US005609428A

United States Patent [19]

Tanaka et al.

[11] Patent Number: 5,609,428

[45] Date of Patent: Mar. 11, 1997

[54] SHEET CARRYING APPARATUS

[75] Inventors: Naoya Tanaka; Hiroshi Fukumoto, both of Hyogo; Keiichi Fukazawa; Mitsuaki Tanaka, both of Hiroshima, all of Japan

[73] Assignee: Mitsubishi Denki Kabushiki Kaisha, Tokyo, Japan

[21] Appl. No.: 507,611

[22] Filed: Jul. 19, 1995

[30] Foreign Application Priority Data

Jul. 26, 1994 [JP] Japan ..... 6-174466
Jun. 29, 1995 [JP] Japan ..... 7-164132

[51] Int. Cl.[6] ..... B41J 11/42

[52] U.S. Cl. ..... 400/579; 101/228; 271/227; 250/559.37

[58] Field of Search ..... 400/279, 579; 101/228; 271/227, 118, 122, 245; 250/559.51, 559.15, 559.37, 559.39

[56] References Cited

U.S. PATENT DOCUMENTS

| | | | |
|---|---|---|---|
| 4,438,917 | 3/1984 | Janssen et al. | 400/579 |
| 4,567,492 | 1/1986 | Skafuenstedt et al. | 400/579 |
| 4,627,607 | 12/1986 | Ishii | 271/122 |
| 5,084,626 | 1/1992 | Dragon et al. | 400/579 |
| 5,138,341 | 8/1992 | Kobayashi | 400/579 |
| 5,154,412 | 10/1992 | Iseda | 271/227 |
| 5,156,391 | 10/1992 | Roller | 271/227 |
| 5,169,140 | 12/1992 | Wenthe, Jr. | 271/227 |
| 5,253,862 | 10/1993 | Acquaviva et al. | 271/227 |
| 5,290,024 | 3/1994 | Takahashi | 271/116 |
| 5,322,273 | 6/1994 | Rapkin et al. | 271/227 |
| 5,407,191 | 4/1995 | Ukai | 271/227 |
| 5,428,431 | 6/1995 | Abe et al. | 271/245 |

FOREIGN PATENT DOCUMENTS

| | | |
|---|---|---|
| 0368643 | 11/1990 | European Pat. Off. . |
| 59-091076 | 5/1984 | Japan . |
| 61-074872 | 4/1986 | Japan . |
| 1075267 | 3/1989 | Japan . |
| 1214555 | 8/1989 | Japan . |
| 3264372 | 11/1991 | Japan . |
| 4049072 | 2/1992 | Japan . |

*Primary Examiner*—Eugene H. Eickholt
*Attorney, Agent, or Firm*—Sughrue, Mion, Zinn, Macpeak & Seas

[57] ABSTRACT

A sheet carrying apparatus reduces skew of a sheet during carriage, and realizes high-quality print. A position detecting sensor detects a position in a direction perpendicular to a sheet carrying direction of the sheet carried by a sheet carrying roller. A skew angle of the sheet is calculated depending upon a deviation of the detected position from a predetermined reference position. Load rollers are on the right and left sides with respect to a sheet center line in the sheet carrying direction, and are respectively opposed to following rollers through the sheet so as to bring the sheet into pressure contact. A torque limiter to apply a braking force to the load roller, and the load roller are coupled or released by electromagnetic clutches. Thereby, the carrying forces can independently be controlled on the right and left sides of the sheet depending upon the skew angle.

2 Claims, 44 Drawing Sheets

———: LOAD ROLLER 31a

—·—·—: LOAD ROLLER 31b

SHEET CARRYING APPARATUS

BACKGROUND OF THE INVENTION

1. Field of the Invention

The present invention relates to a sheet carrying apparatus to carry, for example, a recording paper, or the original for use in a printer, a copying machine, facsimile, a duplicating apparatus, or the like.

2. Description of the Prior Art

FIG. 49 is a perspective view showing an essential part of a sheet carrying apparatus for a conventional color thermal printer disclosed in Japanese Patent Publication (Kokai) No. 4-10965. FIG. 50 is a side view thereof. In FIG. 49, an ink sheet 6 and an ink sheet carrying portion are omitted. In FIGS. 49 and 50, reference numeral 1 means a sheet carrying roller, 2 is first pulleys, 3 is timing belts, 4 is second pulleys, 5 is third pulleys, 6 is an ink sheet, 7 is a sheet supply portion, 9 is a thermal head, and 10 is a clamp mechanism to clamp a distal end of a sheet. The clamp mechanism is, for example, a clamper. Reference numerals 11 and 12 mean drive motors, 13 is a torque limiter, 15 is a supply roll, 16 is a winding roll, 17 is a drive motor, 18 and 19 are torque limiters, and 30 is the sheet. The two first pulleys 2, the two timing belts 3, the two second pulleys 4, and the two third pulleys 5 are respectively disposed on the right and left sides with respect to a sheet center line in a sheet carrying direction.

When the sheet 30 is supplied from the sheet supply portion 7, and the distal end thereof is inserted into the clamper 10, the clamper 10 is closed by an unillustrated clamper opening and closing mechanism so that the clamper 10 can clamp the distal end of the sheet 30. The clamper 10 includes a bridge 10*a* and a holder 10*b* mounted to the bridge 10*a*. The bridge 10*a* is interposed between the right and left timing belts 3 to extend in a direction perpendicular to the sheet carrying direction. The distal end of the sheet 30 is clamped by the bridge 10*a* and the holder 10*b*.

The timing belts 3 are tensed through the first pulleys 2, the second pulleys 4, and the third pulleys 5. A shaft to which the second pulleys 4 are secured is coupled with the drive motor 12 through the torque limiter 13. The clamper 10 mounted to the timing belts 3 is moved by forward rotation of the drive motor 12 in a direction shown by the arrow A while the clamper 10 clamping the sheet 30. Unless the torque limiter 13 is slipped, a speed $V_2$ of the clamper is determined by a rotational speed of the drive motor 12. When the sheet 30 clamped by the clamper 10 reaches the sheet carrying roller 1, the thermal head 9 is brought into pressure contact with the sheet 30 by an unillustrated mechanism, and the ink sheet 6 and the sheet 30 are held between the sheet carrying roller 1 and the thermal head 9.

The sheet carrying roller 1 is coupled with the drive motor 11. Forward rotation of the drive motor 11 can carry the ink sheet 6 and the sheet 30. The ink sheet 6 is supplied from the supply roll 15 to pass through the sheet carrying roller 1 and the thermal head 9, and is wound up by the winding roll 16. The winding roll 16 is coupled with the drive motor 17 through the torque limiter 18. Rotation of the drive motor 17 rotates the winding roll 16. Further, the supply roll 15 is coupled with the torque limiter 19.

In the above structure, while the sheet 30 is clamped by the clamper 10, the sheet 30 is circularly carried through the first pulleys 2, the third pulleys 5, and the second pulleys 4 so as to return to an original position. During the operation, the thermal head 9 is brought into pressure contact with the sheet 30 through the ink sheet 6, thereby transferring print color material applied onto the ink sheet 6 to the sheet 30. In particular, in case of a color thermal printer, the transferring operation is repeated three or four times, and the ink sheet 6 is exchanged to provide different colors for each transfer, resulting in formation of a color image.

At a time of print, as described above, the sheet 30 is held together with the ink sheet 6 between the sheet carrying roller 1 and the thermal head 9. Therefore, the sheet 30 is carried at a constant speed $V_1$ which is determined by a rotational speed of the sheet carrying roller 1. Here, the speed $V_2$ of the clamper 10 is set to be continuously faster than the speed $V_1$. Hence, during the print operation, the torque limiter 13 is slid to absorb a difference between the speeds $V_1$ and $V_2$. When the torque limiter 13 is slid, predetermined torque determined by the torque limiter 13 is transmitted to the clamper 10 through the second pulleys 4 and the timing belts 3. That is, at the time of print, the clamper 10 tenses the sheet 30 with tensile strength according to the predetermined torque. Further, a speed $V_3$ of the ink sheet is set to be continuously faster than the speed $V_1$. Thus, as in the clamper 10, at the time of print, tensile strength determined by diameters of the torque limiter 19 and the winding roll 16 is applied to the ink sheet 6 on the winding side. In addition, tensile strength determined by a torque value of the torque limiter 19 and a diameter of the supply roll 15 is applied to the ink sheet 6 on the supplying side. Each of the tensile strength is applied to carry the ink sheet 6 without wrinkling the ink sheet 6.

However, in order to print on the sheet 30 at a predetermined position, it is necessary to finely control, for example, pressure contacting forces in members, and tensile strength of the sheet 30 and the ink sheet 6 such that the sheet 30 is carried in a predetermined carrying direction at a predetermined carrying speed. For example, when a lateral pressure contacting force of the thermal head 9 to the sheet carrying roller 1 is offset, the carrying speed of the sheet 30 tends to become larger in a direction from a position with a low pressure contacting force to a position with a high pressure contacting force. As a result, there is a problem in that the sheet 30 is carried in a state in which the sheet 30 is deviated from the predetermined carrying direction, that is, so-called skew is caused. The skew of the sheet 30 may cause reduced image quality because the image can not be printed on the sheet 30 at the predetermined position.

Further, when a diameter of the sheet carrying roller 1 is increased due to thermal expansion, for example, if a higher gray level image is printed exclusively on a single side in a horizontal scanning direction, the skew is caused. Further, when the diameter of the sheet carrying roller 1 is increased due to thermal expansion, if the higher gray level image is printed through an entire print area, there is another problem in that an amount of carriage of the sheet 30 is deviated from a regular value. That is, the whole amount of carriage is increased so that a predetermined print length can not be obtained.

Since a rubber roller is typically used as the sheet carrying roller 1, wear is caused in the sheet carrying roller 1 due to long-term use so as to decrease its diameter. Hence, there is still another problem in that the print length becomes shorter than that of a predetermined value in process of time.

Axial chattering may be generated in the respective pulleys 2, 4, and 5 at which the timing belts 3 are wound. Thus, there is a further problem in that the clamper 10 secured to the timing belts 3 is deviated by this chattering in the horizontal scanning direction, and the sheet 30 is translated (hereinafter referred to as shifted) in the horizontal scanning direction.

When only a partial distal end of the sheet 30 is slightly released from the clamper 10, the sheet 30 is carried in a slightly inclined state. Thus, there is a further problem in that an amount of shift is more increased at a later end of the sheet.

Further, in the sheet 30, the skew, a deviation of the amount of carriage, and the shift may concurrently be generated. In such a case, it is impossible to overcome the above problems by only control in view of mechanism.

In particular, in case of the thermal color printer, the skew of the sheet, the variation in the amount of carriage in the carrying direction, and the shift in the horizontal scanning direction may be generated during print and carriage. As a result, registration of colors can not be made at a predetermined position, resulting in misregistration of the colors. The misregistration of color may reduce the image quality.

SUMMARY OF THE INVENTION

In order to overcome the above problems, it is an object of the present invention to provide a sheet carrying apparatus which can correct skew of a sheet during carriage, and enables high-quality print. It is another object of the present invention to provide a sheet carrying apparatus which can correct an amount of carriage or a shift of the sheet during carriage, and enables the high-quality print. It is still another object of the present invention to provide a sheet carrying apparatus which enables the high-quality print even when the sheet is carried a plurality of times on the same path.

According to one aspect of the present invention, for achieving the above-mentioned objects, there is provided a sheet carrying apparatus including sheet carrying means for carrying a sheet, position detecting means for detecting a position of the sheet during carriage in a direction perpendicular to a sheet carrying direction, calculating means for calculating a skew angle of the sheet depending upon a deviation of the position of the sheet detected by the position detecting means from a predetermined reference position, carrying force control means disposed on the right and left sides with respect to a sheet center line in the sheet carrying direction so as to extend in the direction perpendicular to the sheet carrying direction, for controlling a carrying force for the sheet during carriage, and driving means for independently driving the right and left carrying force control means depending upon the skew angle calculated by the calculating means.

The above calculating means calculates the skew angle depending upon the position of the sheet detected by the position detecting means during sheet carriage. Further, the carrying force control means control the carrying force for the sheet depending upon the skew angle such that the sheet is rotated in a direction opposed to a direction of the calculated skew, thereby correcting the skew of the sheet during the sheet carriage.

According to another aspect of the present invention, there is provided a sheet carrying apparatus including sheet carrying means for carrying a sheet, carriage detecting means for detecting an amount of carriage of the sheet during carriage at a plurality of positions in a direction perpendicular to a sheet carrying direction, calculating means for calculating a skew angle of the sheet and a deviation of the amount of carriage depending upon deviations of the amounts of carriage detected by the carriage detecting means from a predetermined amount of reference carriage, carrying force control means disposed on the right and left sides with respect to a sheet center line in the sheet carrying direction so as to extend in the direction perpendicular to the sheet carrying direction, for controlling a carrying force for the sheet during carriage, driving means for independently driving the right and left carrying force control means depending upon the skew angle calculated by the calculating means, and carriage control means for controlling the amount of sheet carriage depending upon the deviation of the amount of carriage calculated by the calculating means.

During sheet carriage, the above carriage detecting means detect the amounts of carriage of the sheet at two or more positions in the direction perpendicular to the sheet carrying direction. The calculating means calculates the skew angle of the sheet and the deviation of the amount of carriage depending upon the deviations of the amounts of carriage detected by the carriage detecting means from the predetermined amount of reference carriage. Further, the carrying force control means control the carrying force for the sheet depending upon the calculated skew angle, and control the amount of sheet carriage depending upon the deviation of the calculated amount of carriage, thereby correcting the skew of the sheet and the deviation in the carrying direction during sheet carriage.

The carrying force control means include, for example, carriage load applying means for applying carriage load to the sheet at a portion in the upstream of the sheet carrying means.

The above carriage load applying means apply the carriage load to the sheet at the portion in the upstream of the sheet carrying means. When the sheet is skew, the skew is corrected by applying the carriage load to the sheet on the side moved more ahead, or removing the carriage load from the sheet on the side delayed.

The carrying force control means may include carrying force applying means for applying the carrying force to the sheet at a portion in the downstream of the sheet carrying means.

The above carrying force applying means apply the carrying force to the sheet at the portion in the downstream of the sheet carrying means. When the sheet is skew, the skew is corrected by applying the carrying force in the carrying direction to the sheet on the side whose carriage is delayed, or removing the carrying force from the sheet on the side carried more ahead.

The carriage load applying means are, for example, disposed in the upstream of the sheet carrying means, and include load rollers rotating by pressure contact with the sheet with a predetermined pressure contacting force, braking means able to apply a constant or predetermined range of braking force to the load rollers, and following rollers disposed at positions opposed to the load rollers through the sheet.

The above carriage load applying means apply the carriage load to the sheet by the braking means applying the braking force to the load rollers in contact with the sheet.

The carriage load applying means may be disposed in the upstream of the sheet carrying means, and may include load members to contact the sheet so as to apply the carriage load to the sheet, pressure contact members disposed at positions opposed to the load members through the sheet, and a pressure contact mechanism to bring the pressure contact members into pressure contact with or disengage the pressure contact members from the sheet.

The above carriage load applying means couple the braking means with the load rollers in contact with the sheet, and applies the carriage load to the sheet when the pressure contact rollers opposed to the load rollers through the sheet are brought into pressure contact with the sheet with a predetermined pressure contacting force. Further, no carriage load is applied to the sheet when the pressure contact rollers are disengaged from the sheet.

The carriage load applying means may be disposed in the upstream of the sheet carrying means, and may include electrodes disposed at positions in contact with the sheet, and a power source to apply voltage to the electrodes.

The above carriage load applying means cause the electrodes to electrically attract the sheet when the voltage is applied to the electrodes disposed at the positions in contact with the sheet, thereby applying a frictional force between the sheet and the electrodes to the sheet as the carriage load. When no voltage is applied to the electrodes, no carriage load is applied to the sheet.

The carriage load applying means may be disposed in the upstream of the sheet carrying means, and may include magnetic members having magnetism, inductors disposed at positions opposed to the magnetic members through the sheet and able to attract the magnetic members, a power source to apply current to the inductors, and a supporting mechanism to clamp or release the sheet in conjunction with the magnetic members and the inductors.

In the above carriage load applying means, when current is applied to the inductors, the sheet is held between the inductors and the magnetic members, thereby applying a frictional force between the sheet and the magnetic members to the sheet as the carriage load. When no current is applied to the inductors, no carriage load is applied to the sheet.

The carrying force applying means may be disposed in the downstream of the sheet carrying means, and may include a clamp mechanism to clamp a distal end of the carried sheet, and clamp drive mechanisms to independently carry, by a predetermined driving force, the clamp mechanism on the right and left sides with respect to the sheet center line in the sheet carrying direction.

In the above carrying force applying means, the distal end of the carried sheet is clamped by the clamp mechanism, and the clamp drive mechanisms carry the clamp mechanism by the predetermined driving force so as to apply the carrying force to the sheet.

The sheet carrying apparatus may further include an ink sheet, ink sheet carrying means for carrying the ink sheet while applying tensile strength, and an ink sheet roller following and rotating by contacting the ink sheet. In the sheet carrying apparatus, both the sheet and the ink sheet may be carried in a print portion, and the carrying force control means may include vertically movable mechanisms to move the ink sheet roller in a direction in contact with the ink sheet and in its reverse direction.

The above carrying force control means include the ink sheet which is carried while the tensile strength is applied to the ink sheet, and the ink sheet roller which is movable in the direction in contact with the ink sheet. Therefore, both the ink sheet roller and the sheet can be carried in the print portion. The vertically movable mechanisms vary a balance of the tensile strength of the ink sheet so as to control the carrying force applied to the sheet.

In the sheet carrying apparatus, if a sheet is carried a plurality of times on the same carrying path, the calculating means may store a position of the sheet detected by the position detecting means during first carriage of one sheet so as to calculate a skew angle by using the stored position of the sheet as a reference position during second or later carriage.

In the above sheet carrying apparatus, registration is made between the reference position of the sheet in second or later carriage and the position of the sheet during first carriage. As a result, it is possible to reduce a variation in the skew angle of the sheet generated due to a slight variation in sheet shape.

The carriage detecting means may be disposed on the right and left sides with respect to the sheet center line in the sheet carrying direction so as to extend in the direction perpendicular to the sheet carrying direction, and may include carriage detecting rollers respectively contacting the sheet so as to independently follow and rotate, and sensors to detect rotations of the carriage detecting rollers. Further, the calculating means includes first calculating means for calculating carriage times depending upon output signals from the sensors so as to calculate amounts of deviation of the carriage times from a predetermined reference time, and second calculating means for calculating a skew angle of the sheet and a deviation of the amount of carriage depending upon the amounts of deviation calculated by the first calculating means.

The first calculating means calculates the deviation of the carriage times from the reference carriage time on the right and left sides with respect to the sheet center line in the sheet carrying direction. The second calculating means calculates the skew angle of the sheet and the deviation of the amount of carriage depending upon the deviation of the carriage time.

The carrying force control means may be disposed in the upstream of the sheet carrying means, and may include carriage load applying means, for applying carriage load to the sheet at a portion in the upstream of the sheet carrying means, having load rollers rotating by pressure contact with the sheet with a predetermined pressure contacting force, braking means able to apply a constant or predetermined range of braking force to the load rollers, and following rollers disposed at positions opposed to the load rollers through the sheet. The carriage detecting rollers and the carriage load applying means are disposed at positions mutually opposed through the sheet and are brought into pressure contact with the sheet with a predetermined pressure contacting force.

Since the carriage load applying means are disposed at positions opposed to the carriage detecting rollers, a structure of the apparatus is simplified.

The second calculating means may calculate a deviation of the amount of carriage for each n rotation (n is a natural number) of the carriage detecting roller.

The above second calculating means calculates the deviation of the amount of carriage for each n rotation (n is the natural number) of the carriage detecting roller. As a result, it is possible to reduce a variation in detected values of the deviation of the amount of carriage due to eccentricity of the carriage detecting roller or ununiformity in mark intervals of the carriage detecting roller.

In the sheet carrying apparatus, if one sheet is carried a plurality of times on the same carrying path, the sheet carrying apparatus may include a registration mechanism to perform origin registration of a rotation angle of the carriage detecting roller for each carriage of the sheet.

The registration mechanism performs the origin registration of the rotation angle of the carriage detecting roller for each carriage of the sheet. As a result, since rotation of the carriage detecting roller is continuously started from the same position, it is possible to reduce a variation in detected values of the deviation of the amount of carriage due to the eccentricity of the carriage detecting roller or the ununiformity in mark intervals of the detecting roller.

In the sheet carrying apparatus, if one sheet is carried a plurality of times on the same carrying path, the first calculating means may store an amount of carriage or a carriage time of the sheet detected by the carriage detecting means during first carriage so as to calculate a deviation of the amount of carriage by using the stored amount of carriage or the stored carriage time of the sheet as an amount of reference carriage or a reference carriage time during second or later carriage.

In the above structure, a state of the carriage detecting roller in second or later carriage can be matched with a state thereof during first carriage. As a result, it is possible to reduce an adverse effect caused by a variation in diameter of the carriage detecting roller due to wear.

The carrying force control means may control a carrying force for the sheet at least once on both the right and left sides depending upon a calculated skew angle so as to concurrently correct a skew angle and a shift of the sheet during carriage.

The above carrying force control means controls the carrying force at least once on both the right and left sides for each calculation of the skew angle during carriage depending upon the calculated skew angle, thereby concurrently correcting the skew angle and the shift of the sheet.

According to still another aspect of the present invention, there is provided a sheet carrying apparatus including printing means for printing onto a sheet through a print area, position detecting means for detecting a position of the sheet during carriage in a direction perpendicular to a sheet carrying direction, shift calculating means for calculating an amount of shift of the sheet depending upon a deviation of the position of the sheet detected by the position detecting means from a predetermined reference position, and shift correcting means for moving the print area of the printing means in the direction perpendicular to the sheet carrying direction depending upon the amount of shift calculated by the shift calculating means.

The shift calculating means calculate the amount of shift of the sheet in the direction perpendicular to the sheet carrying direction depending upon the position of the sheet detected by the position detecting means. Further, the shift correcting means move the print area in the direction perpendicular to the sheet carrying direction depending upon the calculated amount of shift, thereby correcting the deviation of a print position due to the shift of the sheet.

The printing means may print onto a width longer than a width of the print area in the direction perpendicular to the sheet carrying direction. In this case, the shift correcting means shifts the print area in the direction perpendicular to the sheet carrying direction depending upon the amount of shift calculated by the shift calculating means, thereby controlling the print area.

The above shift correcting means moves the print area depending upon the amount of shift calculated by the shift calculating means, thereby correcting a deviation of a print position due to the shift.

The shift correcting means may include head moving means for moving the printing means in the direction perpendicular to the sheet carrying direction, and the head moving means may be controlled depending upon the amount of shift calculated by the shift calculating means.

The above shift correcting means moves the printing means depending upon the amount of shift calculated by the shift calculating means, thereby correcting a deviation of a print position due to the shift.

In the sheet carrying apparatus, if one sheet is carried a plurality of times on the same carrying path, the shift calculating means may store the position of the sheet detected by the position detecting means during first carriage. In this case, the shift calculating means calculates an amount of shift by using the stored position of the sheet as a reference position during second or later carriage.

The above shift calculating means stores the position of the sheet detected by the position detecting means during first carriage, and uses the position as the sheet reference position so as to calculate the amount of shift during second or later carriage. Since a reference position of the print area during second or later carriage is matched with the position detected during first carriage, it is possible to reduce a variation in the amount of shift of the sheet generated due to a slight variation in sheet shape.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Embodiment 1

Figure 1:
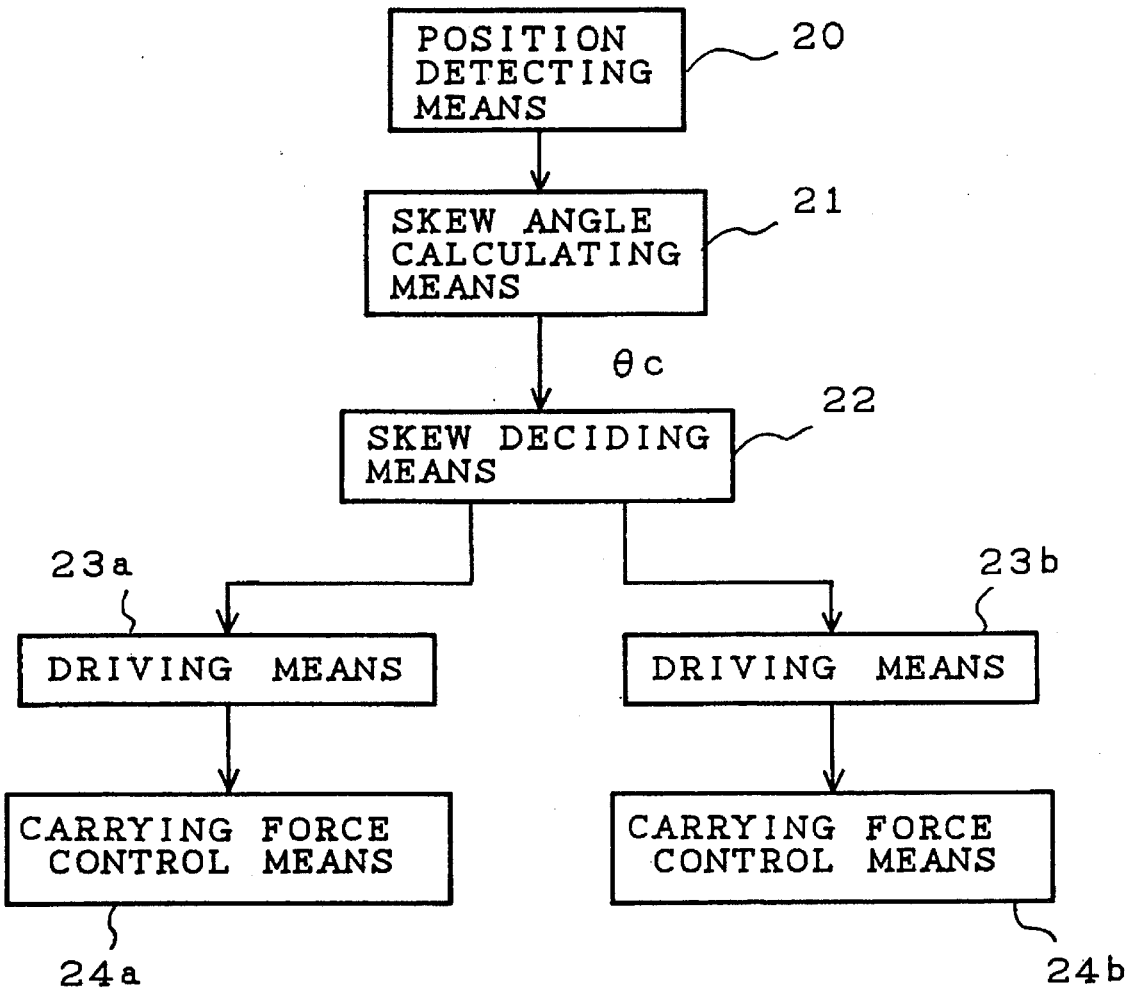
FIG. 1 is a block diagram showing a control system in the first embodiment of a sheet carrying apparatus of the present invention.

FIG. 1 is a block diagram showing a control system in the first embodiment of a sheet carrying apparatus of the present invention. In FIG. 1, reference numeral 20 means position detecting means for detecting a position of a sheet in a direction perpendicular to a sheet carrying direction (i.e., in a horizontal scanning direction), 21 is calculating means (skew angle calculating means) for calculating a skew angle of the sheet, 22 is skew deciding means for deciding whether or not the sheet is skew depending upon the calculated skew angle, 23*a* and 23*b* are driving means, and 24*a* and 24*b* are carrying force control means mounted on the right and left sides of the sheet to correspond to the driving means 23*a* and 23*b*. The carrying force control means 24*a* and 24*b* are mounted on the right and left sides with respect to a sheet center line in the sheet carrying direction so as to independently control application of a carrying force to the sheet. In the following discussion, one of the driving means 23*a* and 23*b* is sometimes referred to as driving means 23, and one of the carrying force control means 24*a* and 24*b* is sometimes referred to as carrying force control means 24.

A description will now be given of correction of skew of the sheet. The position detecting means 20 detects, on demand during carriage, the position of the sheet carried by sheet carrying means. Here, the detected position of the sheet is a position in the horizontal scanning direction. The skew angle calculating means 21 calculates the skew angle $\theta_c$ of the sheet depending upon a deviation of sheet position data outputted from the position detecting means 20 from a predetermined reference position. Next, the skew deciding means 22 compares the calculated skew angle $\theta_c$ with a predetermined permissible skew angle $\theta_0$. If the skew angle $\theta_c$ exceeds the permissible skew angle $\theta_0$, the skew deciding means 22 selects any one of the carrying force control means 24*a* and 24*b* depending upon the skew angle $\theta_c$ such that the sheet is skewed in a direction opposed to the calculated skew. Further, the skew deciding means 22 outputs a drive signal to the driving means 23 corresponding to the selected carrying force control means 24. The driving means 23 drives carrying force control means 24 according to the drive signal inputted from the skew deciding means 22. As a result, the carrying force is applied to the sheet so as to correct the skew of the sheet. When a value of $\theta_c$ calculated after the carrying force control means 24 is driven becomes within $\theta_0$, drive of the carrying force control means 24 is stopped, or the carrying force control means 24 returns to a predetermined initial state.

The above operation is repeated until carriage of the sheet is completed. It is thereby possible to correct the skew of the sheet generated during carriage. without stopping the carriage of the sheet.

The magnitude of the permissible skew angle $\theta_0$ is less than a desired target value, and is determined in consideration of, for example, detection accuracy of the position detecting means 22 or correction accuracy by the carrying force control means 24.

Detailed embodiments of the respective means will be described in the fifth and later embodiments.

Embodiment 2

Figure 2:
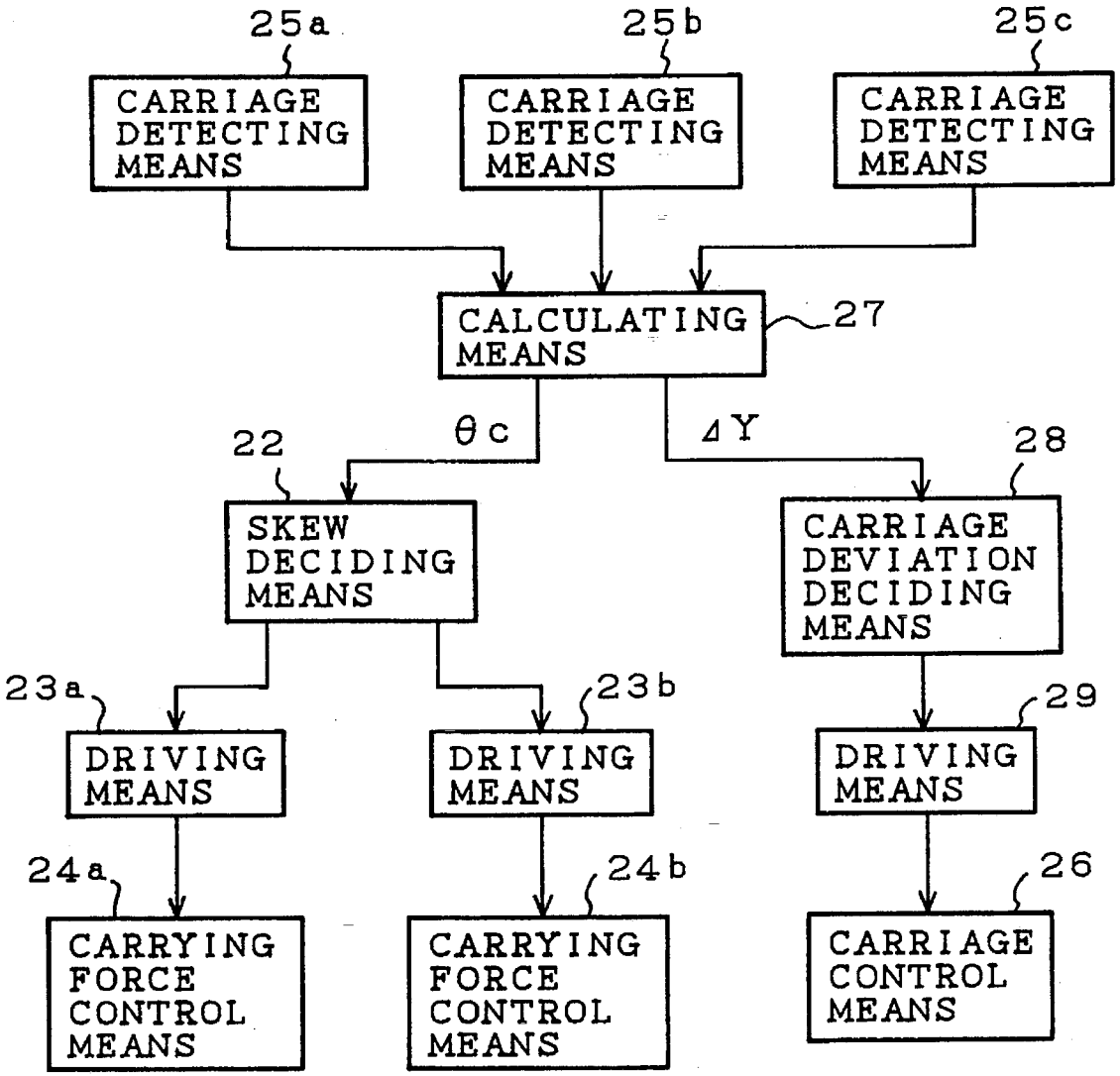
FIG. 2 is a block diagram showing a control system in the second embodiment of the sheet carrying apparatus of the present invention.

FIG. 2 is a block diagram showing a control system in the second embodiment of the sheet carrying apparatus of the present invention. In FIG. 2, carriage detecting means 25 are opposed to a sheet, and are disposed at predetermined positions in a horizontal scanning direction so as to detect amounts of carriage of the sheet at the respective positions. When the carriage detecting means 25 include a plurality of detecting elements, the elements are respectively referred to as carriage detecting means 25*a*, 25*b*, and 25*c*. Though the three carriage detecting means 25*a*, 25*b*, and 25*c* are illustrated in FIG. 2, it must be noted that the present invention should not be limited to three carriage detecting means, and only one carriage detecting means may be sufficient as long as it is possible to detect the amounts of carriage at two or more positions in the horizontal scanning direction, or a distribution of the amount of carriage in the horizontal scanning direction.

As the carriage detecting means 25, it is possible to employ, for example, a plurality of laser Doppler speedometer disposed at a plurality of positions in the horizontal scanning direction with respective to the sheet, or one pair of a light source and a two-dimensional CCD sensor opposed to the sheet. Reference numeral 26 means carriage control means for controlling so as to substantially uniformly provide a carrying speed of the sheet in the horizontal scanning direction. Reference numeral 27 means calculating means, 28 is carriage deviation deciding means, and 29 is driving means for driving the carriage control means 26.

A description will now be given of correction of skew of the sheet and a deviation of the amount of carriage. The carriage detecting means 25 detect the amount of carriage of the sheet at predetermined positions on the sheet on demand. The calculating means 27 calculates the skew angle $\theta_c$ of the sheet and the deviation $\Delta Y$ of the amount of carriage depending upon a deviation of amount of carriage data outputted from the carriage detecting means 25 from a predetermined amount of carriage. The calculated skew angle $\theta_c$ and the deviation $\Delta Y$ are respectively outputted to skew deciding means 22 and the carriage deviation deciding means 28. The skew deciding means 22 compares the skew angle $\theta_c$ with a predetermined permissible skew angle $\theta_0$. The carriage deviation deciding means 28 compares the deviation $\Delta Y$ with a deviation $\Delta Y_0$ of a predetermined amount of permissible carriage. If the skew angle $\theta_c$ exceeds the permissible skew angle $\theta_0$, the skew deciding means 22 carries out correction depending upon the skew angle $\theta_c$ in the same process as that in the first embodiment.

Further, if the deviation $\Delta Y$ of the amount of carriage exceeds the deviation $\Delta Y_0$ of the amount of permissible carriage, the carriage deviation deciding means 28 outputs carriage correcting data depending upon the deviation $\Delta Y$ to the driving means 29. The driving means 29 drives the carriage control means 26 according to the carriage correcting data. When the deviation $\Delta Y$ and the skew angle $\theta_c$ calculated after each correcting operation is started become within $\Delta Y_0$ and $\theta_0$, the correcting operations corresponding to the calculated values are stopped, or the carriage control means 26 returns to a predetermined initial state.

The above operation is repeated until carriage of the sheet is completed. It is thereby possible to correct the skew of the sheet and the deviation of the amount of carriage which are generated during carriage without stopping the carriage of the sheet.

As used herein, the magnitudes of the permissible skew angle $\theta_0$ and the deviation $\Delta Y_0$ of the amount of permissible carriage are less than desired target values, and are determined in consideration of, for example, detection accuracy of the carriage detecting means 25, and correction accuracy by the carrying force control means 24 and the carriage control means 26.

Detailed embodiments of the respective means will be described in the fifth and later embodiments.

Embodiment 3

Figure 3:
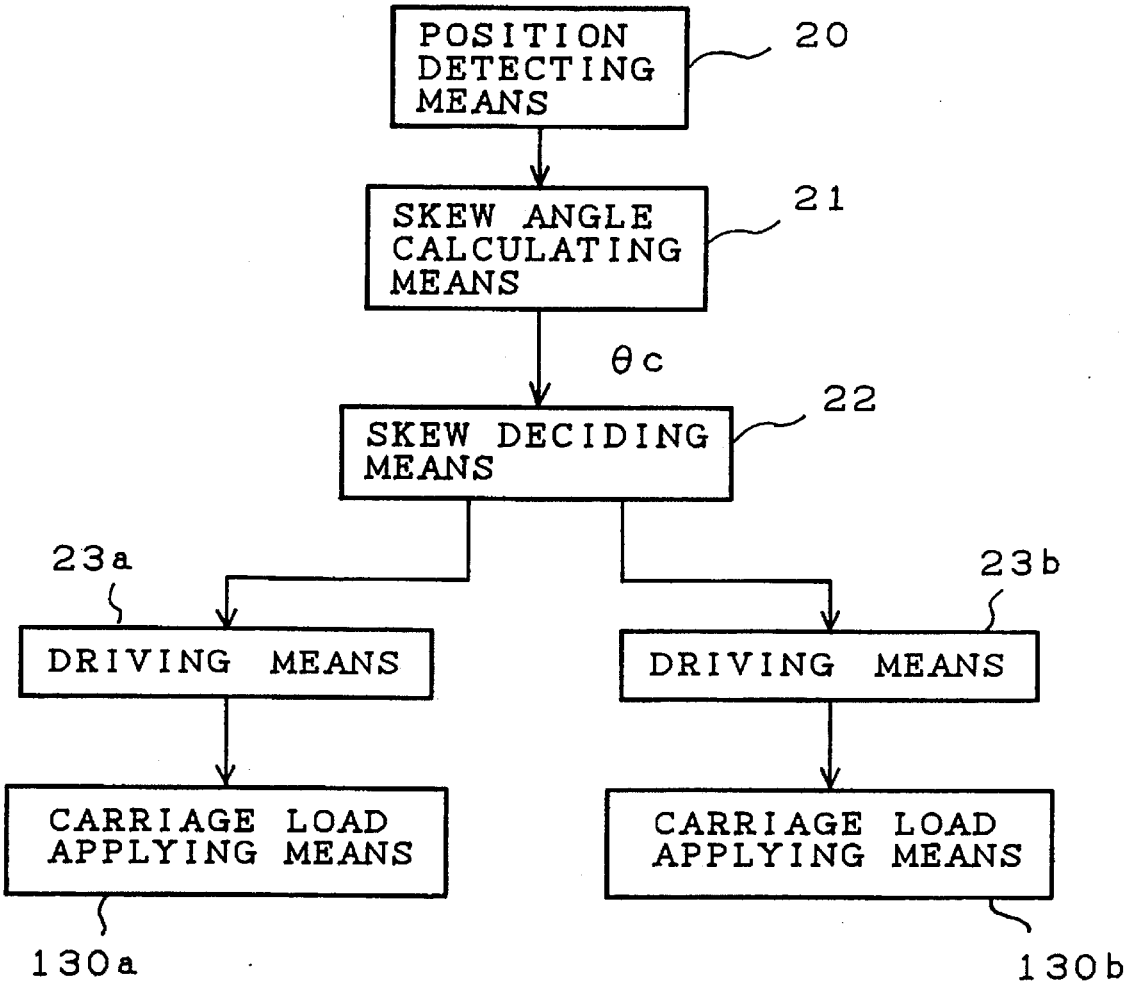
FIG. 3 is a block diagram showing a control system in the third embodiment of the sheet carrying apparatus of the present invention.

FIG. 3 is a block diagram showing a control system in the third embodiment of the sheet carrying apparatus of the present invention. In the sheet carrying apparatus according to the embodiment, there are provided carriage load applying means for applying carriage load to a sheet 30 at a portion disposed in the upstream of sheet carrying means, corresponding to the carrying force control means 24*a* and 24*b* in the first and second embodiments. The carriage load applying means 130*a* and 130*b* are disposed, in the upstream of the sheet carrying means, on the right and left sides with respect to a sheet center line in a sheet carrying direction so as to independently apply the carriage load to the sheet. In the following discussion, the carriage load applying means 130*a* or 130*b* is sometimes referred to as carriage load applying means 130.

A description will now be given of correction of skew of the sheet. Skew deciding means 22 compares a skew angle $\theta_c$ calculated in skew angle calculating means 21 with a predetermined permissible skew angle $\theta_0$. If the skew angle $\theta_c$ exceeds the permissible skew angle $\theta_0$, the skew deciding means 22 selects any one of the carriage load applying means 130*a* and 130*b* depending upon the skew angle $\theta_c$ such that the sheet is skewed in a direction opposed to the calculated skew. Specifically, the carriage load applying means 130 to be driven is selected so as to apply the carriage load to the sheet on the side carried more ahead due to the skew. Further, the skew deciding means 22 outputs a drive signal to driving means 23 corresponding to the selected carriage load applying means 130. The driving means 23 drives the carriage load applying means 130 according to the drive signal inputted from the skew deciding means 22 so as to apply the carriage load to the sheet. When a value of $\theta_c$ calculated after the carriage load applying means 130 is driven becomes within $\theta_0$, drive of the carriage load applying means 130 is stopped.

The above operation is repeated until carriage of the sheet is completed. It is thereby possible to correct the skew of the sheet generated during carriage without stopping the carriage of the sheet.

Though the carriage load is applied to the sheet at a time of correction in the embodiment, it must be noted that the skew correction for the sheet should not be limited to such a control method. For example, when the correction is not required, the carriage load applying means 130*a* or 130*b* may uniformly apply predetermined carriage load to the right and left sides of the sheet. Further, at the time of correction, the carriage load on any one of both the sides may be removed depending upon the skew angle $\theta_c$, resulting in the same effect. In this case, the carriage load applying means 130 is driven so as to remove the carriage load from the sheet on the side whose carriage is delayed due to the skew.

Embodiment 4

Figure 4:
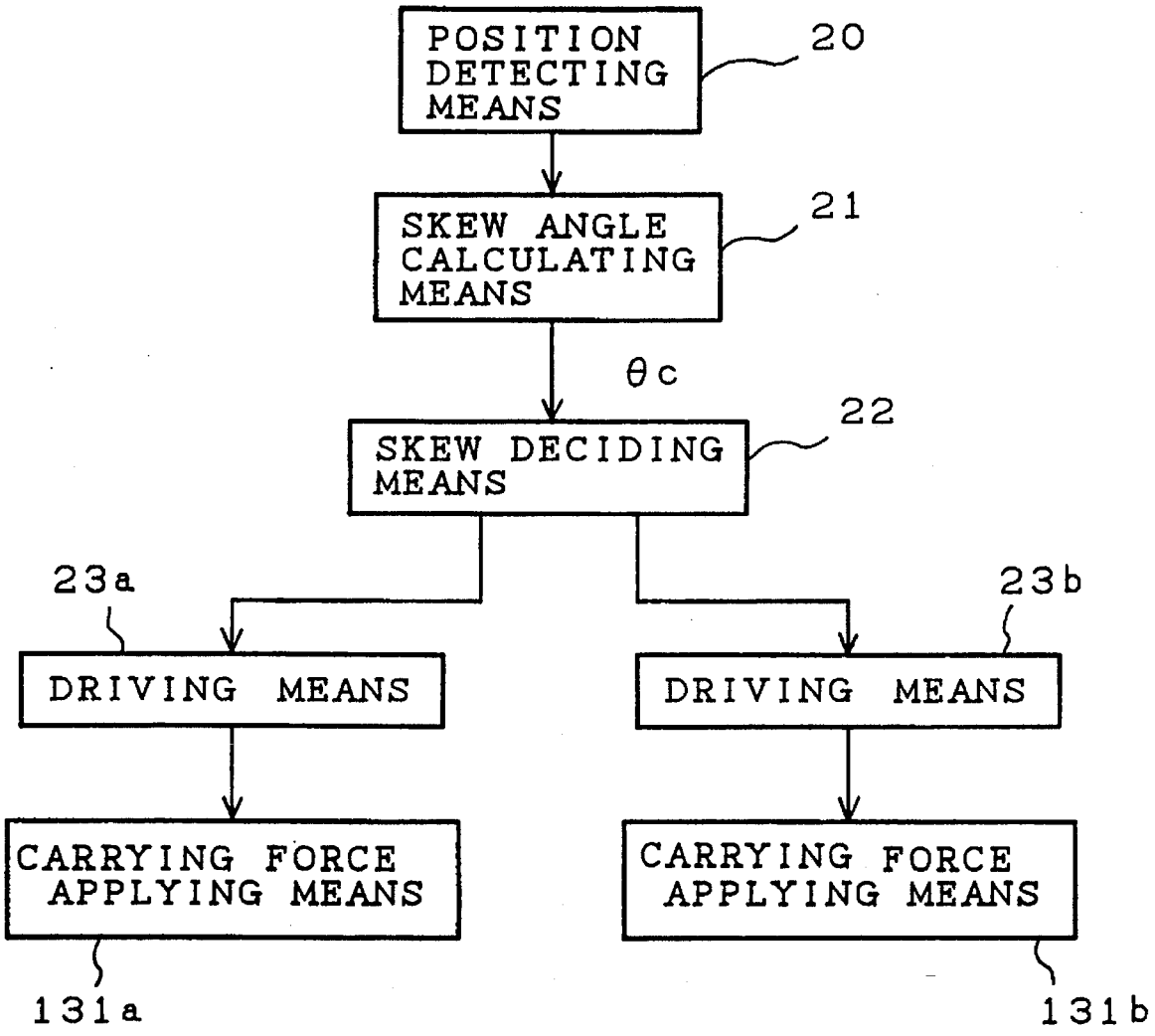
FIG. 4 is a block diagram showing a control system in the fourth embodiment of the sheet carrying apparatus of the present invention.

FIG. 4 is a block diagram showing a control system in the fourth embodiment of the sheet carrying apparatus of the present invention. In the sheet carrying apparatus according to the embodiment, carrying force applying means are disposed in the downstream of sheet carrying means so as to correspond to the carrying force control means 24 in the first and second embodiments. Carrying force applying means 131*a* and 131*b* are disposed, in the downstream of the sheet carrying means, on the right and left sides with respect to a sheet center line in a sheet carrying direction so as to independently apply a carrying force to a sheet. The carrying force is applied in the carrying direction of the carried sheet. In the following discussion, the carrying force applying means 131*a* or 131*b* is sometimes referred to as carrying force applying means 131.

A description will now be given of correction of skew of the sheet. Skew deciding means 22 compares a skew angle $\theta_c$ calculated in skew angle calculating means 21 with a predetermined permissible skew angle $\theta_0$. If the skew angle $\theta_c$ exceeds the permissible skew angle $\theta_0$, the skew deciding means 22 selects any one of the carrying force applying means 131*a* and 131*b* to be driven depending upon the skew angle $\theta_c$ such that the sheet is skewed in a direction opposed to the calculated skew. Specifically, the carrying force applying means 131 is selected such that the carriage load is applied to the sheet on the side delayed due to the skew. Further, the skew deciding means 22 outputs a drive signal to driving means 23 corresponding to the selected carrying force applying means 131. The driving means 23 drives the carrying force applying means 131 according to the drive signal inputted from the skew deciding means 22 so as to apply the carriage load to the sheet. When a value of $\theta_c$ calculated after the carrying force applying means 131 is driven becomes within $\theta_0$, drive of the carrying force applying means 131 is stopped.

The above operation is repeated until carriage of the sheet is completed. It is thereby possible to correct the skew of the sheet generated during carriage without stopping the carriage of the sheet.

Though the carriage load is applied to the sheet at a time of correction in the embodiment, it must be noted that the skew correction for the sheet should not be limited to such a control method. For example, when the correction is not required, the respective carrying force applying means 131*a* and 131*b* may uniformly apply predetermined carrying forces to the right and left sides of the sheet. Further, at the time of correction, the carrying force on any one of both the sides may be removed depending upon the skew angle $\theta_c$, resulting in the same effect. In this case, the carrying force applying means 131 is driven so as to remove the carrying force from the sheet on the side carried more ahead due to the skew.

Embodiment 5

Figure 5:
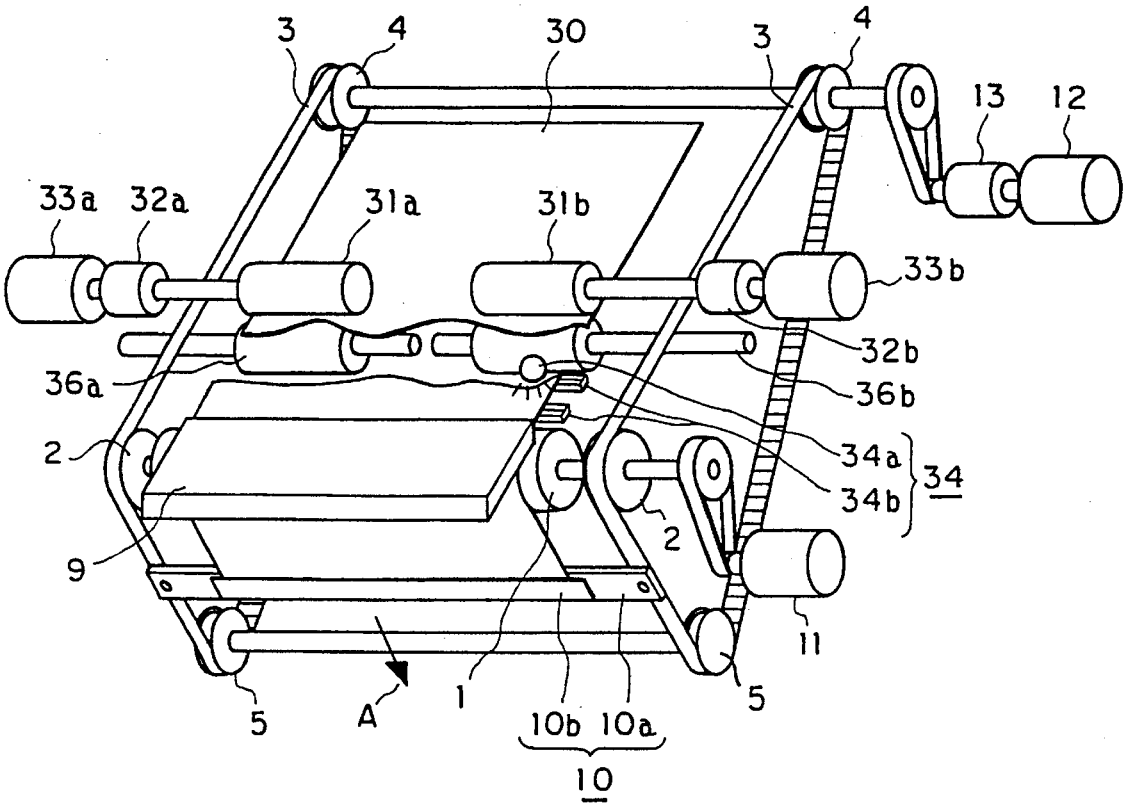
FIG. 5 is a perspective diagram showing an essential structure in the fifth embodiment of the sheet carrying apparatus of the present invention.
Figure 49:
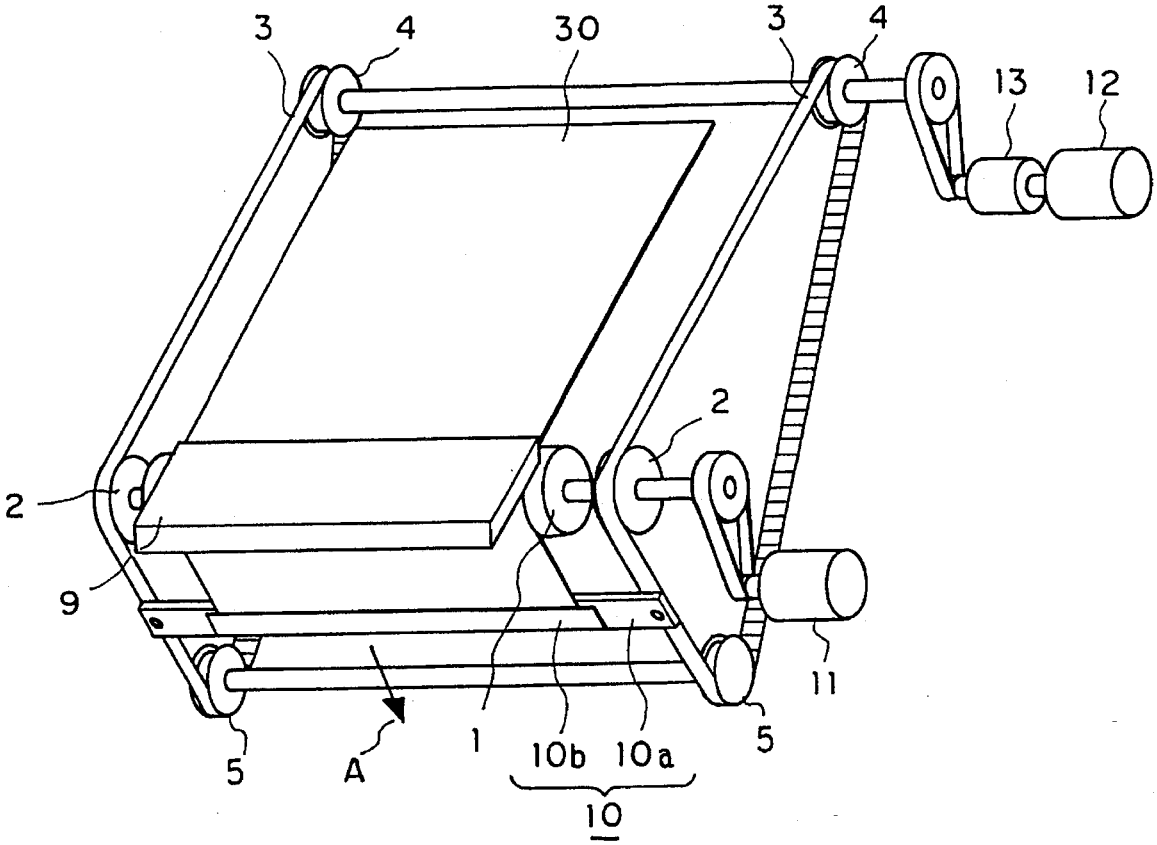
FIG. 49 (PRIOR ART)
FIG. 49 is a perspective view showing an essential structure of a conventional sheet carrying apparatus.
Figure 50:
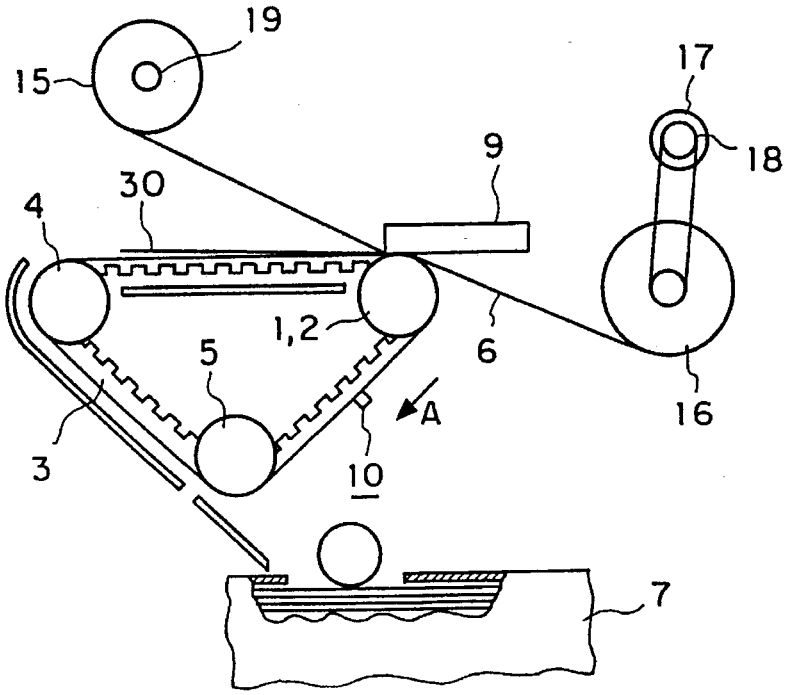
FIG. 50 (PRIOR ART)
FIG. 50 is a side view showing the essential structure of the conventional sheet carrying apparatus.

FIG. 5 is a perspective diagram showing an essential structure in the fifth embodiment of the sheet carrying apparatus of the present invention. FIG. 5 shows a sheet 30 which is partially cut away. The same reference numerals are used for component parts equivalent to or identical with those shown in FIGS. 49 and 50. In the drawing, an ink sheet 6 and an ink sheet carrying portion are omitted.

In FIG. 5, a distal end of the sheet 30 is clamped by a clamper 10, and is circularly carried in a direction shown by the arrow A in the drawing by forward rotation of a sheet carrying roller 1 serving as one embodiment of sheet carrying means. At the time, the clamper 10 circulates while applying predetermined tensile strength to the sheet 30. In the upstream of the sheet carrying roller 1, there are disposed, on the right and left sides with respect to a sheet center line in a sheet carrying direction, load rollers 31*a* and 31*b* and following rollers 36*a* and 36*b* respectively having substantially the same diameter so as to extend in a horizontal scanning direction. In the following discussion, the load roller 31*a* or 31*b* is sometimes referred to as load roller 31, and the following roller 36*a* or 36*b* is sometimes referred to as following roller 36. Further, the respective rollers 31 and 36 are independently and rotatably supported. For example, rubber rollers, or metallic rollers having fine irregularity of their surfaces are employed as the load rollers 31*a* and 31*b*. The load rollers 31*a* and 31*b* are respectively in contact with the following rollers 36*a* and 36*b* under predetermined contact pressure through the sheet 30. Torque limiters 33*a* and 33*b* having substantially the same torque value are coupled with the load rollers 31*a* and 31*b* through electromagnetic clutches 32*a* and 32*b*. The load rollers 31*a* and 31*b*, the torque limiters 33*a* and 33*b*, and the electromagnetic clutches 32*a* and 32*b* form carriage load applying means. The torque limiters 33*a* and 33*b* correspond to braking means for applying braking forces to the load rollers 31*a* and 31*b*. Carriage load determined by the torque values of the torque limiters 33*a* and 33*b* is applied to the sheet 30. The electromagnetic clutches 32*a* and 32*b* couple the load rollers 31*a* and 31*b* with/disengage the load rollers 31*a* and 31*b* from the torque limiters 33*a* and 33*b*, thereby controlling transmission of the carriage load.

It must be noted that the carriage load is smaller than a force by which the sheet 30 is gripped by the sheet carrying roller 1 in response to pressure contact of a thermal head 9. Therefore, setting is made such that skew can be corrected substantially without stopping sheet feed at the load roller 31. As sheet position detecting means, a position detecting sensor 34 is disposed in the vicinity of an edge of the sheet 30 between the sheet carrying roller 1 and the load rollers 31*a* and 31*b*. The position detecting sensor 34 includes a light source 34*a* and two line-type CCD sensors 34*b* arrayed in the carrying direction. A position of the sheet edge in the horizontal scanning direction is detected depending upon a position of shade of the edge of the sheet 30, which is projected onto the CCD sensors 34*b*.

Figure 6:
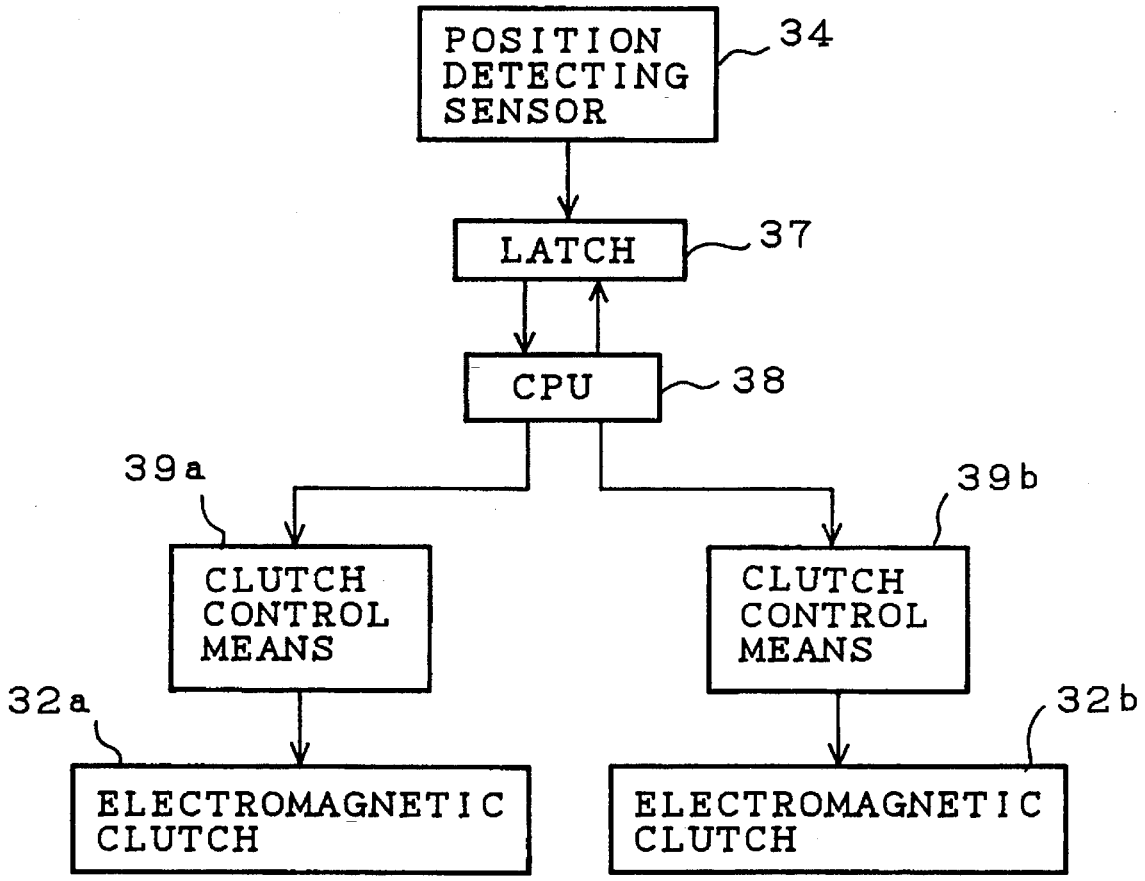
FIG. 6 is a block diagram showing a control system in the fifth embodiment.

FIG. 6 is a block diagram showing a control system in the embodiment. The same reference numerals are used for component parts identical with or equivalent to those shown in FIG. 5. The position of the sheet edge in the horizontal scanning direction, detected in the position detecting sensor 34, can be outputted as position data to a latch 37 on demand. In synchronization with a signal from a central processing unit (CPU) 38 of a computer, the position data is read from the latch 37 into the CPU 38. The CPU 38 implementing skew angle calculating means calculates a skew angle $\theta_c$ depending upon the read position data of the sheet. Further, the CPU 38 compares the calculated skew angle $\theta_c$ with a predetermined permissible skew angle $\theta_0$. It is thereby decided whether or not correction is required. If the correction is required, the CPU 38 selects, depending upon the calculated skew angle $\theta_c$, an electromagnetic clutch 32 to be driven. Further, the CPU 38 outputs a coupling signal to clutch control means 39 corresponding to the selected electromagnetic clutch 32. The clutch control means 39 sets the electromagnetic clutch 32 in a coupled state in response to the inputted coupling signal.

Figure 7:
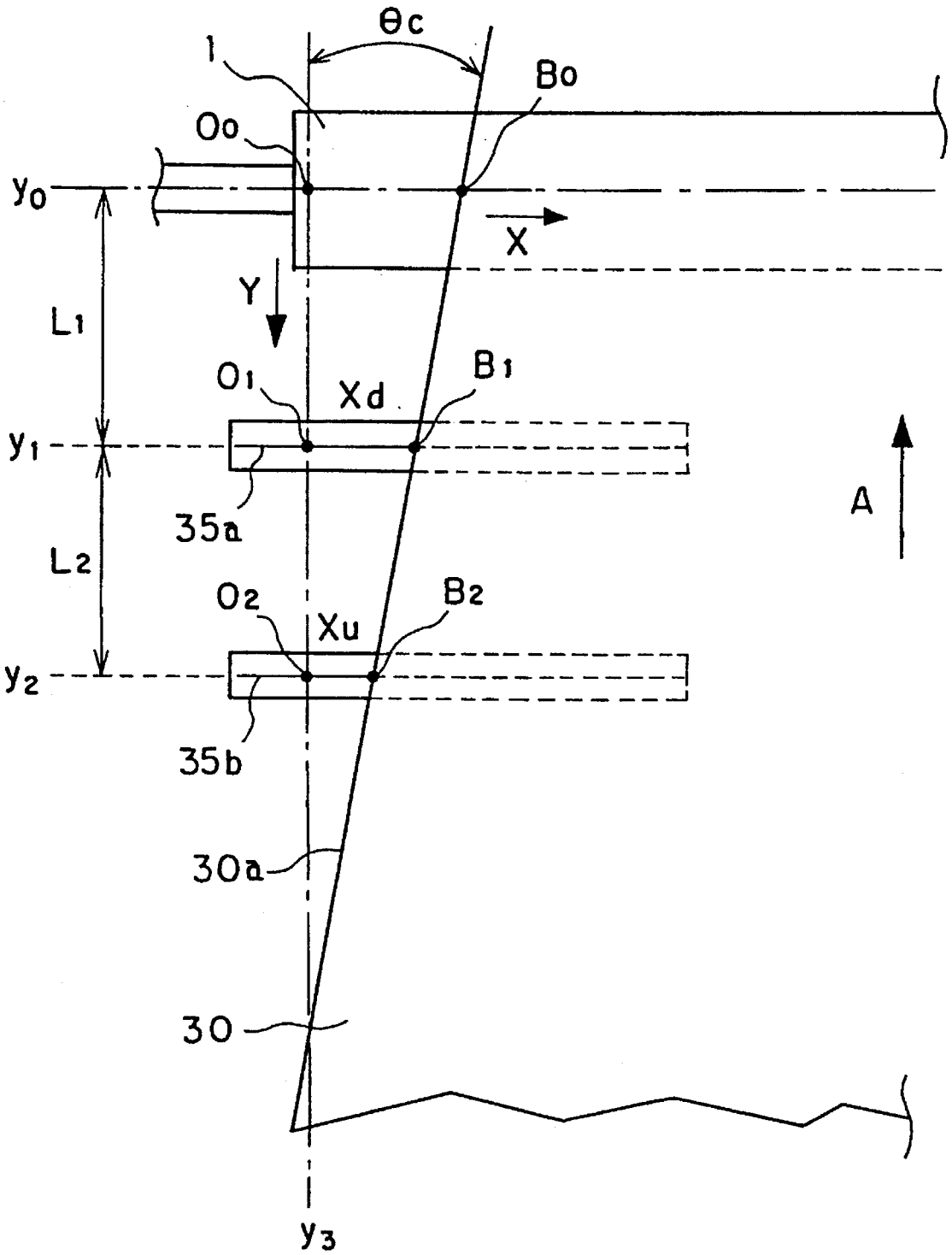
FIG. 7 is an explanatory view illustrating a method of calculating an amount of skew in the fifth embodiment.

The skew is represented by a deviation forming an angle between a predetermined reference carrying direction of the sheet and an actual carrying direction, that is, by a rotation angle of the actual carrying direction with respect to the reference carrying direction. The rotation angle is defined as the skew angle $\theta_c$, and a description will now be given of one illustrative method of calculating the skew angle $\theta_c$ with reference to FIG. 7. FIG. 7 is a typical diagram in which the sheet 30 is skew during carriage, and members in the vicinity of the position detecting sensor 34 are shown. The arrow A in FIG. 7 denotes the reference carrying direction of the sheet. Further, the line $y_0$ shows a print line on the sheet carrying roller 1, and the lines $y_1$ and $y_2$ respectively show detecting lines 35*a* and 35*b* of the position detecting sensor 34. Further, the line $y_3$ is a line extending parallel to the reference carrying direction. The position detecting sensor 34 is disposed such that the lines $y_1$ and $y_2$ can extend substantially parallel to the line $y_0$. Reference positions $O_1$ and $O_2$ to detect positions of the sheet edge are provided on the detecting lines 35 such that a line for connecting the positions $O_1$ and $O_2$ can extend parallel to the reference carrying direction of the sheet. In the above relationship, as shown in FIG. 7, the origin is defined as a point $O_0$, the X-axis is defined as the line $y_0$, and the Y-axis is defined as the line $y_3$. Further, it is considered that the positive skew angle $\theta_c$ is formed in a counterclockwise direction facing the drawing of FIG. 7. It is thereby possible to find the skew angle $\theta_c$ by using the following expression (1):

$$\theta_c=\tan^{-1}\{(Xu-Xd)/L_2\} \quad (1)$$

where Xd is a sheet edge position (an X-coordinate value of a point $B_1$ in FIG. 7) which is detected by the position detecting sensor positioned in the downstream of the carrying direction, Xu being a sheet edge position (an X-coordinate value of a point $B_2$ in FIG. 7) which is detected by the position detecting sensor positioned in the upstream of the carrying direction, and $L_2$ being a distance between the position detecting sensors in a direction of the Y-axis.

A description will now be given of a principle of correction in the structure according to the embodiment.

Figure 8:
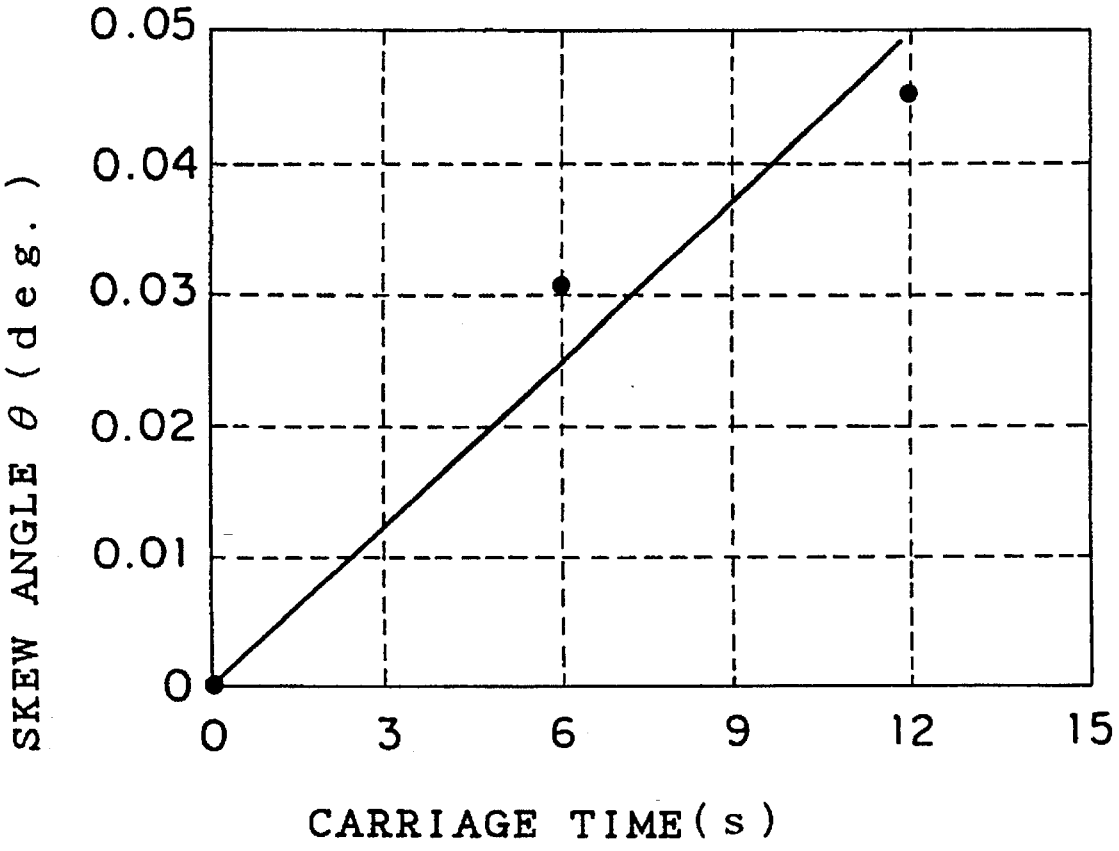
FIG. 8 is an explanatory view illustrating a principle of correction in the fifth embodiment.

FIG. 8 is a diagram illustrating a relationship between a carriage time (s) and the skew angle θ (deg.), and showing a case where a sheet carrying apparatus having the same structure as that shown in FIG. 5 is employed, and the electromagnetic clutch 32*b* of the load roller 32*b* on the left side in the carrying direction is coupled with the torque limiter 33*b*, thereby applying the carriage load to the left side of the sheet. In this case, a sheet carrying speed is 10 mm/s, and the carriage load applied by the load roller 31*b* is, for example, 100 gf (gram-force). The sign of the skew angle θ has the same meaning as that of $\theta_c$ in FIG. 7. As seen from FIG. 8, the skew angle θ of the sheet is more increased as the carriage time is more elapsed. That is, it can be seen that the sheet 30 is rotated to the left with respect to the reference carrying direction by applying the carriage load to the left side of the sheet 30. This is because the application of the carriage load increases extremely slight slip on a contact surface between the sheet carrying roller on the left side of the sheet and the sheet so as to reduce an amount of carriage of the sheet left side. Though a case of the right side is not shown, when the carriage load is applied to the right side of the sheet, the skew angle θ is more decreased according to the same inclination as that shown in FIG. 8 as the carriage time is more elapsed.

That is, it can be seen that the carrying direction of the sheet can be controlled by applying the carriage load to the sheet on the right and left sides in the upstream of the carrying roller. Therefore, in order to correct the skew, the carriage load may be applied such that the sheet is rotated in a direction opposed to a direction of the detected skew. In other words, the skew can be corrected by applying the carriage load to the sheet on the side carried more ahead due to the skew. Further, the inclination of the line in FIG. 8 corresponds to a gain of a correction feedback, and depends upon the torque value of the torque limiter 33 shown in FIG. 5.

Figure 9:
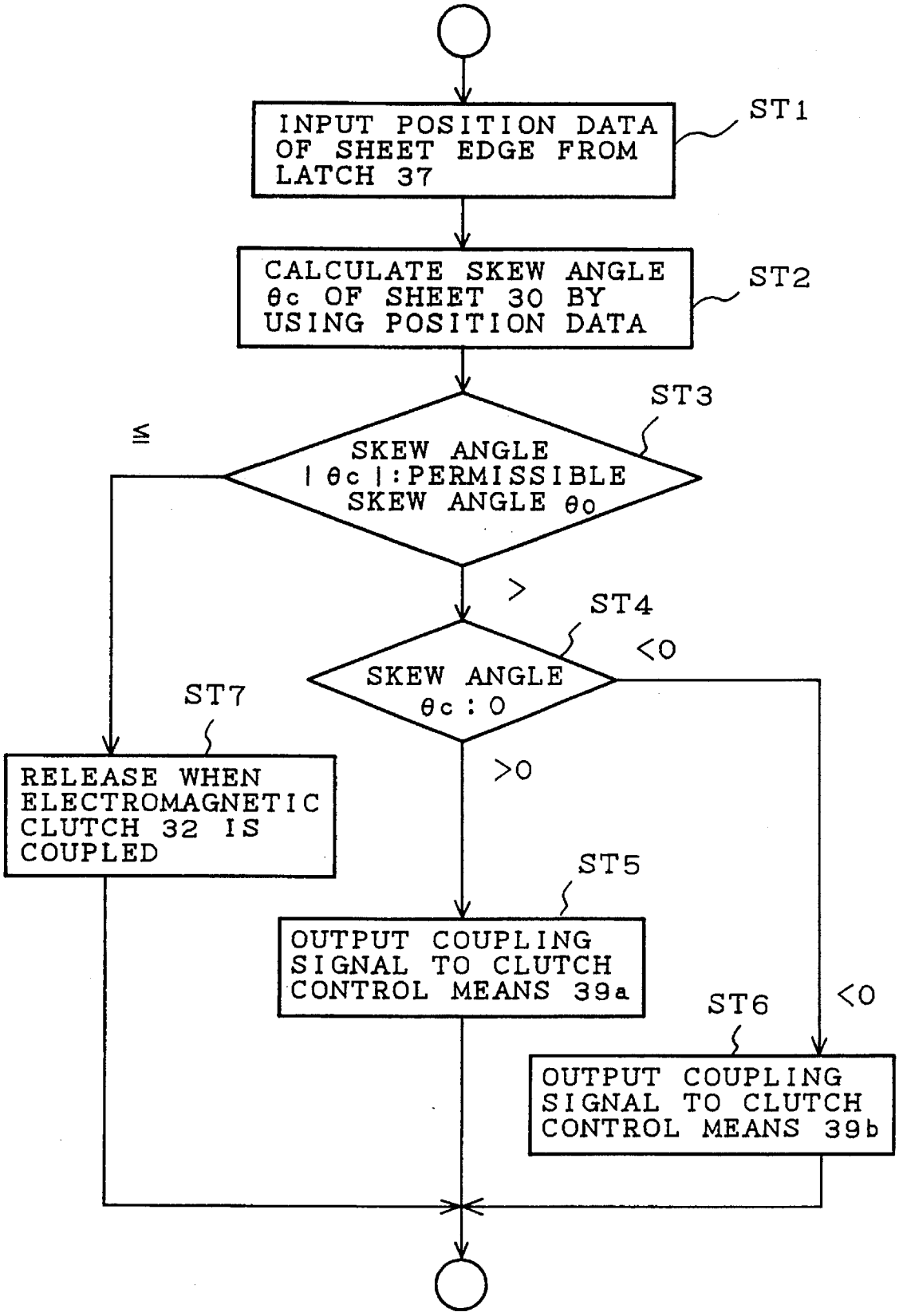
FIG. 9 is a flowchart showing a correcting operation of a CPU in the fifth embodiment.

FIG. 9 is a flowchart showing askew correcting operation executed by the CPU 38 depending upon the above principle. In Step ST1, the CPU 38 initially receives, as input from the latch 37, the position data of the sheet edge in the course of carriage. In Step ST2, the CPU 38 calculates the skew angle $\theta_c$ of the sheet 30 by using the position data according to the expression (1). Subsequently, in a decision of Step ST3, if the calculated skew angle $\theta_c$ is greater than the predetermined permissible skew angle $\theta_0$, the process proceeds to the correcting operation. For the purpose of the correction, the CPU 38 selects the electromagnetic clutch 32*a* or 32*b* such that the sheet is rotated in a direction opposed to a sheet rotation direction which is obtained from the sign of the skew angle data $\theta_c$. The CPU 38 outputs a coupling signal to the clutch control means 39 corresponding to the selected electromagnetic clutch 32. Then, the selected electromagnetic clutch 32 couples the torque limiter 33 with the load roller 31.

For example, one decision in Step ST4 that the skew angle $\theta_c$ is positive, shows that the sheet 30 is rotated to the left with respect to the carrying direction. For the purpose of the correction, the electromagnetic clutch 32*a* on the right side in the carrying direction may be coupled so as to rotate the sheet 30 to the right. Therefore, in Step ST5, a coupling signal is outputted to the clutch control means 39*a*, and the clutch control means 39*a* couples the electromagnetic clutch 32*a* according to the inputted coupling signal. Otherwise, another decision in Step ST4 that the skew angle $\theta_c$ is negative, shows that the sheet 30 is rotated to the right with respect to the carrying direction. For the purpose of the correction, the electromagnetic clutch 32*b* on the left side in the carrying direction may be coupled so as to rotate the sheet 30 to the left. Therefore, in Step ST6, a coupling signal is outputted to the clutch control means 39*b*, and the clutch control means 39*b* couples the electromagnetic clutch 32*b* according to the inputted coupling signal.

After coupling, when the calculated skew angle $\theta_c$ becomes equal to the predetermined permissible skew angle $\theta_0$ or less, the electromagnetic clutch is released (Step ST7).

The above operation is executed during carriage. Thus, in a simple structure, the sheet carrying apparatus can correct the sheet skew generated during carriage without stopping the carriage of the sheet.

In the embodiment, the load rollers 31*a* and 31*b* coupled with the torque limiters 33*a* and 33*b* are brought into pressure contact with a print surface of the sheet 30. However, it is to be noted that the load rollers may be brought into pressure contact with a sheet back surface, resulting in the same effect. In the structure, since a load force is not directly transmitted from the load rollers 31*a* and 31*b* to the print surface, it is possible to avoid damage to the print surface.

Further, in the embodiment, the carriage load is applied by the torque limiter 33 to the sheet when the skew is detected, however, it must be noted that the sheet skew correction should not be limited to such a control method. That is, when the correction is not required, both the right and left electromagnetic clutches 32 may be coupled to apply uniform carriage load to the right and left sides. Further, when the skew is detected, any one of the electromagnetic clutches 32 may be released to be set in a free state, resulting in the same effect. In this case, the electromagnetic clutch 32 on the delayed side having a smaller amount of sheet carriage may be released to correct the skew.

Embodiment 6

Figure 10:
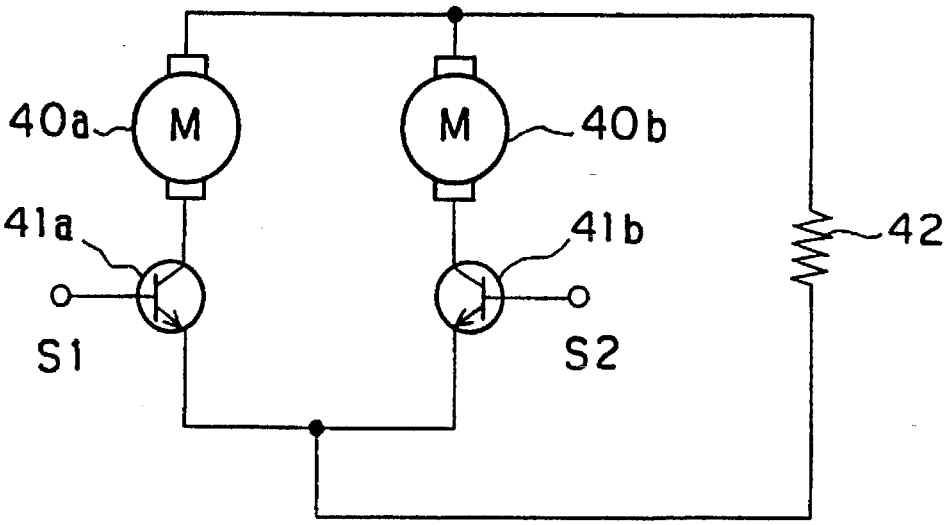
FIG. 10 is a wiring diagram showing partial carriage load applying means in the sixth embodiment of the present invention.

In the fifth embodiment, the torque limiter 33 is employed as the braking means, the electromagnetic clutch 32 is employed as the coupling means, and the carriage load is applied by the torque limiter 33 to the sheet through the electromagnetic clutch 32. However, in the embodiment, DC motors are used instead of the electromagnetic clutch 32 and the torque limiter 33. FIG. 10 is a wiring diagram showing a structure using the DC motors. In FIG. 10, only a part of carriage load applying means used for skew correction is shown, and structures of other parts are identical with those shown in FIG. 5.

The DC motors 40*a* and 40*b* are respectively coupled with the load rollers 31*a* and 31*b* shown in FIG. 5. The respective DC motors 40*a* and 40*b* are provided with switches 41*a* and 41*b* to cause short in power source terminals. When the switch 41*a* or 41*b* is set in an ON state, short is caused in the DC motor 40*a* or 40*b*. In the following discussion, the DC motor 40*a* or 40*b* is sometimes referred to as DC motor 40, and the switch 41*a* or 41*b* is sometimes referred to as switch 41.

The switch 41 is connected to an unillustrated CPU 38. The CPU 38 applies predetermined voltage to terminals S1 and S2, thereby connecting the switch 41. When the switch 41 is set in the ON state, rotation of the load roller 31 causes the DC motor 40 to generate an electromotive force, and generate torque serving as a braking force against rotation of the DC motor 40. The torque is transmitted to the sheet 30 through the load roller 31 so as to serve as the carriage load. No current flow is present in an OFF state, and the load roller 31 is set in a rotatable and followable state in which the load roller 31 applies substantially no carriage load to the sheet 30.

Therefore, the CPU 38 can correct the skew by controlling the switch 41 according to a detected skew angle $\theta_c$. In this case, the CPU 38 provides a control operation, shown in Steps ST5 and ST6 of a flowchart in FIG. 9, in which the predetermined voltage is applied to the terminals S1 and S2 instead of outputting a coupling signal to clutch control means 39.

Further, the magnitude of the carriage load can be controlled by changing a resistance. According to the embodiment, as in the fifth embodiment, it is possible to correct the sheet skew generated during carriage without stopping the carriage of the sheet. Further, since an expensive member such as electromagnetic clutch, or torque limiter is not required, it is possible to provide a sheet carrying apparatus which can correct the skew in a more inexpensive structure than that in the fifth embodiment.

Though the DC motors 40 are directly coupled with the load roller 31 in the above structure, it must be noted that the DC motors may be coupled through, for example, a step-up gear, or a reduction gear, resulting in the same effect.

Figure 11:
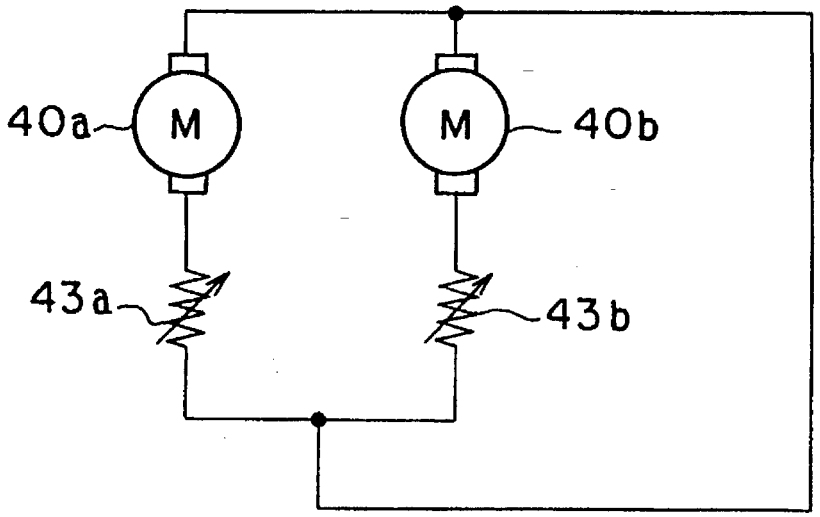
FIG. 11 is a wiring diagram showing another embodiment of the partial carriage load applying means in the sixth embodiment.

As shown in FIG. 11, instead of the switches 41*a* and 41*b*, current control means 43*a* and 43*b* may respectively be connected in series to the DC motors 40*a* and 40*b* so as to control an amount of current generated by the electromotive force of the DC motor 40. As the current control means 43, for example, a variable resistive element which can electrically be controlled may be employed. In order to correct the skew by applying the carriage load to the sheet, the current control means 43 is set such that a large amount of current can be generated by the electromotive force of the DC motor 40. When the skew is not corrected, the current control means 43 is set so as to generate a small amount of current. In the structure, it is possible to reduce a converging time for the correction by controlling the amount of current according to the magnitude of the calculated skew angle $\theta_c$. That is, as the calculated skew angle $\theta$ becomes greater, the amount of current may be more increased. As a result, an increase in generating torque increases an amount of correction per unit time. Even when the correction is not performed, stationary carriage load can be applied by providing current to some extent.

Alternatively, instead of the DC motor 40, an electromagnetic brake and control means for the electromagnetic brake may be employed, resulting in the same effect.

Embodiment 7

Figure 12:
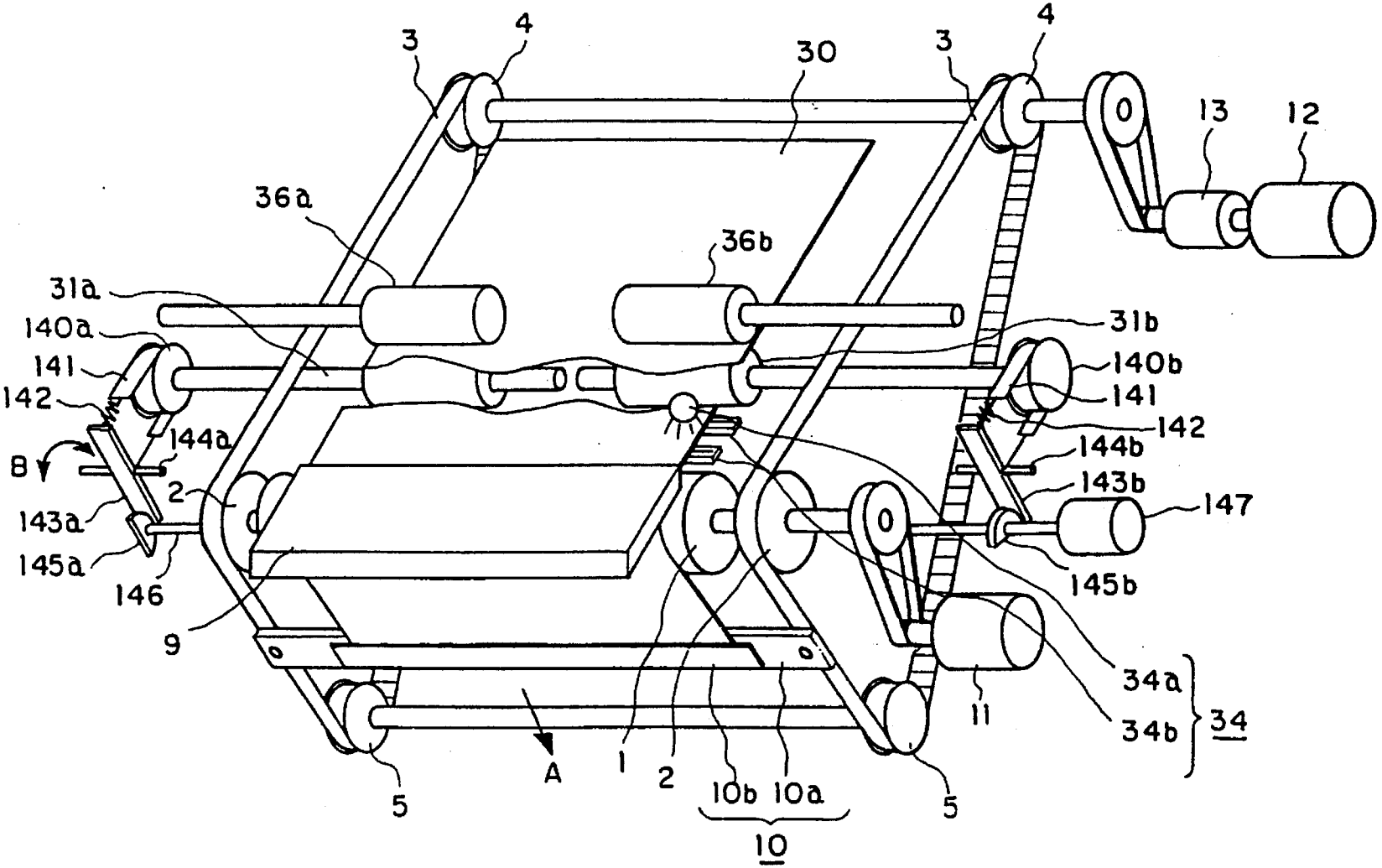
FIG. 12 is a perspective view showing an essential structure in the seventh embodiment of the sheet carrying apparatus of the present invention.

FIG. 12 is a perspective view showing an essential structure of the seventh embodiment of the sheet carrying apparatus of the present invention. The same reference numerals are used for component parts identical with or equivalent to those shown in FIGS. 49 and 50. In FIG. 12, an ink sheet 6 and an ink sheet carrying portion are omitted. Since the embodiment is different from the fifth embodiment in only carriage load applying portion, the carriage load applying portion will be described infra.

As shown in FIG. 12, in the upstream of a sheet carrying roller 1, there are disposed, laterally symmetrically with respect to a sheet center line in a sheet carrying direction, load rollers 31*a* and 31*b* and following rollers 36*a* and 36*b* respectively having substantially the same diameter so as to extend in a horizontal scanning direction. The respective load rollers 31*a* and 31*b* and the following rollers 36*a* and 36*b* are independently and rotatably supported. For example, rubber rollers, or metallic rollers having fine irregularity of their surfaces are employed as the load rollers 31*a* and 31*b*. Further, the load rollers 31*a* and 31*b* are respectively in contact with the following rollers 36*a* and 36*b* under predetermined contact pressure through a sheet 30. Braking means for applying a braking force to the load rollers 31*a* and 31*b* include brake drums 140*a* and 140*b*, springs 142, arms 143*a* and 143*b*, and shafts 144*a* and 144*b*. In the following discussion, the brake drum 140*a* or 140*b* is sometimes referred to as brake drum 140, the arm 143*a* or 143*b* is sometimes referred to as arm 143, and the shaft 144*a* or 144*b* is sometimes referred to as shaft 144.

The brake drums 140*a* and 140*b* are provided in a cylindrical form, and are respectively mounted to ends of the load rollers 31*a* and 31*b*. Further, brake bands 141*a* and 141*b* are brought into contact with outer peripheries of the respective brake drums 140*a* and 140*b*. Tensile strength is applied to the brake bands 141*a* and 141*b* so that the braking forces are applied to the load rollers 31*a* and 31*b*. Further, the arms 143*a* and 143*b* are independently and rotatably supported by the shafts 144*a* and 144*b*. The arms 143*a* and 143*b* can be swung in a direction of the arrow B in the drawing. One ends of the brake bands 141*a* and 141*b* are respectively coupled with the arms 143*a* and 143*b* through the springs 142, and the other ends are coupled with rotation centers of the arms 143*a* and 143*b*.

Therefore, it is possible to control the tensile strength of the brake bands 141*a* and 141*b* by the arms 143*a* and 143*b*. In order to correct skew, the braking forces determined by frictional resistance between the brake drums 140*a* and 140*b*, and the brake bands 141*a* and 141*b* are applied to the load rollers 31*a* and 31*b*. Subsequently, the load rollers 31*a* and 31*b* are brought into pressure contact with the sheet 30 so as to apply carriage load to the sheet. The respective brake drums 140*a* and 140*b* may be made of, for example, polyacetal or metal. Further, in order to provide the brake band 141*a* or 141*b*, for example, a plate made of metal or polyacetal may be used as a base material, and mesh such as felt or leather may be applied onto the base material at a surface in contact with the brake drum 140*a* or 140*b*.

The arm 143*a* and 143*b* are able to contact cams 145*a* and 145*b*. The cams 145*a* and 145*b* are secured to a shaft 146, and the shaft 146 is coupled with a shaft of a stepping motor 147. Therefore, the arm 143*a* and 143*b* can be swung by the cams 145*a* and 145*b* in the direction of the arrow B by controlling a rotation angle of the stepping motor 147. As a result, it is possible to control the tensile strength of the brake bands 141*a* and 141*b*. The cams 145*a* and 145*b* have a phase difference, and can apply/release the tensile strength for both the brake bands 141*a* and 141*b*, and can apply any one of the tensile strength. Thus, according to a direction of the skew detected by a position detecting sensor 34, the brake band 141*a* or 141*b* to which the tensile strength is applied is selected, and the stepping motor 147 is driven by a predetermined rotation angle. Thereby, as in the fifth embodiment, the skew is corrected. In the following discussion, the cam 145*a* or 145*b* is sometimes referred to as cam 145.

Here, it is assumed that the carriage load applied by a load roller 47 to the sheet 30 is smaller than a force by which the sheet 30 is gripped by the sheet carrying roller 1 in response to pressure contact of a thermal head 9. That is, the skew can be corrected substantially without stopping feed of the sheet 30. Further, the pressure contact between the load roller 47 and the sheet 30 is set to a value which causes no slip therebetween. In the right and left load rollers 31*a* and 31*b*, values of braking forces are substantially identical. It is possible to set the magnitude of the braking force by coefficient of friction between the brake drum 140 and the brake band 141, and by an operation angle between the spring 142 and the arm 143 defining the tensile strength of the brake band 141.

Figure 13:
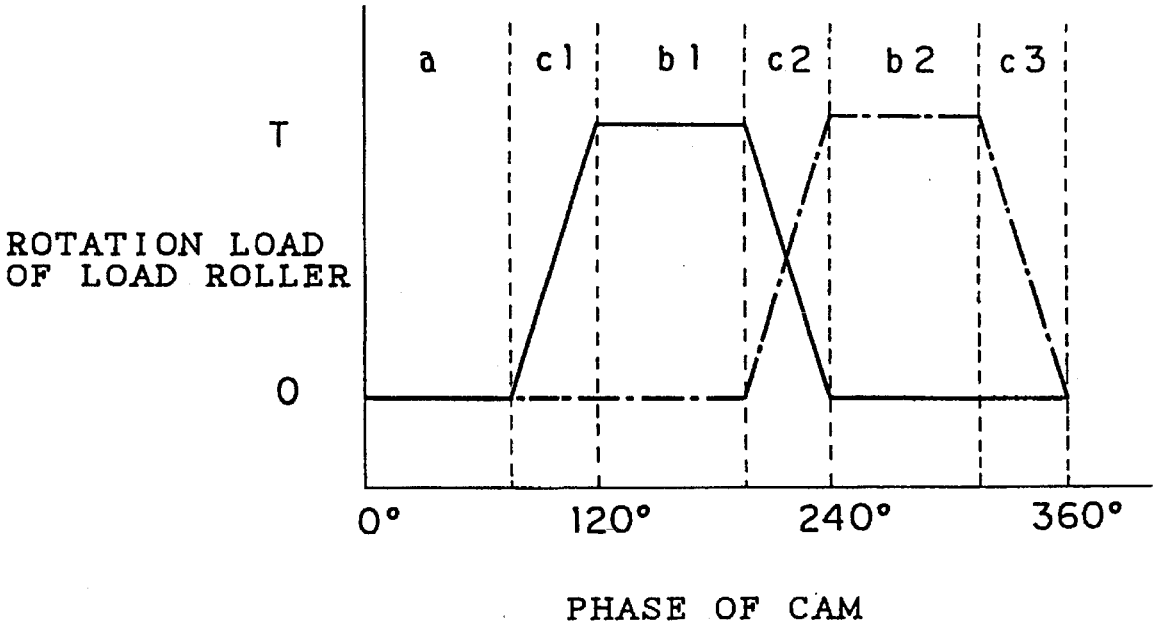
FIG. 13 is an explanatory view illustrating operations of load rollers in the seventh embodiment.

FIG. 13 is a diagram showing a relationship between phases of the cam 145*a* and 145*b*, and braking forces applied to the load rollers 31*a* and 31*b*. An area a shown in FIG. 13 shows a state in which no tensile strength is applied to the two brake bands 141*a* and 141*b*. The area a corresponds to a time when the skew correction is not carried out, or to a feed/eject time of the sheet. An area b1 or b2 shows a state in which the tensile strength is applied to any one of the brake bands 141*a* and 141*b*. The area b1 or b2 corresponds to a skew correcting operation. Further, areas c1, c2, and c3 serving as a transition state between the above states show a state in which the tensile strength is gradually applied to the brake bands 141*a* and 141*b*, or is gradually released therefrom. Such an area is provided to eliminate a rapid variation in the braking force, that is, the carriage load. As a result, it is possible to avoid a harmful effect on a print surface, such as locally generating wrinkle which is caused due to a rapid variation in a carriage speed.

Figure 14:
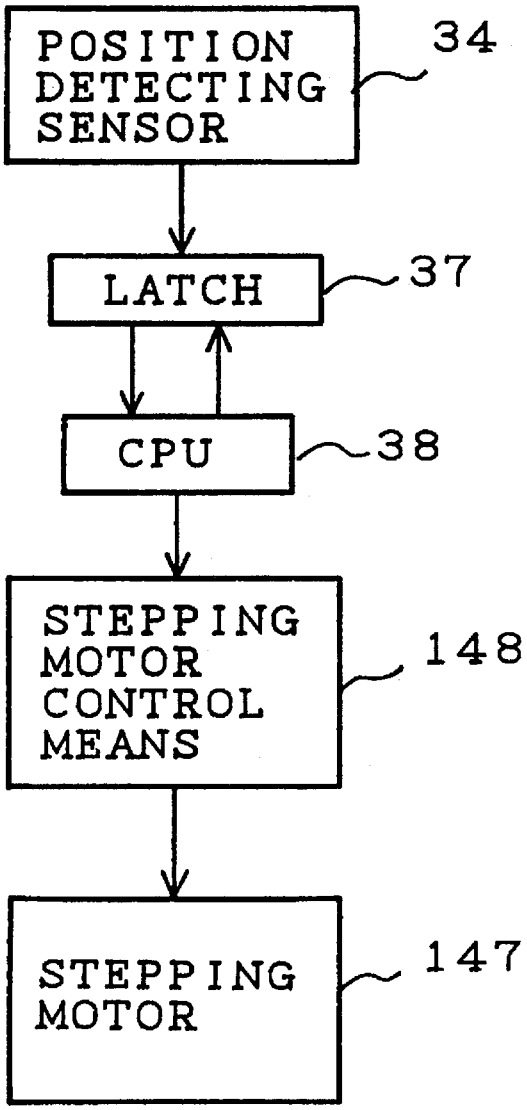
FIG. 14 is a block diagram showing a control system in the seventh embodiment of the sheet carrying apparatus.

FIG. 14 is a block diagram showing a control system in the seventh embodiment. With reference to the drawing, a description will be given of a control operation. The same reference numerals are used for component parts identical with or equivalent to those in the fifth embodiment, and descriptions thereof are omitted.

A CPU 38 calculates a skew angle $\theta_c$, and determines the rotation angle of the stepping motor 147 depending upon the sign of the skew angle $\theta_c$. Further, the CPU 38 outputs a drive signal to stepping motor control means 148. The stepping motor control means 148 drives the stepping motor 147 according to the drive signal from the CPU 38.

According to rotation of the cam 145, a cam curve at a portion in contact with the arm 143 can appropriately be changed. That is, the tensile strength applied to the brake band 141 can be controlled by controlling the phase of the cam. Consequently, it is possible to continuously control, in a predetermined range, the magnitude of the carriage load applied by the load roller 31 to the sheet 30. It is possible to reduce a correction time by controlling the magnitude of the carriage load according to the magnitude of the sheet skew angle $\theta_c$ during carriage. That is, as the calculated skew angle $\theta_c$ becomes greater, the tensile strength applied to the brake band 141 may be more increased. As a result, an increase in the generating braking force increases an amount of correction per unit time. In this case, it is possible to set a range of the tensile strength applied to the load roller by the coefficient of friction between the brake drum 140 and the brake band 141, and by the operation angle between the spring 142 and the arm 143 defining the tensile strength of the brake band 141.

According to the embodiment, as in the fifth and sixth embodiments, in a simple structure, it is possible to correct the skew of the sheet 30, generated during carriage, without stopping the carriage of the sheet 30.

Though the tensile strength is applied to one of the brake bands 141*a* and 141*b* at a time of correction, it must be noted that the correcting operation should not be limited to the above method. For example, when the correction is not required, the tensile strength may be applied to both the brake bands 141*a* and 141*b* so as to apply the carriage load from the load rollers 31*a* and 31*b* to the sheet. Further, when the correction is required, any one of the tensile strength applied to the brake bands 141*a* and 141*b* may be released according to the detected skew angle, resulting in the same effect. It is to be noted that the minimum value of the tensile strength applied to the brake band 141 should not be limited to zero. That is, setting may also be made such that some braking forces are applied to both the load rollers 31*a* and 31*b* at a time of non-correction. In this case, a deviation of carriage load at the time of correction from carriage load at the time of non-correction may be set so as to provide a sufficient correction gain for the skew angle correction. Further, in this case, since the tensile strength is continuously applied to the sheet 30 at a portion interposed between the carrying roller 1 and the load roller 31, a tightly contacting force between the sheet 30 and the carrying roller 1 is increased. Hence, it is possible to reduce a carriage error which is caused when the correction is not carried out.

Though the band brake wound at the brake drum is employed as the braking means in the seventh embodiment, it must be noted that the braking means should not be limited to this as long as the braking force can appropriately be changed. For example, a brake shoe may be employed instead of the brake band 141. In this case, the brake shoe is brought into pressure contact with/disengaged from the brake drum, thereby controlling the braking force of the load roller. That is, when the brake shoe is brought into pressure contact with the brake drum with predetermined contact pressure, the frictional resistance is generated between the brake shoe and the brake drum. It is thereby possible to apply the braking force to the load roller. In order to provide the brake shoe, for example, a metallic block or polyacetal block may be used as a base material, and a felt or leather may be applied onto the base material at a sliding surface in contact with the brake drum.

Embodiment 8

Figure 15:
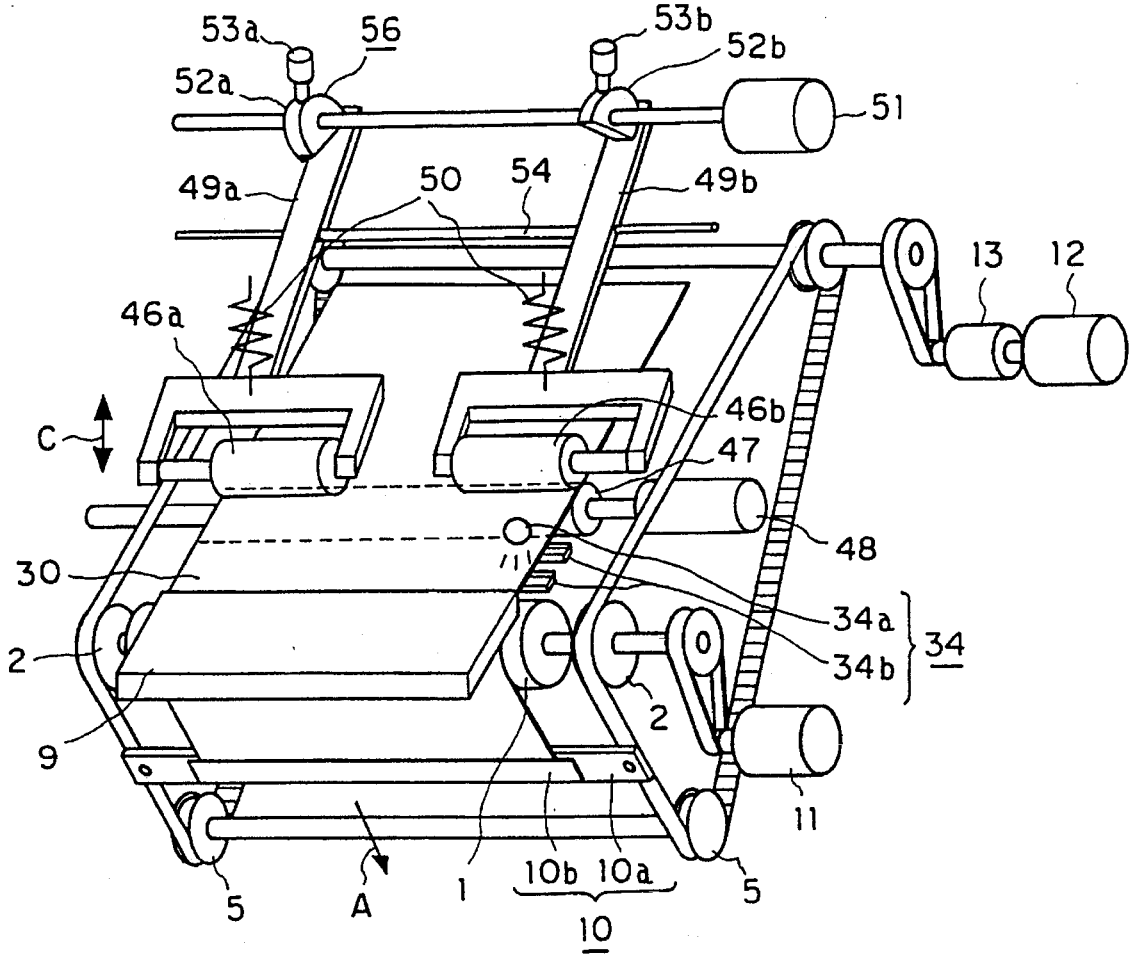
FIG. 15 is a perspective diagram showing an essential structure in the eighth embodiment of the sheet carrying apparatus of the present invention.

FIG. 15 is a perspective diagram showing an essential structure in the eighth embodiment of the sheet carrying apparatus of the present invention. In FIG. 15, the same reference numerals are used for component parts identical with or equivalent to those shown in FIGS. 49 and 50. In FIG. 15, an ink sheet 6 and an ink sheet carrying portion are omitted. Since the embodiment is different from the fifth embodiment in only carriage load applying means, only the carriage load applying means will be described infra.

In the embodiment, the carriage load applying means includes, for example, a load member contacting a sheet 30 so as to apply carriage load, pressure contact members disposed at positions opposed to the load member through the sheet 30, a pressure contact mechanism to bring the pressure contact members into pressure contact with/disengage the pressure contact members from the sheet 30. The pressure contact members include, for example, pressure contact rollers 46*a* and 46*b*, and the load member includes, for example, a load roller 47 and a torque limiter 48. The pressure contact rollers 46*a* and 46*b* can be brought into pressure contact with/disengaged from the sheet 30, and bring the sheet 30 into pressure contact with the load roller 47 so as to apply the carriage load to the sheet 30. The pressure contact rollers 46*a* and 46*b* respectively include following rollers rotatably supported by arms 49*a* and 49*b*, and are disposed on the right and left sides with respect to a sheet center line in a sheet carrying direction so as to extend in a direction perpendicular to the sheet carrying direction. The respective pressure contact rollers 46*a* and 46*b* have substantially the same diameter, and include, for example, rubber rollers or metallic rollers having fine irregularity of their surfaces. In the following discussion, the pressure contact roller 46*a* or 46*b* is sometimes referred to as pressure contact roller 46.

The arms 49*a* and 49*b* are rotatably supported by a supporting shaft 54 so that the arms 49*a* and 49*b* are rotated about the supporting shaft 54, and the pressure contact rollers 46*a* and 46*b* can be brought into pressure contact/disengaged in directions of the arrow C. At a position opposed to the pressure contact rollers 46 through the sheet 30, the load roller 47 including the rubber roller is rotatably supported by an unillustrated side plate. The torque limiter 48 is coupled with the one side of the load roller 47. The fixing side of the torque limiter 48 is fixed on an unillustrated side plate. The torque limiter 48 forms braking means for applying a braking force to the load roller 47. When the skew is corrected, torque determined by the torque limiter 48 is transmitted to the load roller 47, and the carriage load is applied to the sheet 30 at a portion in the upstream of the sheet carrying roller 1.

Here, a pressure contact mechanism 56 includes the arms 49*a* and 49*b*, springs 50, a DC motor 51, and cams 52*a* and 52*b*. Pressure contacting forces of the pressure contact rollers 46*a* and 46*b* are generated by the springs 50 whose one ends are secured to a top board (not shown). Further, rotation of the arms 49*a* and 49*b* is controlled by rotation of the DC motor 51 coupled with the cams 52*a* and 52*b*. The cams 52*a* and 52*b* have a phase difference. Therefore, rotation of the DC motor 51 can bring both the rollers into pressure contact/disengage both the rollers, and can bring any one of the rollers into pressure contact. Further, in the vicinity of the cams 52*a* and 52*b*, cam detecting sensors 53*a* and 53*b* are mounted to detect positions of the pressure contact rollers 46*a* and 46*b*.

Here, it is assumed that the carriage load determined by the torque limiter 48 is smaller than a force by which the sheet 30 is gripped by the sheet carrying roller 1 in response to pressure contact of a thermal head 9. That is, the skew can be corrected substantially without stopping feed of the sheet 30. Further, the pressure contact between the pressure contact rollers 46*a* and 46*b* is set to a value causing no slip between the load roller 47 and the sheet 30.

Figure 16:
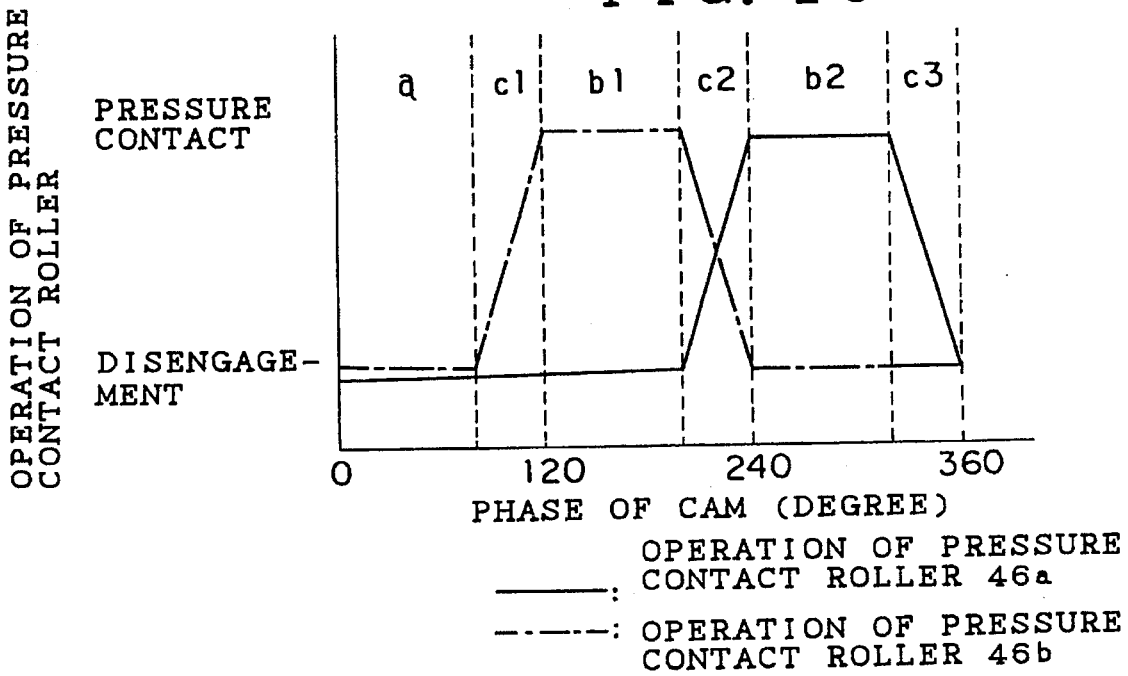
FIG. 16 is an explanatory view illustrating operations of pressure contact rollers in the eighth embodiment.

FIG. 16 is a diagram showing relationships between phases of the cams 52*a* and 52*b*, and operations of the pressure contact rollers 46*a* and 46*b*. An area a shown in FIG. 16 corresponds to a state in which both the two pressure contact rollers 46*a* and 46*b* are disengaged from the sheet 30, that is, to a time when the skew correction is not carried out, or a feed/eject time of the sheet. Areas b1 and b2 correspond to a state in which any one of the pressure contact rollers 46*a* and 46*b* is brought into pressure contact with the sheet 30, that is, to a time of skew correction. Further, areas c1, c2, and c3 provided between the respective operations show a state in which the pressure contact rollers 46 are gradually brought into pressure contact with or disengaged from the sheet 30. By providing such an area, it is possible to eliminate a rapid variation in the carriage load, and avoid a harmful effect on print, such as locally generating wrinkle which is caused due to the rapid variation in a carriage speed.

Figure 17:
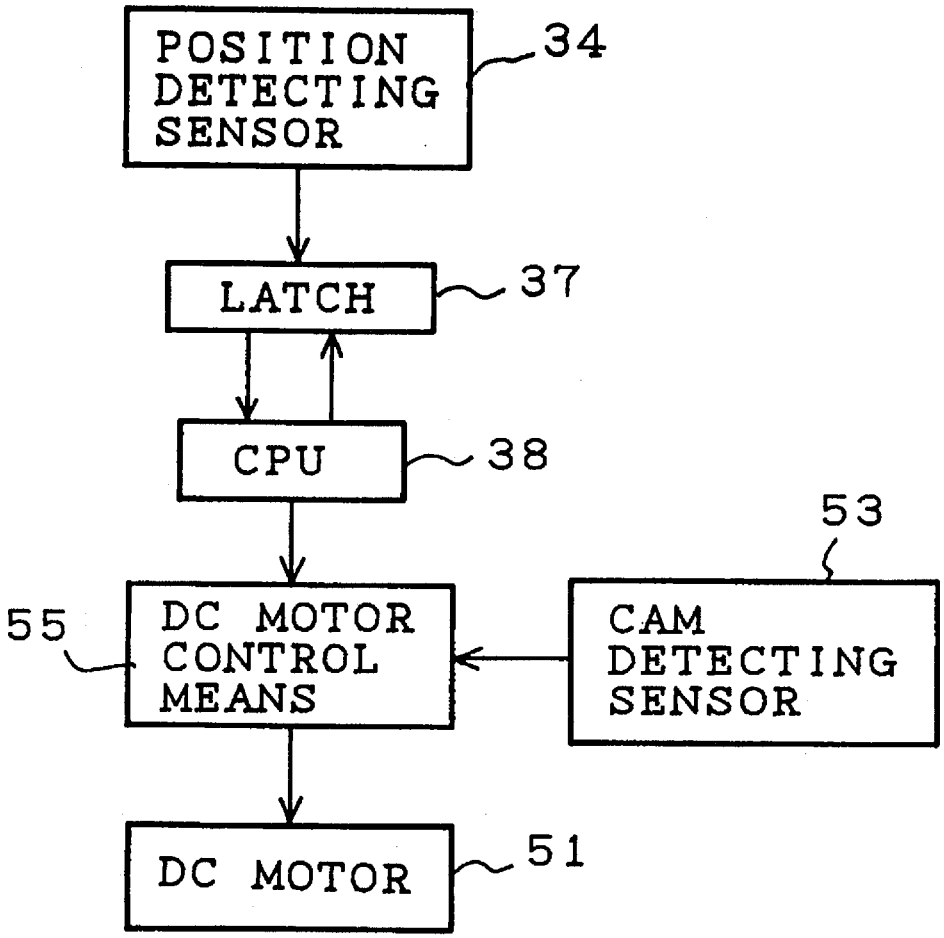
FIG. 17 is a block diagram showing a control system in the eighth embodiment.

FIG. 17 is a block diagram showing a control system in the eighth embodiment. With reference to the drawing, a description will be given of a control operation. The same reference numerals are used for blocks identical with or equivalent to those in the fifth embodiment shown in FIG. 17, and descriptions thereof are appropriately omitted.

A CPU 38 calculates the skew angle $\theta_c$, and determines a rotation direction of the DC motor 51 coupled with the cams 52*a* and 52*b* depending upon the sign of the skew angle $\theta_c$. Further, the CPU 38 outputs a drive signal to DC motor control means 55.

The DC motor control means 55 drives the DC motor 51 according to the drive signal from the CPU 38. Further, depending upon signals from the cam detecting sensors 53*a* and 53*b*, it is confirmed whether the pressure contact rollers 46 are brought into pressure contact or are disengaged.

Figure 18:
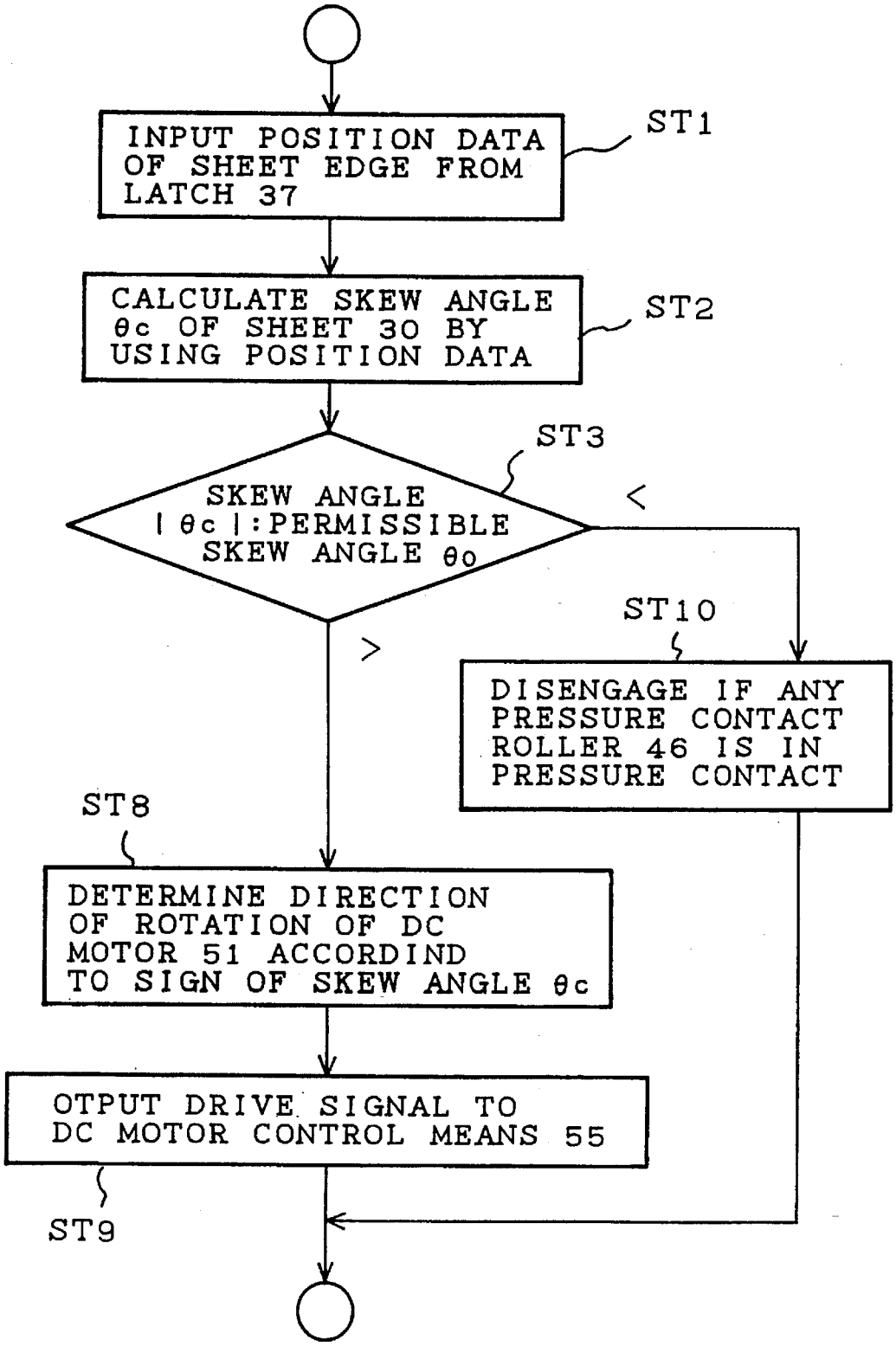
FIG. 18 is a flowchart showing a correcting operation of a CPU in the eighth embodiment.

FIG. 18 is a flowchart showing a correcting operation of the CPU 38 in the eighth embodiment. With reference to the drawing, a description will be given of correction of skew.

The CPU 38 calculates a skew angle $\theta_c$ (Steps ST1 and ST2) so as to decide whether or not the correction is required (Step ST3). When the skew angle $\theta_c$ is smaller than a predetermined permissible skew angle $\theta_0$, there is established a state in which both the pressure contact rollers 46*a* and 46*b* are disengaged from the sheet 30. In the state, no carriage load is applied from the load roller 47 to the sheet 30.

On the other hand, when it is decided in Step ST3 that the skew angle $\theta_c$ exceeds the predetermined permissible skew angle $\theta_0$, the CPU 38 selects the pressure contact rollers 46*a* and 46*b* such that the sheet is rotated in a direction opposed to a rotation direction of the carried sheet 30, which is obtained from the sign of the skew angle data $\theta_c$. Thus, the selected pressure contact roller 46 determines the rotation direction of the DC motor 51 such that the pressure contact roller 46 can be brought into pressure contact with the sheet 30 (Step ST8). Further, in Step ST9, the CPU 38 outputs a coupling signal to the DC motor control means 55 so as to drive the DC motor 51. Therefore, since the carriage load from the load roller 47 is applied to the sheet only on the side in contact with the pressure contact roller 46, the skew of the sheet 30 can be corrected. When the skew angle $\theta_c$ becomes smaller than the permissible skew angle $\theta_0$ because of the correction, the pressure contact roller 46 is disengaged (Step ST10). The above operation is executed during a carriage time so as to correct the skew generated during carriage.

According to the embodiment, in the respective embodiments, in a simple structure, it is possible to correct the sheet skew generated during carriage without stopping the carriage of the sheet.

Embodiment 9

In the eighth embodiment, though the carriage load is applied to the sheet 30 by the load roller 47 serving as the load member coupled with the torque limiter 48, a friction plate may also be employed. That is, the friction plate can be used instead of the load roller 47 coupled with the torque limiter 48 in the eighth embodiment, resulting in the same effect as that in the eighth embodiment.

As the friction plate, it is possible to use, for example, a metallic plate in which a felt is applied onto its surface. In this case, the friction plate is disposed such that the surface having the felt serves as a surface in pressure contact with a sheet 30.

Alternatively, a guide plate made of metal or the like, or a rotatable following roller may be mounted instead of the load roller 47. Further, a friction plate may be mounted instead of the pressure contact roller 46 such that, according to the skew angle $\theta_c$, the friction plate can be brought into pressure contact with/disengaged from the following roller through the sheet. In such a structure, it is possible to control a pressure contacting force of the friction plate depending upon phase control of the cams 52, thereby controlling the magnitude of the carriage load. Consequently, a correction time can be reduced.

Embodiment 10

Figure 19:
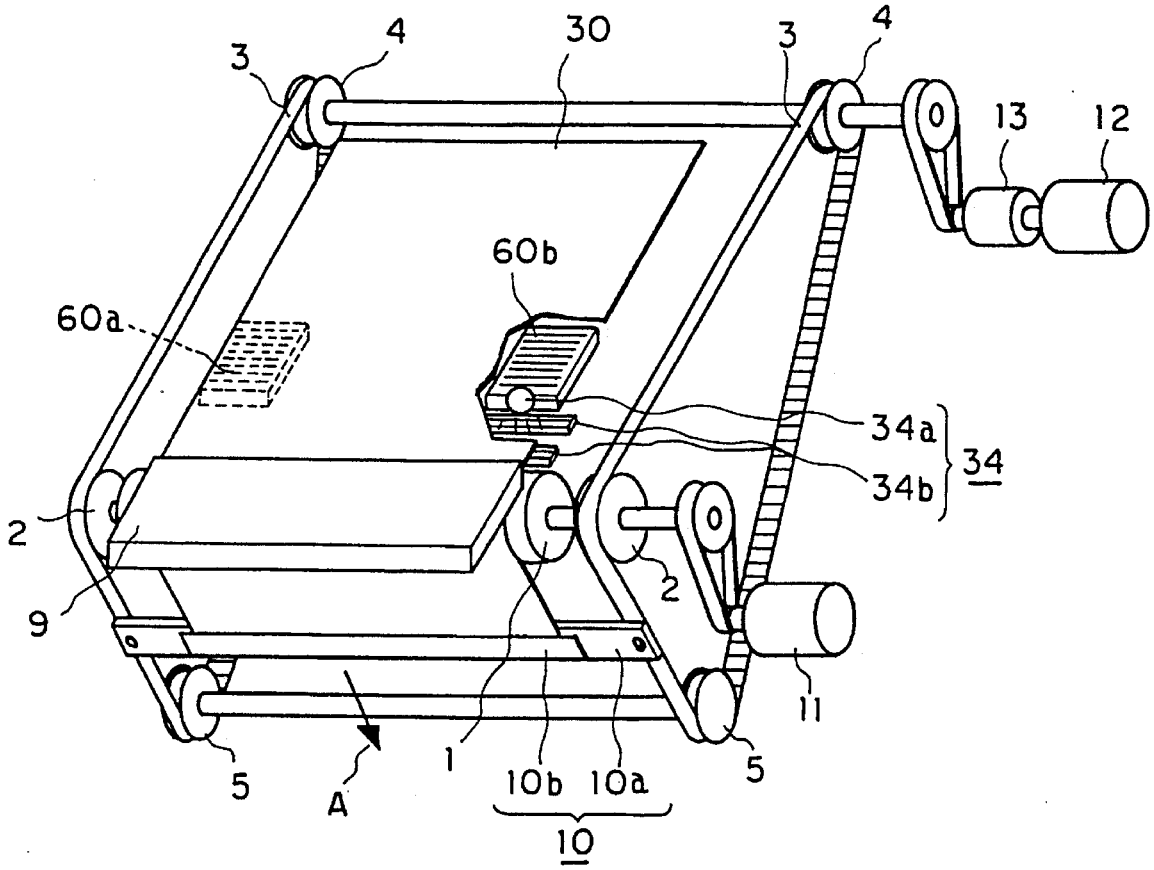
FIG. 19 is a perspective diagram showing an essential structure in the tenth embodiment of the sheet carrying apparatus of the present invention.

FIG. 19 is a perspective diagram showing an essential structure in the tenth embodiment of the sheet carrying apparatus of the present invention. The drawing shows a sheet 30 which is partially cut away. In FIG. 19, the same reference numerals are used for component parts identical with or equivalent to those shown in FIGS. 49 and 50. In FIG. 19, an ink sheet 6 and an ink sheet carrying portion are omitted.

In the sheet carrying apparatus in the embodiment, electrode plates are used instead of the load rollers to apply the carriage load to the sheet 30 in the upstream of the sheet carrying roller 1 in the fifth embodiment.

The electrode plates 60*a* and 60*b* forming carriage load applying means are disposed, in the upstream of the sheet carrying roller 1, on the right and left sides with respect to a sheet center line in a sheet carrying direction so as to extend in a horizontal scanning direction. In order to provide the electrode plates 60*a* and 60*b*, an electrode made of conductor such as copper and having a comb-shaped structure is formed on an insulated substrate made of ceramics or the like, and an insulating protective film is coated on the electrode. In the following discussion, the electrode plate 60*a* or 60*b* is sometimes referred to as electrode plate 60.

Voltage is applied to the electrode plate 60*a* or 60*b*, resulting in generation of the carriage load. This is because attraction is generated between the electrode plate 60*a* or 60*b* and the sheet 30 opposed thereto by dielectric polarization at a time of application of the voltage, and a frictional force is generated because of the attraction between the electrode plate 60*a* or 60*b* and the sheet 30 so as to serve as the carriage load. Thus, as in the fifth embodiment, according to a direction of skew detected by a position detecting sensor 34, the electrode plate 60 to which the voltage should be applied is selected, and predetermined voltage is applied to correct the skew.

In this case, the magnitude of the carriage load applied to the sheet is determined depending upon the magnitude of the applied voltage.

Figure 20:
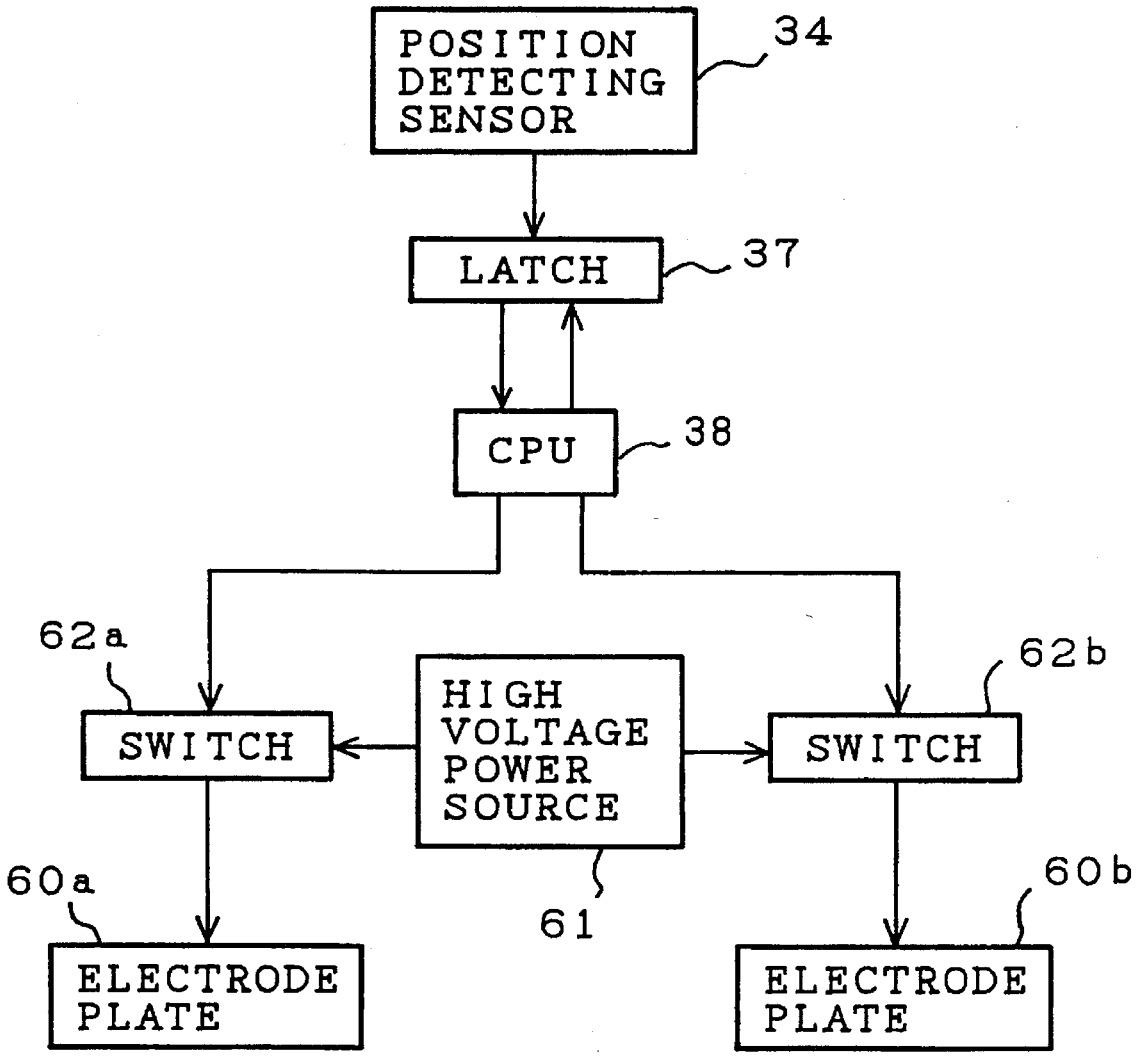
FIG. 20 is a block diagram showing a control system in the tenth embodiment.

FIG. 20 is a block diagram showing a control system in the embodiment. In the drawing, the same reference numerals are used for component parts identical with or equivalent to those shown in FIG. 6. A high voltage power source 61 is connected to the electrode plates 60*a* and 60*b* through switches 62*a* and 62*b* so as to apply positive or negative voltage to the electrodes 60*a* and 60*b*. The switches 62*a* and 62*b* are controlled by a CPU 38. The CPU 38 connects any one of the two switches 62*a* and 62*b* to the high voltage power source 61 according to the direction of the calculated skew.

In the structure, it is possible to provide smaller carriage load applying means, and correct the skew during sheet carriage in the simple structure.

Though the electrode plate has the comb-shaped structure in the embodiment, it must be noted that an electrode plate form should not be limited to this. For example, a flat plate electrode or a lattice electrode may be used, resulting in the same effect. Further, it is to be noted that the electrode should not be limited to the plate-type electrode.

Further, though constant voltage is applied to the electrode plate in the embodiment, it must be noted that voltage may be irregular. The applied voltage may be controlled according to the magnitude of a calculated skew angle so as to vary the carriage load. It is thereby possible to reduce a correction time.

Embodiment 11

Figure 21:
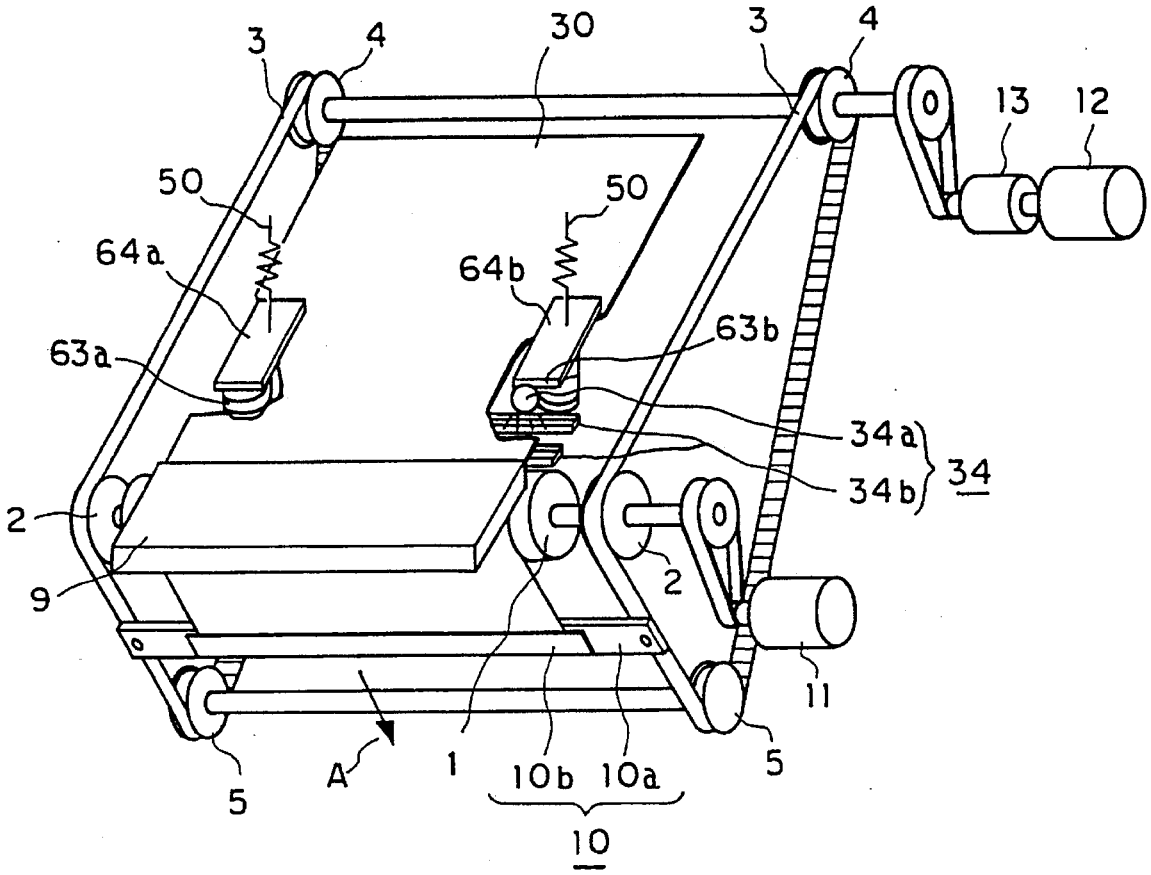
FIG. 21 is a perspective diagram showing an essential structure in the eleventh embodiment of the sheet carrying apparatus of the present invention.

FIG. 21 is a perspective diagram showing an essential structure in the eleventh embodiment of the sheet carrying apparatus of the present invention. The drawing shows a sheet 30 which is partially cut away. In FIG. 21, the same reference numerals are used for component parts identical with or equivalent to those shown in FIGS. 49 and 50. In FIG. 21, an ink sheet 6 and an ink sheet carrying portion are omitted.

Though carriage load applying means includes the electrode plate in the tenth embodiment, in the embodiment, the carriage load applying means includes inductors 63*a* and 63*b*. A description will now be given of only a point in which the embodiment is different from the tenth embodiment. In the following discussion, the inductor 63*a* or 63*b* is sometimes referred to as inductor 63.

The inductors 63*a* and 63*b* forming the carriage load applying means are disposed, in the upstream of a sheet carrying roller 1, on the right and left sides with respect to a sheet center line in a sheet carrying direction so as to extend in a horizontal scanning direction. The inductors 63*a* and 63*b* are connected to an unillustrated power source. In the structure, the power source can independently apply voltage to the right and left inductors. Friction members 64*a* and 64*b* are made of, for example, magnetic material, and are disposed at positions opposed to the inductors 63*a* and 63*b* through the sheet 30. The friction members 64*a* and 64*b* are made of magnetic material such as iron, and a material having high coefficient of friction such as felt, or rubber is applied to surfaces of the friction members in contact with the sheet 30. Further, the friction members 64*a* and 64*b* are supported by springs (supporting mechanism) 50 such that the friction members 64*a* and 64*b* can be brought into contact with/disengaged from the sheet 30. Here, there are employed, for example, the springs 50 which can support own weight in an upward direction. In the following discussion, the friction member 64*a* or 64*b* is sometimes referred to as friction member 64.

Current flows in the inductor 63 to generate a magnetic field. The friction member 64 is attracted by the generated magnetic field toward the inductor 63. Then, the sheet 30 is held between the inductor 63 and the friction member 64. At the time, frictional resistance is caused between the sheet 30 and the friction member 64, and the frictional resistance serves as the carriage load.

The friction member 64 includes the magnetic material to which a felt or the like is applied. However, it must be noted that present invention should not be limited to such a structure, and for example, magnetic material whose surface is roughly machined may be used as the friction member 64. That is, the friction member 64 can include any material as long as the material may be attracted by the magnetic field, and can contact the sheet 30 so as to generate a frictional force serving as the carriage load.

In the embodiment, as in the tenth embodiment, according to a direction of skew detected by a position detecting sensor 34, the inductor 63*a* or 63*b* to which the voltage should be applied is selected. By application of predetermined voltage to the inductor 63, it is possible to correct the skew without stopping the carriage of the sheet. Further, the applied voltage may be controlled according to the magnitude of a skew angle so as to vary the carriage load. It is thereby possible to reduce a correction time.

According to the embodiment, it is possible to provide smaller carriage load applying means, and provide an apparatus having a simple mechanism.

Embodiment 12

Figure 22:
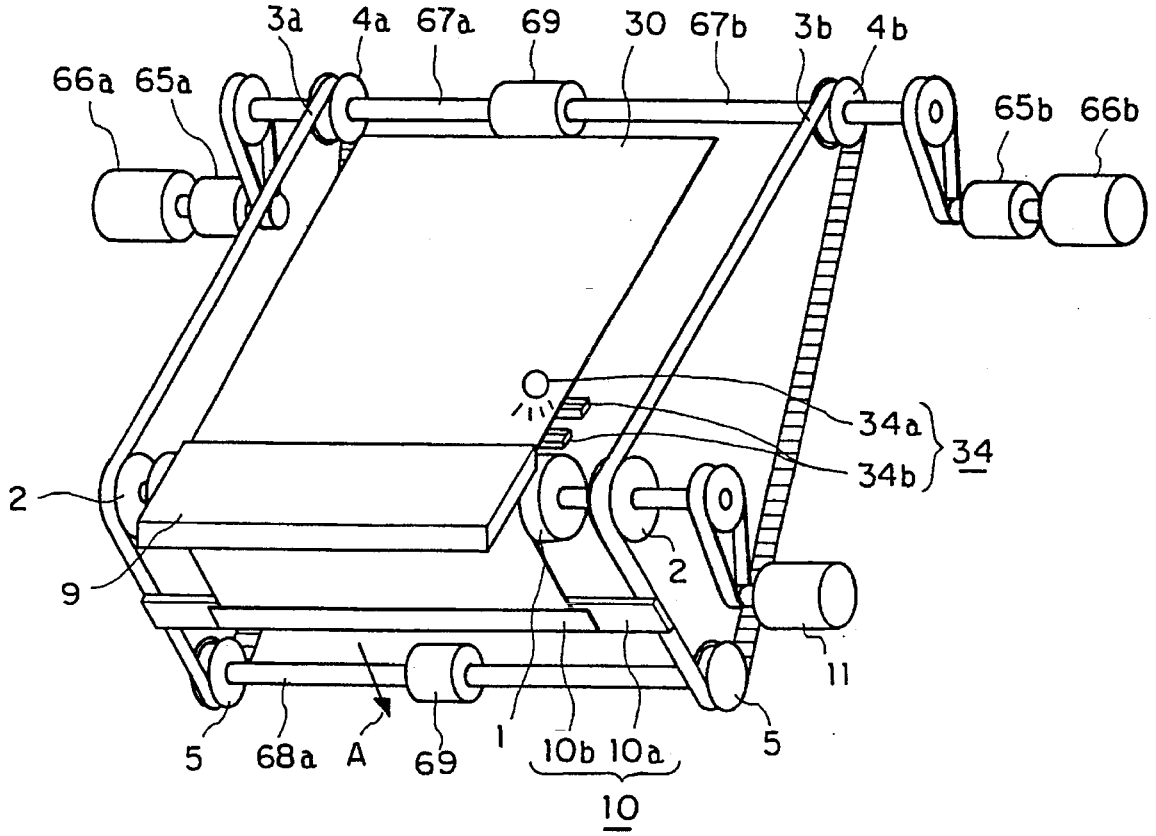
FIG. 22 is a perspective diagram showing an essential structure in the twelfth embodiment of the sheet carrying apparatus of the present invention.

FIG. 22 is a perspective diagram showing an essential structure in the twelfth embodiment of the sheet carrying apparatus of the present invention. In FIG. 22, the same reference numerals are used for component parts identical with or equivalent to those shown in FIGS. 49 and 50.

In the sheet carrying apparatus in the embodiment, a carrying force is applied to a sheet 30 at a portion in the downstream of the sheet carrying roller 1. A description will now be given of a structure of carrying force applying means.

A clamper 10 serves as a clamp mechanism to clamp a distal end of the carried sheet 30, and is disposed on the right and left sides with respect to a sheet center line in a sheet carrying direction. Clamp drive mechanisms are provided to independently carry the clamper 10 by a predetermined driving force. Specifically, timing belts 3*a* and 3*b* are coupled with drive motors 66*a* and 66*b* whose rotation speed can be changed through torque limiters 65*a* and 65*b*. Further, a shaft support 69 rotatably supports a first shaft 67*a* or 67*b*, and a second shaft 68*a* or 68*b*. In addition, second pulleys 4*a* and 4*b* are rotatably mounted to a shaft of the sheet carrying roller 1. Thus, it is possible to independently rotate the right and left timing belts 3*a* and 3*b* to which a bridge 10*a* of the clamper 10 is secured. Here, it is assumed that torque values of the two torque limiters 65*a* and 65*b* are substantially identical.

In order to correct skew, a difference is provided in speed between the right and left timing belts 3*a* and 3*b* so as to control tensile strength applied from the clamper 10 in the carrying direction of the sheet 30.

Figure 23:
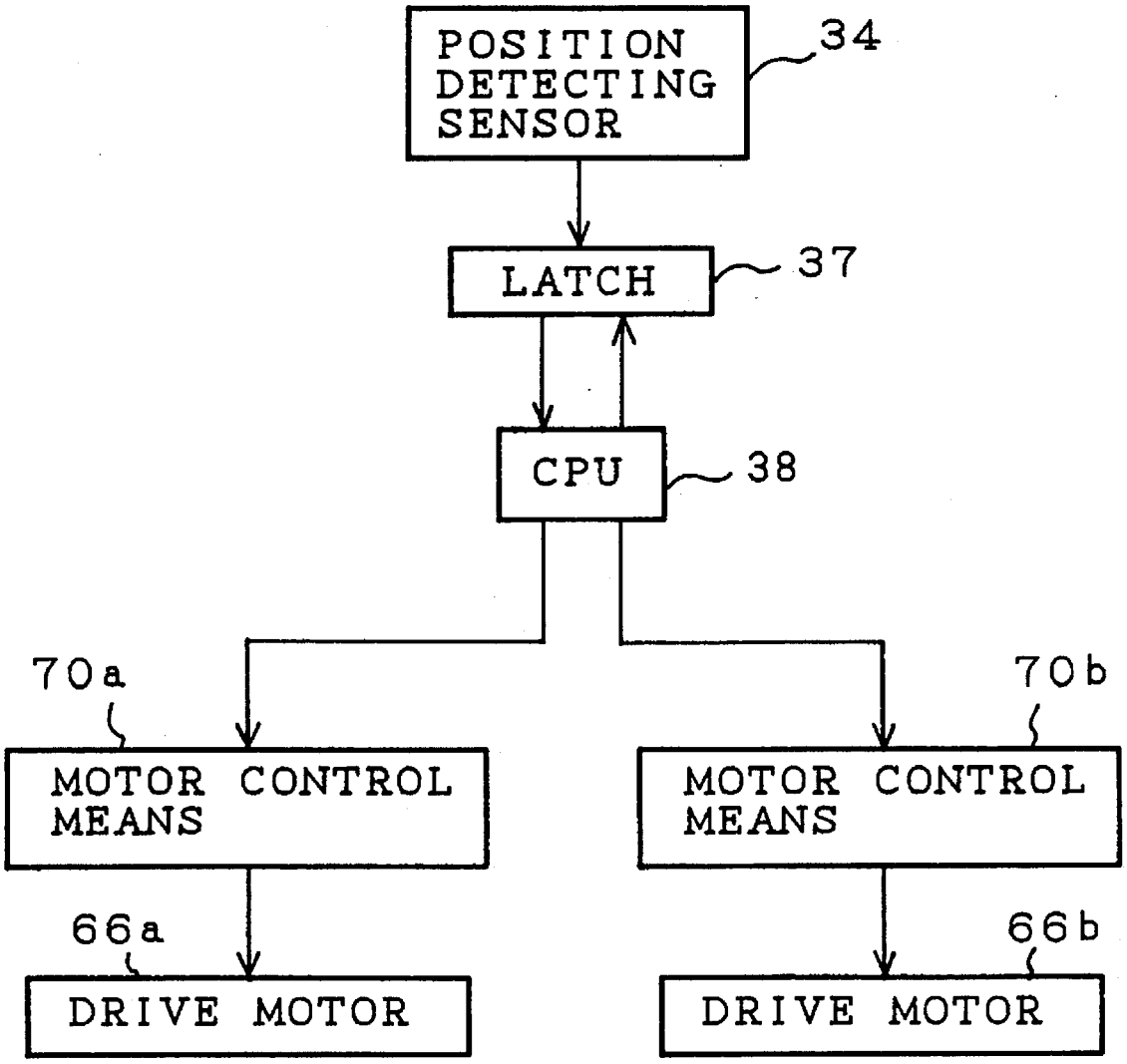
FIG. 23 is a block diagram showing a control system in the twelfth embodiment.

FIG. 23 is a block diagram showing a control system in the embodiment. In FIG. 23, the same reference numerals are used for component parts identical with or equivalent to those shown in FIG. 6. The CPU 38 calculates a skew angle $\theta_c$ depending upon read position data of a sheet edge. Further, the CPU 38 compares the calculated skew angle $\theta_c$ with a predetermined permissible skew angle $\theta_0$ so as to decided whether or not the correction is required. If it is decided that the correction is required, the CPU 38 determines, depending upon the sign of the calculated skew angle $\theta_c$, a drive motor 66 to be decelerated, and outputs a decelerating signal to motor control means 70. Further, the CPU 38 outputs a deceleration completion signal to the motor control means 70 when the skew angle $\theta_c$ becomes equal to the predetermined permissible skew angle $\theta_0$ or less after the deceleration signal is outputted.

The motor control means 70 is programmed such that the drive motor 66 can be driven at, for example, two rotation speeds N1 and N2 (N1>N2), and can decelerate the rotation speed from N1 to N2 when the deceleration signal is inputted from the CPU 38. Further, the motor control means 70 accelerates the rotation speed from N2 to N1 when the deceleration completion signal is inputted. A correcting operation will now be described by comparison between a case where the correction is made and a case where no correction is made.

First, a description will now be given of the case where the skew is not corrected. In order to set a longitudinal direction of the bridge 10*a* to be continuously perpendicular to the carrying direction, the two timing belts 3*a* and 3*b* are circulated at a constant speed in a state in which secured portions of the bridge 10*a* are mutually in phase. At the time, the two drive motors 66*a* and 66*b* drive the timing belts 3*a* and 3*b* at the predetermined number of revolutions N1. When a circulating speed of the clamper 10 is defined as $V_2$, and a speed of the sheet 30 carried by the sheet carrying roller 1 is defined as $V_1$, the number of revolutions N1 is set such that the speed $V_2$ exceeds the speed $V_1$ at a time of non-print.

However, since the sheet 30 is clamped and carried between a thermal head 9 and the sheet carrying roller 1 during print, the clamper 10 to clamp the sheet 30 is circulated at the speed $V_1$. A speed difference between $V_1$ and $V_2$ is absorbed by sliding the torque limiters 65*a* and 65*b*. Further, predetermined torque determined by the torque limiters 65*a* and 65*b* is transmitted to the clamper 10 through the second pulleys 4*a* and 4*b* and the timing belts 3*a* and 3*b*. Therefore, predetermined tensile strength determined by the torque limiters 65*a* and 65*b* is substantially uniformly applied from the clamper 10 to sheet 30 in a sheet width direction so that no skew is caused due to the tensile strength applied from the clamper 10.

Next, a description will now be given of the case where the skew is corrected. The CPU 38 selects, depending upon a direction of the detected skew, the timing belt 3 on the side on which the sheet 30 is moved more ahead. The CPU 38 decelerates the rotational speed N1 of the drive motor 66 to the predetermined second rotational speed N2 through the motor control means 70*a* or 70*b* such that a speed of the selected timing belt 3 becomes slightly lower than the sheet carrying speed $V_1$. At the time, slack is generated in the sheet 30 at a portion between the sheet carrying roller 1 and the clamper 10. Thus, no tensile strength is applied to the sheet 30 from the torque limiter 65 on the decelerating side, and tensile strength is applied to the sheet 30 only from the torque limiter 65 on the side on which the timing belt 3 is not decelerated. Hence, there is generated a deviation of the tensile strength applied from the clamper 10 in the sheet width direction, and the deviation becomes larger in a direction closer to the side on which the timing belt 3 is not decelerated. When the tensile strength to tense the sheet 30 is decreased, the carriage speed is decreased as in a case where the carriage load is applied. Therefore, according to the deviation of the tensile strength, the carriage speed is accelerated on the side on which the sheet 30 is moved more ahead. As a result, the correction is made such that the sheet is skewed in a reverse direction. The CPU 38 accelerates the rotational speed of the drive motor on the accelerating side from N2 to N1 when the skew angle $\theta_c$ becomes equal to the predetermined permissible skew angle $\theta_0$ or less. The above operation is executed during a predetermined carriage time so as to correct the skew generated during carriage.

In the embodiment, at a time of the skew correction, the circulating speed of the timing belt on the side having a larger amount of sheet carriage is set to be lower than the carrying speed of the sheet. However, it must be noted that the correction should not be limited to this method. In contrast with this, it is also possible to correct the skew by setting the circulating speed of the timing belt on the side having a smaller amount of sheet carriage to be higher than the carrying speed of the sheet. In this case, when the correction is not made, circulating speeds of both the timing belts are set to be lower than the carrying speed of the sheet.

Further, it is to be noted that the present invention should not be limited to the clamp mechanism to clamp the distal end of the sheet, and may be applied to, for example, another mechanism which can circulate while attracting the distal end of the sheet by static electricity.

Embodiment 13

Figure 24:
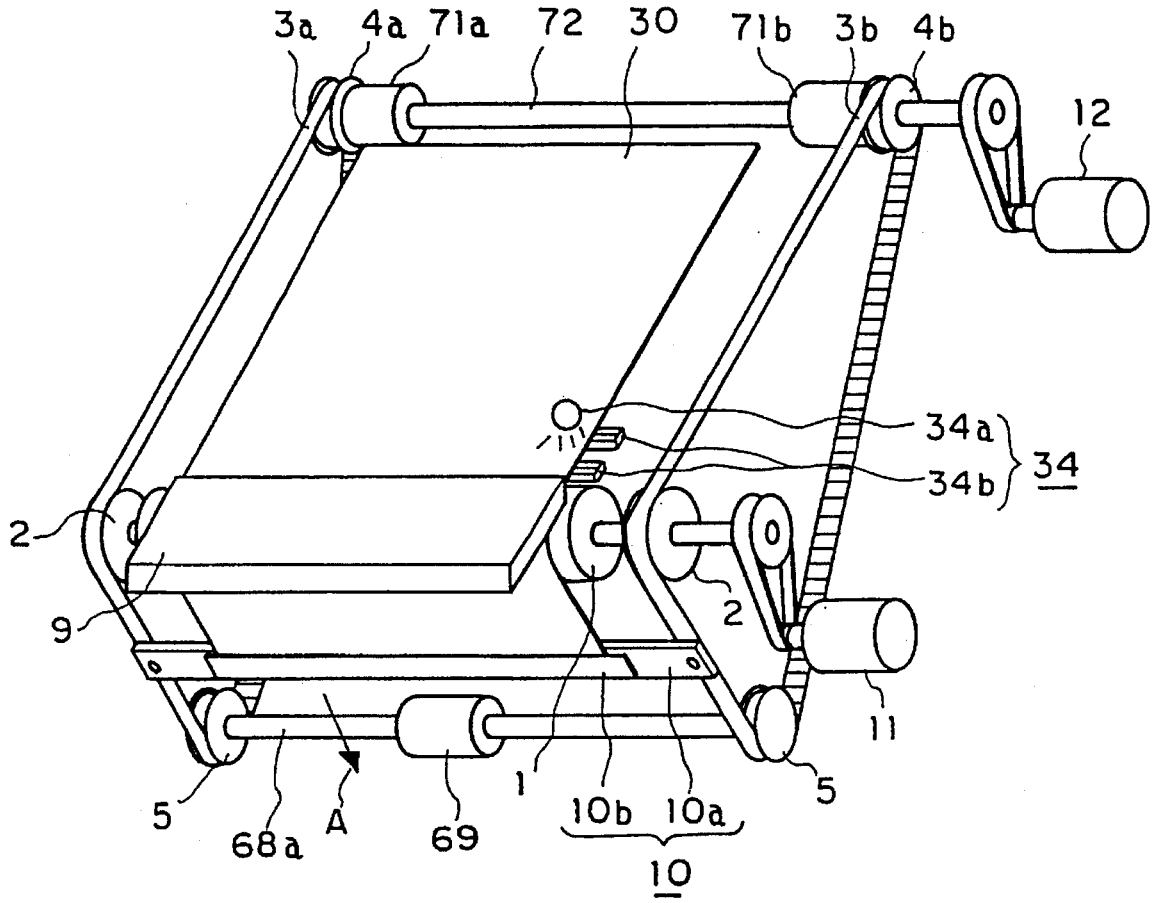
FIG. 24 is a perspective diagram showing an essential structure in the thirteenth embodiment of the sheet carrying apparatus of the present invention.

FIG. 24 is a perspective diagram showing an essential structure in the thirteenth embodiment of the sheet carrying apparatus of the present invention. Though the circulating speeds of the right and left timing belts 3*a* and 3*b* are independently controlled in the twelfth embodiment, in the embodiment, right and left driving forces to drive the timing belts 3*a* and 3*b* are independently controlled. A description will now be given of only a point in which the embodiment is different from the twelfth embodiment.

As shown in FIG. 24, a drive motor 12 to drive the timing belt 3 is coupled with a first shaft 72. The first shaft 72 supports second pulleys 4*a* and 4*b* through electromagnetic clutches 71*a* and 71*b*. The respective electromagnetic clutches 71*a* and 71*b* can provide control in which torque transmitted from the drive motor 12 through the second pulley 4 to the timing belt 3 can be switched over from T1 to T2 (T1>T2). Further, a speed of the timing belt 3 is determined by the number of revolutions of the drive motor 12, and is set such that the speed is continuously greater than a sheet carrying speed determined by the number of revolutions of a drive motor 11. In addition, a shaft support 69 rotatably supports second shafts 68*a* and 68*b* coupled with third pulleys 5, and the second pulleys 4*a* and 4*b* are rotatably mounted to a shaft of a sheet carrying roller 1.

In the embodiment, the right and left transmitting torque of the electromagnetic clutches 71*a* and 71*b* are independently controlled, thereby independently controlling the right and left torque transmitted from the drive motor 12 through the timing belts 3*a* and 3*b* to a clamper 10. Therefore, right and left tensile strength applied by the clamper 10 to a sheet 30 can independently be controlled so that skew can be corrected during sheet carriage.

A description will now be given of a more detailed operation. When no correction is made during print or carriage, the transmitting torque of the electromagnetic clutches 71*a* and 71*b* are set to the same predetermined value T1. Thus, equivalent predetermined torque T1 is transmitted from the right and left timing belts 3*a* and 3*b* to the clamper 10. As a result, the sheet 30 is carried while predetermined tensile strength determined by the torque T1 is substantially uniformly applied to the sheet in a horizontal scanning direction.

In order to correct the skew generated during print or carriage, the transmitting torque of the electromagnetic clutch 71, coupled with the second pulley 4 supporting the timing belt 3 on the side on which the sheet 30 is moved more ahead, is set to T2 according to a calculated skew angle $\theta_c$. As a result, reduction is caused in torque transmitted to the clamper 10 from the timing belt 3 on the side on which the sheet 30 is moved more ahead. Hence, there is generated a deviation of the tensile strength applied from the clamper 10 to the sheet 30, and the deviation is more decreased in a direction closer to the side on which the sheet 30 is moved more ahead. Therefore, a carrying speed is decreased on the side on which the sheet 30 is moved more ahead, and the sheet 30 is skewed in a direction opposed to a direction of the calculated skew, resulting in correction of the skew. When the calculated skew angle $\theta_c$ becomes within a predetermined permissible skew angle $\theta_0$, the transmitting torque of the electromagnetic clutch 71 is switched over from T2 to T1. The above operation is repeated until the carriage is completed so as to correct the skew of the sheet.

In the embodiment, it is possible to correct the sheet skew during carriage without stopping the carriage of the sheet, and apply a carrying force from the clamper to the sheet. Thus, no additional member is required in the course of the carriage, and a structure can be formed by using a conventional structure.

Though the transmitting torque of the electromagnetic clutch 71 is decreased at a time of correction in the embodiment, it must be noted that the correction should not be limited to this method. The transmitting torque may be increased at the time of correction, resulting in the same effect. For this purpose, at the time of correction, it is sufficient to increase a transmitting torque value of the electromagnetic clutch 71 which is coupled with the second pulley 4 supporting the timing belt 3 on the side on which the sheet 30 is delayed.

Embodiment 14

Figure 25:
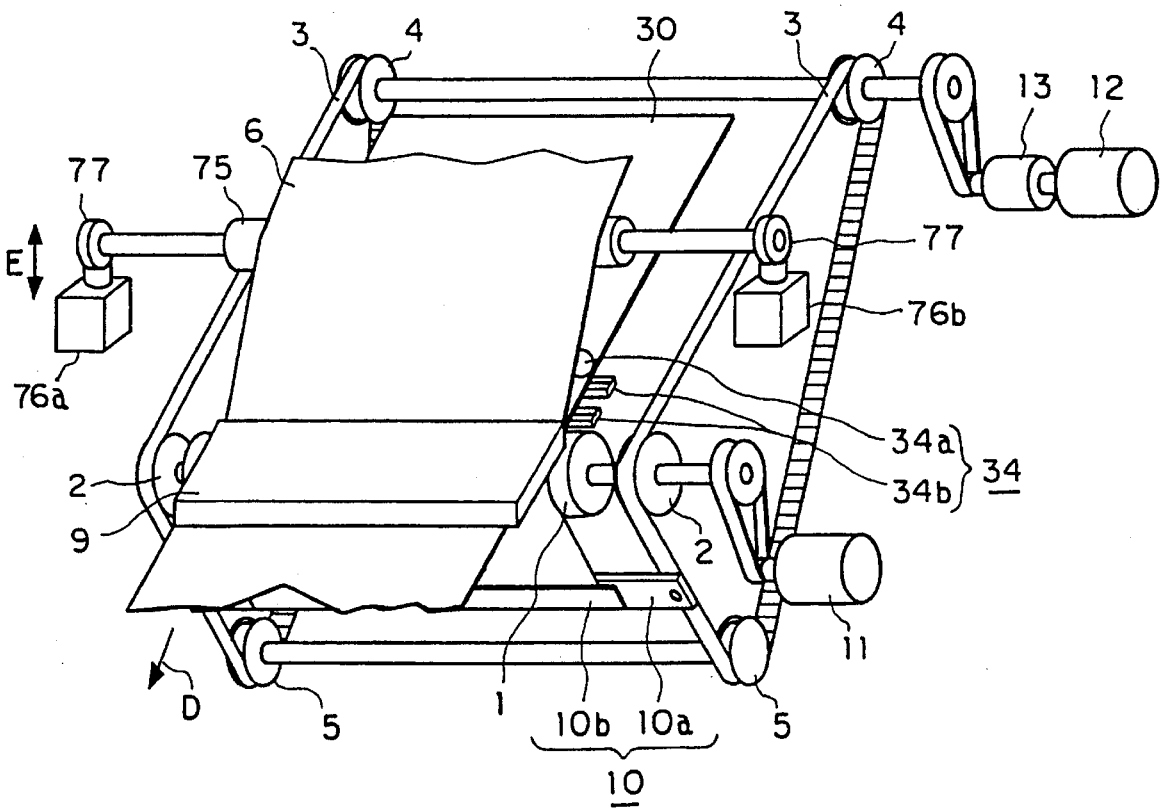
FIG. 25 is a perspective diagram showing an essential structure in the fourteenth embodiment of the sheet carrying apparatus of the present invention.
Figure 26:
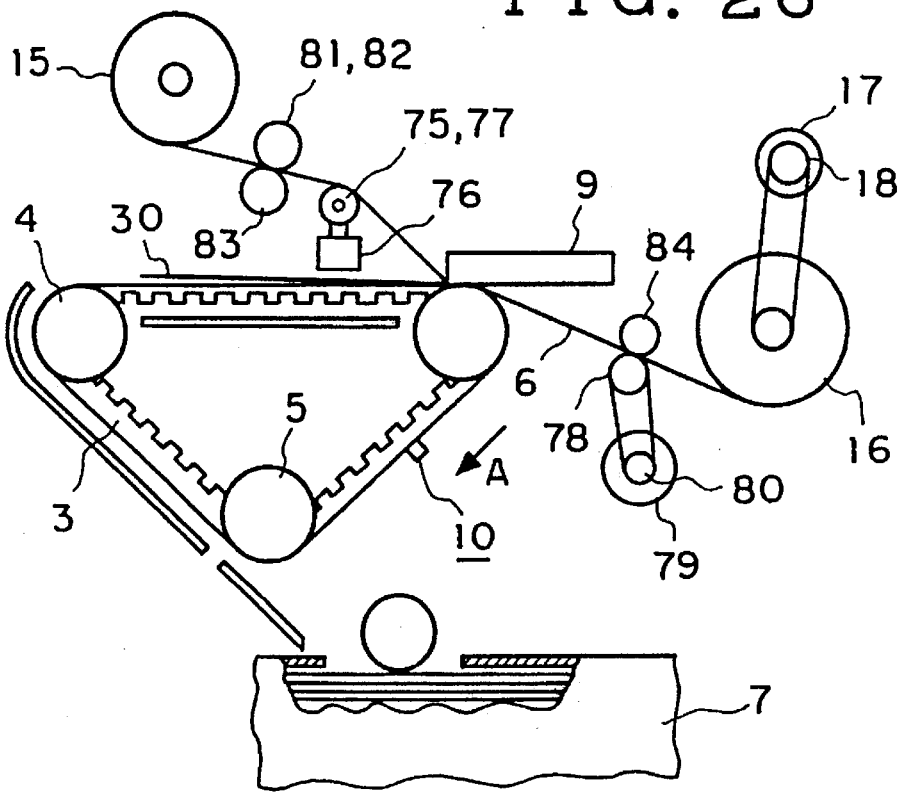
FIG. 26 is a side view showing the essential structure in the fourteenth embodiment of the sheet carrying apparatus.

FIG. 25 is a perspective diagram showing an essential structure in the fourteenth embodiment of the sheet carrying apparatus of the present invention, and FIG. 26 is a side view thereof. In the embodiment, a variation is generated in a distribution of a carrying force in a width direction of an ink sheet 6, thereby correcting skew of a sheet 30. With reference to FIGS. 25 and 26, a description will now be given of component parts in the embodiment. In FIGS. 25 and 26, the same reference numerals are used for component parts identical with or equivalent to those shown in FIGS. 49 and 50.

During print, the ink sheet 6 is sent out from a supply roll 15 which is rotatably supported, and passes through a back tension roller 81, an ink sheet roller 75, a thermal head 9, and an ink sheet carrying roller 78 so as to be wound at a winding roll 16 (in a direction of the arrow D in FIG. 25). The back tension roller 81 is coupled with a torque limiter 82. The ink sheet 6 is held between the back tension roller 81 and a pinch roller 83. Therefore, torque determined by a predetermined torque value of the torque limiter 82 is transmitted to the ink sheet 6 during print through the back tension roller 81. That is, back side tensile strength Fib is applied to the ink sheet 6. The ink sheet carrying roller 78 is coupled with a drive motor 79 through a torque limiter 80. The ink sheet 6 is carried while the ink sheet 6 being held between the ink sheet carrying roller 78 rotated by the drive motor 79 and a pinch roller 84. Torque determined by a torque value of the torque limiter 80 is transmitted to the ink sheet 6 through the carrying roller 78. Thus, front side tensile strength Fif is applied to the ink sheet 6.

A description will now be given of a structure of carrying force applying means in the embodiment. The ink sheet roller 75 is rotatably supported by linear actuators 76*a* and 76*b* through a bearing 77. The linear actuators 76*a* and 76*b* are vertically movable mechanisms to urge the ink sheet roller 75 toward the ink sheet 6 according to a control signal. For example, solenoids are used as the linear actuators 76*a* and 76*b*, and are driven in directions of the arrow E in FIG. 25. In the following discussion, the linear actuator 76*a* or 76*b* is sometimes referred to as linear actuator 76.

At a time of non-correction, the ink sheet roller 75 is supported to extend substantially parallel to the ink sheet carrying roller 78. When the skew of the sheet 30 is corrected, any one of the right and left linear actuators 76 is driven to urge one side of the ink sheet roller 75 toward the ink sheet 6. At the time, since a bent portion is formed in the ink sheet 6 at a portion urged toward the ink sheet roller 75, an ink sheet path length (hereinafter referred to as ink sheet path length) from the back tension roller 81 to the ink sheet carrying roller 78 is increased. As stated above, the ink sheet roller 75 has the function of controlling the upstream ink sheet path length.

Figure 27:
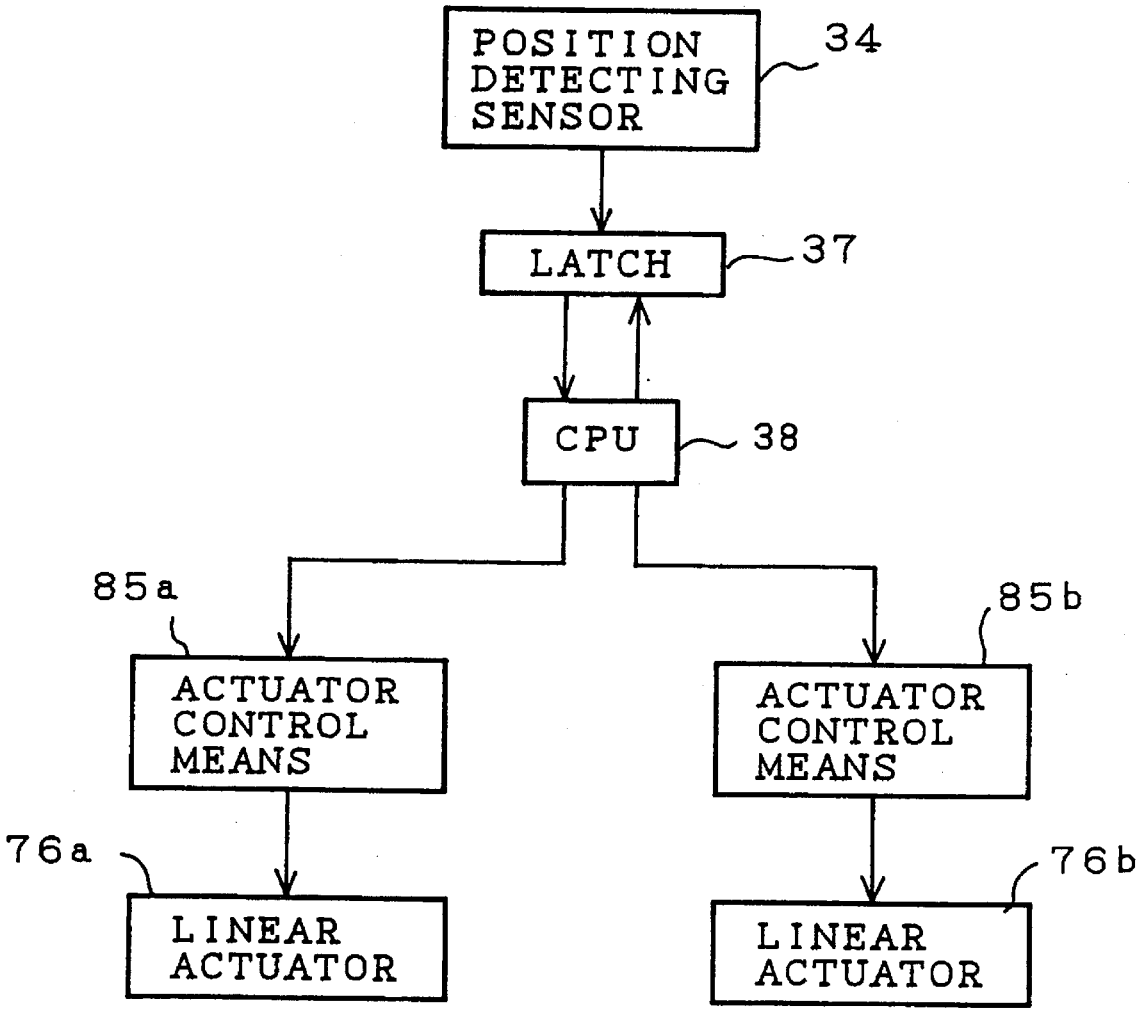
FIG. 27 is a block diagram showing a control system in the fourteenth embodiment.

FIG. 27 is a block diagram showing a control system in the embodiment. With reference to the drawing, a description will now be given of the control system. In FIG. 27, the same reference numerals are used for blocks to provide operations identical with or equivalent to those in blocks shown in FIG. 6.

A CPU 38 compares a calculated skew angle $\theta_c$ with a predetermined permissible skew angle $\theta_0$ so as to decide whether or not the correction is required. If it is decided that the correction is required, the CPU 38 determines, depending upon the sign of the calculated skew angle $\theta_c$, the linear actuator 76 to be drive. Further, the CPU outputs a drive signal to actuator control means 85 corresponding to the selected linear actuator 76. After the drive signal is outputted, the CPU 38 outputs a drive completion signal to the actuator control means 85 when the skew angle $\theta_c$ becomes equal to the predetermined permissible skew angle $\theta_0$ or less.

Figure 28:
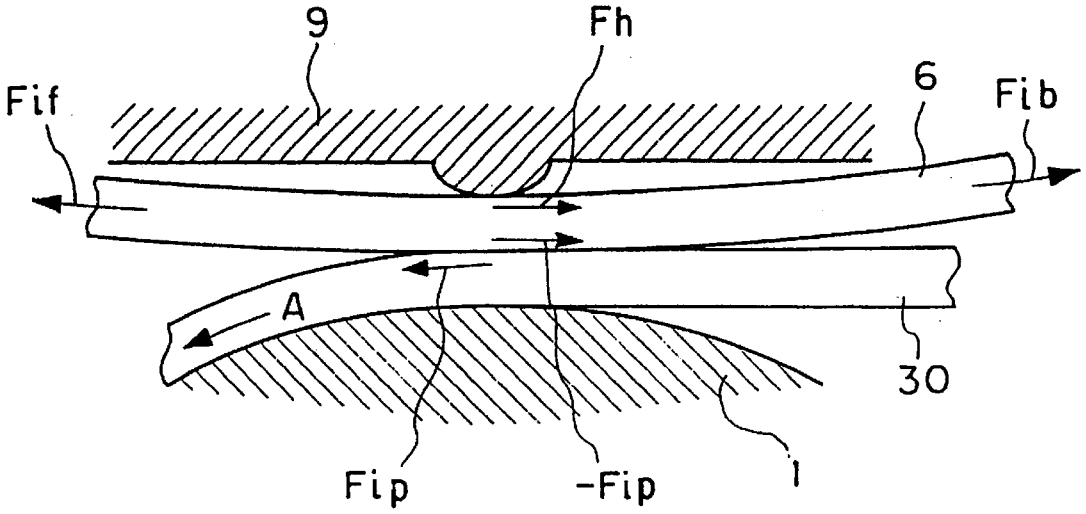
FIG. 28 is an explanatory view of a principle of correction in the fourteenth embodiment.

A description will now be given of a principle of the skew correction using the ink sheet 6 with reference to FIG. 28. FIG. 28 is an explanatory view showing an enlarged section in the vicinity of a print portion during print. In FIG. 28, the arrow A denotes a sheet carrying direction.

A description will now be given of a carrying force applied to the ink sheet 6 and a force transmitted from the ink sheet 6 to the sheet 30. However, for the sake of simplicity, a force transmitted from a sheet carrying roller 1 is neglected. During the print, the front side tensile strength Fif from the carrying roller 78, and the back side tensile strength Fib from the back tension roller 81 are applied to the ink sheet 6. Further, a carriage load Fh depending upon frictional resistance between the ink sheet 6 and the stationary thermal head 9 is applied to the ink sheet 6. Here, the ink sheet 6 and the sheet 30 are held between the sheet carrying roller 1 and the thermal head 9 so that a force represented by the following expression (2) is transmitted from the ink sheet 6 and the sheet 30:

$$Fip=Fif-(Fib+Fh) \quad (2)$$

A description will now be given of a principle of the correction using the force Fip applied to the sheet 30 according to the expression (2). As seen from the expression (2), the magnitude and a direction of Fip can be controlled by the front side tensile strength Fif and the back side tensile strength Fib of the ink sheet 6. A carrying speed of the sheet 30 depends upon the carrying force applied to the sheet 30 so that the carrying speed of the sheet 30 can be controlled by controlling the strength Fif and Fib. Therefore, if a deviation is provided for the front and back tensile strength of the ink sheet 6, according to the deviation, a deviation of the carrying speed is caused in a width direction of the sheet 30. As a result, the sheet 30 can be skewed. Thus, it is possible to correct the skew of the sheet 30 by controlling the strength Fif and Fib according to the detected skew.

A description will now be given of setting for the tensile strength of the ink sheet 6 in the embodiment using the principle of correction according to the expression (2). In the embodiment, the front side tensile strength Fif and the back side tensile strength Fib determined by the torque values of the torque limiter 80 and the torque limiter 82 shown in FIG. 26 are set so as to meet the expression (3):

$$(Fif-Fib)>Fh \quad (3)$$

When the expression (3) is met, the force Fip applied from the ink sheet 6 to the sheet 30 becomes continuously a positive value. That is, the force Fip is applied in a direction to increase an amount of carriage of the sheet 30. As a deviation of Fif from Fib is more increased in a width direction of the ink sheet 6, the amount of sheet carriage is more increased. For example, when the deviation of Fif from Fib is more increased on the right side with respect to a travelling direction of the sheet 30, the amount of carriage of the sheet 30 is more increased on the right side than on the left side. Consequently, the sheet 30 is skewed to the left with respect to the carrying direction.

A description will now be given of the skew correction in the embodiment depending upon the above principle. When no skew is detected during print, the linear actuators 76*a* and 76*b* are not driven. Therefore, a longitudinal direction of the ink sheet roller 75 is positioned to extend substantially parallel to a longitudinal direction of the sheet carrying roller 1. At the time, predetermined tensile strength is applied to the ink sheet 6 uniformly in the width direction. Thus, the force Fip causes no skew.

On the other hand, when the skew of the sheet 30 is detected, the CPU 38 drives the linear actuator 76 on the side on which carriage of the sheet 30 is delayed due to the skew, and urges the ink sheet roller 75 toward the ink sheet 6 such that the sheet 30 is skewed in a direction opposed to a direction of the calculated skew. With this operation, the ink sheet path length is more extended in a direction closer to the side on which the linear actuator 76 is driven. The ink sheet is additionally supplied from the supply roll 15 by an amount corresponding to an increase in the path length. However, since a shaft position of the supply roll 15 is fixed, the ink sheet 6 can be supplied uniformly in the width direction by the increase. Therefore, on the side on which the linear actuator 76 is not driven, the supplied ink sheet length becomes longer than the ink sheet path length. As a result, slack is provided in the sheet 6 on the side which is not driven, and the tensile strength of the ink sheet 6 is deviated.

As set forth above, the amount of carriage of the sheet 30 is more increased in a direction closer to the side on which the linear actuator 76 is driven. That is, the sheet 30 is skewed in the direction opposed to the direction of the calculated skew, resulting in the correction of the skew.

The linear actuator 76 returns to a predetermined position when the calculated skew angle $\theta_c$ becomes equal to or less than the predetermined permissible skew angle $\theta_0$. The above operation is executed during a predetermined carriage time so as to correct the skew generated in the sheet 30 during carriage.

According to the embodiment, by using the ink sheet 6, it is possible to correct the skew during carriage in a simple mechanism without any mechanism added to a sheet carrying path.

In the structure shown in FIG. 25, the ink sheet roller 75 is interposed between the back tension roller 81 and the thermal head 9. However, it must be noted that the ink sheet roller 75 may be interposed between the thermal head 9 and the ink sheet carrying roller 78 so as to provide the same operation as the above operation, resulting in the same effect.

In the embodiment, though the front side tensile strength Fif and the back side tensile strength Fib of the ink sheet 6 are set to meet the expression (3), it is to be noted that the present invention should not be limited to this. For example, in the structure of the sheet carrying apparatus shown in FIG. 25, the front side tensile strength Fif and the back side tensile strength Fib may be set to meet the expression (4):

$$(Fif-Fib)<Fh \quad (4)$$

In this case, the force Fip applied from the ink sheet 6 to the sheet 30 becomes continuously a negative value. That is, the force Fip serves as load applied in a direction to decrease the amount of carriage of the sheet 30. Thus, in the width direction of the ink sheet 6, the amount of sheet carriage is more decreased on the side on which the deviation of Fif from Fib is more increased. Consequently, the linear actuator 76 on the side having a larger amount of carriage is driven according to the detected skew angle $\theta_c$, and the skew of the sheet 30 can thereby be corrected.

Embodiment 15

Figure 29:
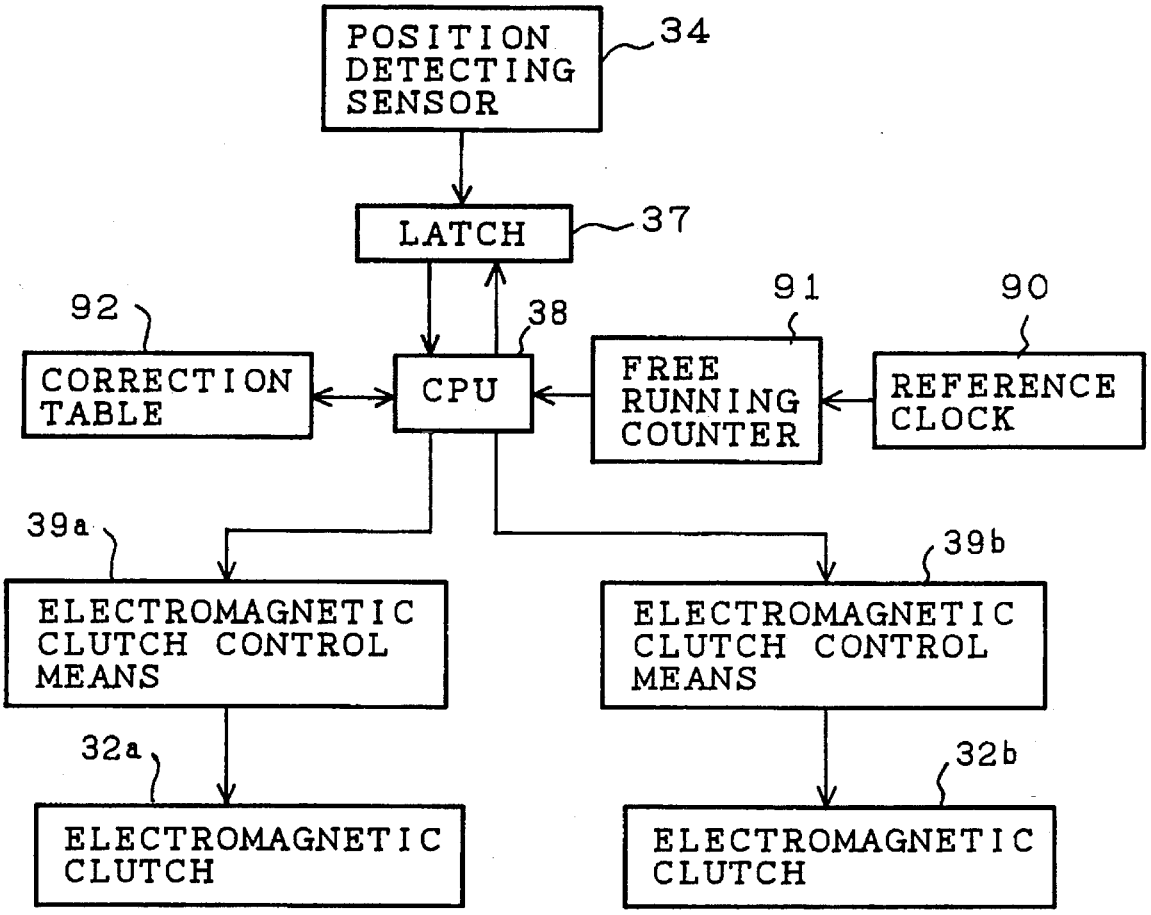
FIG. 29 is a block diagram showing a control system in the fifteenth embodiment of the sheet carrying apparatus of the present invention.

FIG. 29 is a block diagram showing a control system in the fifteenth embodiment of the sheet carrying apparatus of the present invention. In the embodiment, skew is detected for a predetermined time interval Td, and correction is successively made such that a skew angle at a time of skew detection is corrected before the next skew is detected. A description will now be given of a control method.

First, a description will be given of the control system with reference to FIG. 29. In a structure shown in FIG. 29, a reference clock 90, a free running counter 91, and a correction table 92 are added to the structure shown in FIG. 6. An essential structure of a sheet carrying apparatus in the embodiment is equivalent to that shown in FIG. 5. A sheet edge position detected by a position detecting sensor 34 is read from a latch 37 into a CPU 38 in synchronization with a signal outputted from the CPU 38 on a predetermined cycle Td. The CPU 38 determines reading timing depending upon a count value of the free running counter 91 to count the reference clock 90.

The CPU 38 calculates a skew angle $\theta_c$ depending upon read position data of the sheet edge. Further, the CPU 38 selects an electromagnetic clutch 32 to be coupled with a torque limiter 33 depending upon the sign of the calculated skew angle $\theta_c$, that is, depending upon a direction of skew. Concurrently, the CPU 38 reads a coupling time tn of the electromagnetic clutch 32 from the correction table 92. The correction table 92 previously contains a correspondence between a time for which predetermined carriage load is applied (i.e., the coupling time tn) and the skew angle $\theta_c$. The CPU 38 outputs a coupling signal to electromagnetic clutch control means 39 corresponding to the electromagnetic clutch 32 to be coupled with the torque limiter 33. The electromagnetic clutch control means 39 sets the electromagnetic clutch 32 in a coupling state according to the inputted coupling signal. After the elapse of the coupling time tn, the CPU 38 outputs a releasing signal to the electromagnetic clutch control means 39 corresponding to the electromagnetic clutch 32 set in the coupling state so as to set the electromagnetic clutch 32 in a releasing state.

Figure 30:
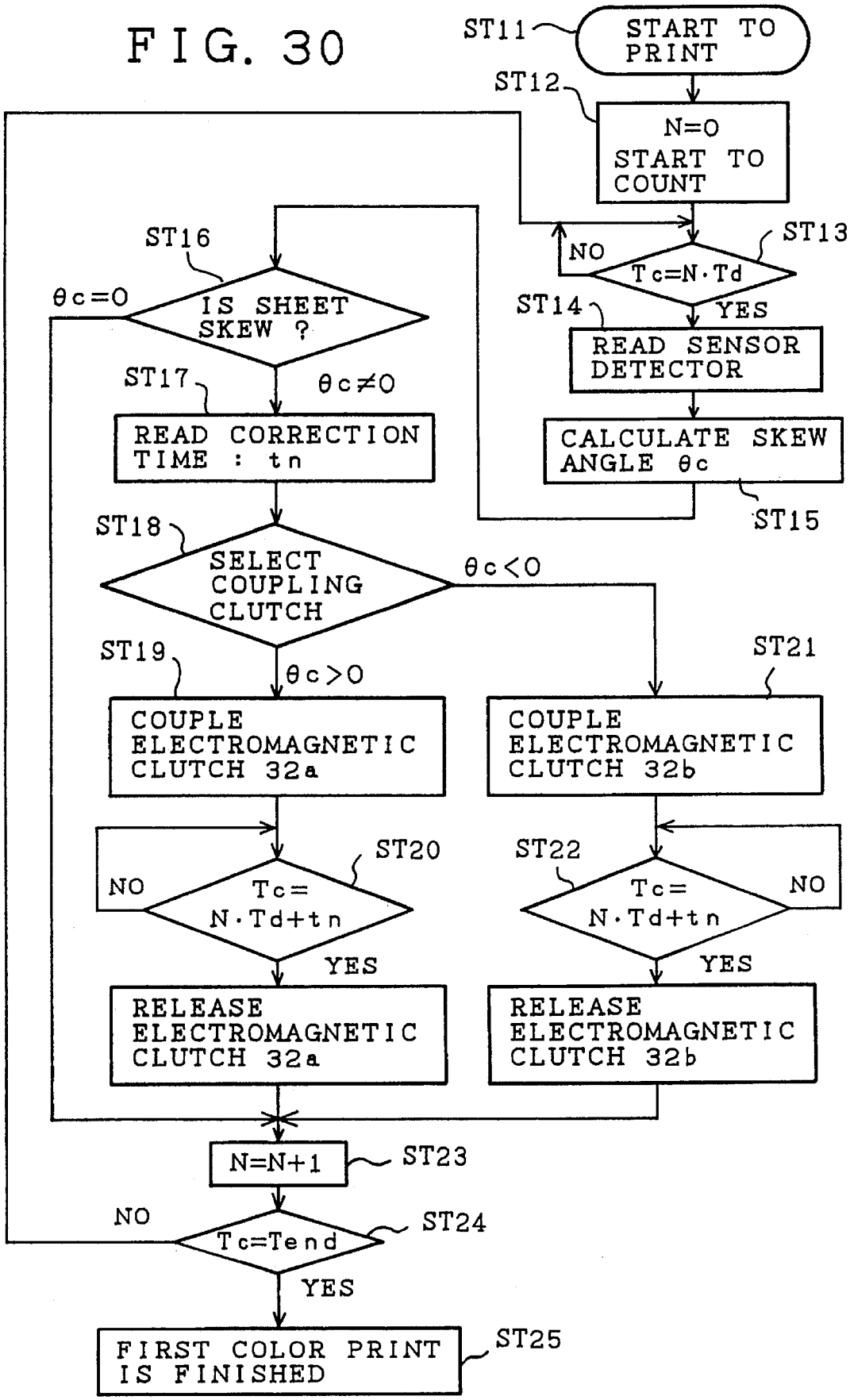
FIG. 30 is a flowchart showing the steps of processing in the fifteenth embodiment.

A description will now be given of a control algorithm in the embodiment with reference to a flowchart of FIG. 30. Here, N in $\theta_{CN}$ means the number of times of detection.

Print is started in Step ST11. In Step ST12, the CPU 38 clears the number of times of detection N (N is an integer) of the skew by the position detecting sensor 34, and causes the reference clock 90 to start to count the free running counter 91. When the count value Tc of the free running counter 91 becomes equal to a predetermined detection cycle Td·N (N is a positive integer) (Step ST13), the CPU 38 reads out an output value from the position detecting sensor 34 through the latch 37 (Step ST14). In Step ST15, the CPU 38 calculates a skew angle $\theta_{CN}$ depending upon the output value from the position detecting sensor 34. In Step ST16, the CPU 38 decides whether or not the calculated skew angle $\theta_{CN}$ has a value of zero.

Subsequently, in Step ST17, the CPU 38 reads the coupling time tn corresponding to the skew angle $\theta_{CN}$ from the correction table 92. In Step ST18, the CPU 38 determines the electromagnetic clutch 32 to be set in the coupling state depending upon the sign of the calculated skew angle $\theta_{CN}$. Further, the CPU 38 outputs the coupling signal to the electromagnetic clutch control means 39 corresponding to the determined electromagnetic clutch 32. In Steps ST19 and ST21, the electromagnetic clutch control means 39 receives the coupling signal so as to couple the electromagnetic clutch 32. Subsequently, the CPU 38 outputs a releasing signal to release the electromagnetic clutch 32 when the count value of the free running counter 91 is incremented by tn from the count value N·Td at the time of skew detection (Steps ST20 and ST22).

In Step ST23, the CPU 38 increments the number of times of detection N. Further, the process from Steps ST13 to ST24 is repeated until the count value Tc becomes an end value $T_{end}$ of the detection. When the count value Tc becomes the end value $T_{end}$ of the detection, the print is finished (Steps ST24 and ST25).

Though no skew is corrected when the skew angle $\theta_c$ is zero in the above algorithm, it must be noted that no correction may be made when the skew angle $\theta_c$ becomes equal to or less than a predetermined permissible skew angle $\theta_0$.

In the above algorithm, the skew angle detected at each discrete time N·Td is corrected for the detection interval Td. Thus, it is impossible to correct skew generated for a period from the time N·Td to a time (N+1)·Td. Further, skew which can not be corrected for the interval Td is added to a subsequently calculated skew angle. Therefore, it is necessary to set the detection interval Td and a torque value of the torque limiter 33 forming carriage load applying means such that the magnitude of the skew angle calculated at each time N·Td becomes equal to or less than a desired target value. According to the detection and the correction as described above, in the sheet carrying apparatus having a relatively smaller variation in the skew angle, it is not necessary to continuously detect the skew angle of the sheet as in the fifth to thirteenth embodiments. Thus, the correction can be made at relatively rough intervals so that control is facilitated.

Though a description has been given of the case where the algorithm is applied to the fifth embodiment, it is to be noted that the algorithm may be applied to other apparatus shown in the sixth to fourteenth embodiments. That is, a cycle to calculate the skew angle is defined as the time Td, and the skew angle calculated at each time N·Td may be corrected by the carriage load applying means within the time Td in which the next skew is not calculated. Further, a carrying force applied by the calculating cycle Td and the carriage load applying means may be predetermined such that the skew angle calculated at each time N·Td can not exceed a predetermined permissible skew angle. It is thereby possible to provide rough detection/correction intervals for the skew angle according to a type of the sheet carrying apparatus. That is, the algorithm can be applied to the sixth embodiment to fourteenth embodiment, similarly resulting in facilitated control.

When the algorithm is applied to other embodiments, the correction table 92 previously contains a correspondence between an applying time of carriage load or a load carrying force by the means in the embodiments and the skew angle $\theta_c$.

In the third to fifteenth embodiments, a description has been given of the case where the correction is made depending upon the skew angle $\theta_c$ described in the first embodiment. However, it is also possible to detect an amount of carriage as described in the second embodiment so as to correct a deviation of the skew angle from the amount of carriage.

Embodiment 16

The embodiment relates to a sheet carrying apparatus to carry a sheet 30 a plurality of times on the same carrying path, in particular, like a color printer. A structure and skew correction in the sheet carrying apparatus are similar to those in the above embodiments. In this case, on the basis of skew detected at a time of first carriage, correction is made during second or later carriage.

A description will now be given of the operation. No correction is made at the time of first carriage of the sheet 30, and a sheet edge position during carriage, detected by a position detecting sensor 34, is stored in storage means. Further, during second or later carriage, skew is calculated depending upon the stored sheet edge position data so as to correct the skew.

In the embodiment, it is possible to reduce a relative error in a carrying direction for each carriage, and reduce misregistration of color, in particular, in the color printer. When edges of the sheets 30 detected by the position detecting sensor 34 are different in shape (particularly, in the straightness), it may possibly be decided that the sheet is skew even when no skew is present. However, in this method, such possibility can be reduced. Further, in the fifth to fourteenth embodiments, it is necessary to control, for example, a mounting position of the position detecting sensor 34 such that a reference position of the position detecting sensor 34 can be positioned in alignment with a reference sheet carrying direction. However, in the embodiment, the control can be simplified.

In the first, and third to fifteenth embodiments, on the basis of the skew detected at the time of first carriage among the plurality of carriage, the correction may be made during the second or later carriage. Thus, in addition to the effects in the respective embodiments, it is possible to reduce the relative error in the carrying direction for each carriage, and reduce the misregistration of color, in particular, in the color printer. Further, the embodiment may be applied to the third to fifteenth embodiments employing the position detecting sensor 34. In this case, even when the edges of the sheets 30 detected by the position detecting sensor 34 are different in shape (particularly, in the straightness), it is possible to avoid an erroneous decision that the sheet is skew when no skew is present.

Embodiment 17

Figure 31:
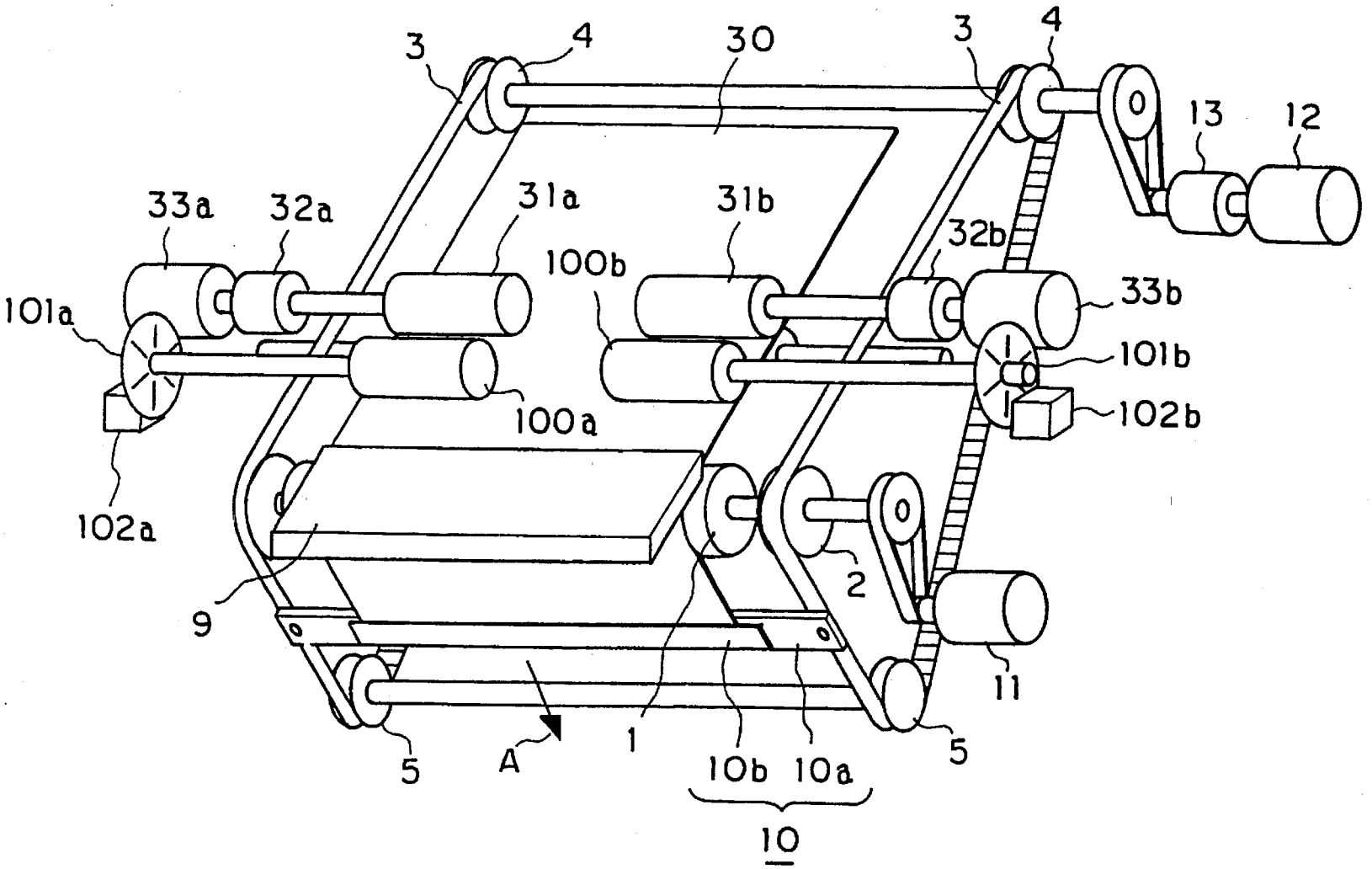
FIG. 31 is a perspective view showing an essential structure in the seventeenth embodiment of the sheet carrying apparatus.

FIG. 31 is a perspective view showing an essential structure in the seventeenth embodiment of the sheet carrying apparatus of the present invention. In FIG. 31, the same reference numerals are used for component parts identical with or equivalent to those shown in FIGS. 49 and 50. In FIG. 31, an ink sheet 6 and an ink sheet carrying portion are omitted.

As shown in FIG. 31, a distal end of the sheet 30 is clamped by a clamper 10, and the sheet 30 is circularly carried in a direction shown by the arrow A in the drawing by forward rotation of a sheet carrying roller 1. At the time, the clamper 10 circulates while applying predetermined tensile strength to the sheet 30. Carriage detecting rollers 100*a* and 100*b* forming means for detecting the sheet 30 are disposed, between the sheet carrying roller 1 and load rollers 31*a* and 31*b*, on the right and left sides with respect to a sheet center line in a sheet carrying direction so as to extend in a horizontal scanning direction. The carriage detecting rollers 100*a* and 100*b* have substantially the same diameter, and include, for example, rubber rollers, or metallic rollers.

The right and left carriage detecting rollers 100*a* and 100*b* are rotatably supported by unillustrated side plates so as to be independently rotated. One ends of the respective carriage detecting rollers 100*a* and 100*b* are coupled with disks 101*a* and 101*b*. The disks 101*a* and 101*b* have marks disposed at constant intervals in a circumferential direction. Theses marks are detected by reflection-type photosensors (sensors) 102*a* and 102*b* fixed on the side plates. Further, the carriage detecting rollers 100*a* and 100*b* are brought by unillustrated springs with a predetermined pressure contacting force, into pressure contact with following rollers disposed at positions opposed to the carriage detecting rollers through the sheet 30. Hence, the carriage detecting rollers 100*a* and 100*b* can rotate while following the sheet 30. In the following discussion, the carriage detecting roller 100*a* or 100*b* is sometimes referred to as carriage detecting roller 100. The disk 101*a* or 101*b* is sometimes referred to as disk 101.

Figure 32:
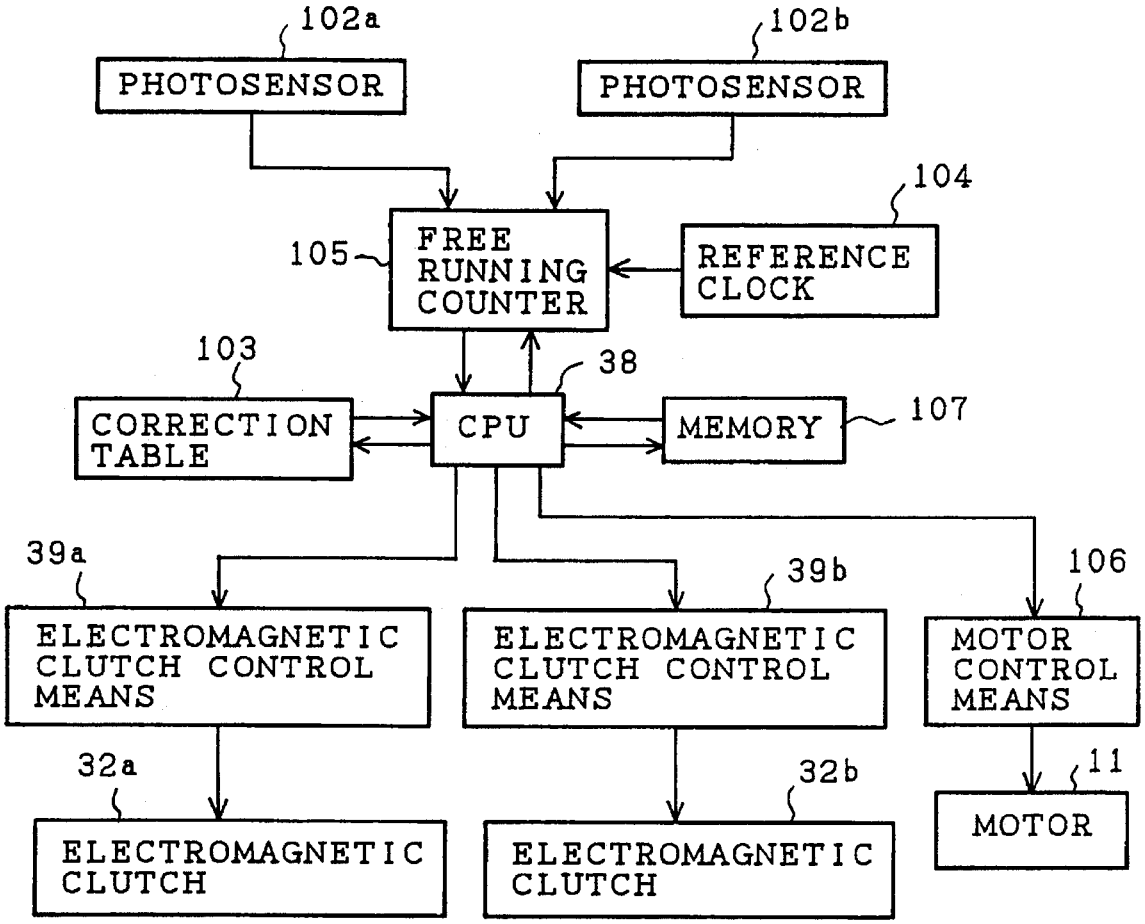
FIG. 32 is a block diagram showing a control system in the seventeenth embodiment.

A description will now be given of a control system in the embodiment with reference to a block diagram of FIG. 32. Each time the photosensors 102*a* and 102*b* detect the marks, the photosensors 102*a* and 102*b* output detection signals to a free running counter 105. The free running counter 105 counts a clock pulse outputted from a reference clock 104, and, in synchronization with the output from the photosensors 102*a* and 102*b*, outputs a count value Tc to a CPU 38. Further, the free running counter 105 counts the detection signals from the photosensors 102*a* and 102*b* so as to output a count value N to the CPU 38. The CPU 38 stores the respective count values in a memory 107. The CPU 38 calculates a skew angle and a deviation of carriage (hereinafter referred to as carriage error) from an amount of reference carriage depending upon the inputted count value Tc and the reference count value $Tc_0$ previously stored in the CPU 38.

Subsequently, the CPU 38 reads a coupling time tn of electromagnetic clutch 32 and the number of motor drive pulse $\omega_{pn}$ from a correction table 103 depending upon the calculated skew angle and the carriage error so as to output the coupling time tn and the number of drive pulse $\omega_{pn}$ to each control means. Here, the reference count value $Tc_1$ is a value calculated depending upon a predetermined reference carrying speed $V_1$. Electromagnetic clutch control means 39 couples/releases the electromagnetic clutch 32 according to coupling/releasing signals inputted from the CPU 38. Further, motor control means 106 controls a rotational speed of a drive motor 11 to drive the sheet carrying roller 1 according to the number of drive pulse $\omega_{pn}$ inputted from the CPU 38.

A description will now be given of a principle of detection of the skew angle and the carriage error in the above structure. The skew of the sheet to be corrected is caused due to the deviation of the carriage speed in a sheet width direction, that is, due to the deviation of the amount of carriage. Further, a variation in the amount of carriage at the time tends to increase or decrease substantially linearly with respect to the horizontal scanning direction as long as large distortion is not generated in the sheet. In addition, an inclination of the variation in the amount of carriage with respect to the horizontal scanning direction is substantially equivalent to the tangent of the skew angle $\theta_c$. Therefore, it is possible to detect an amount of carriage between two points on the sheet in the horizontal scanning direction, and calculate the inclination of the amount of carriage in the horizontal scanning direction depending upon the detected values, thereby calculating the skew angle $\theta_c$ of the sheet depending upon the inclination. Further, the carriage error can be calculated depending upon a difference between the detected amount of carriage and a predetermined amount of reference carriage.

Figure 33:
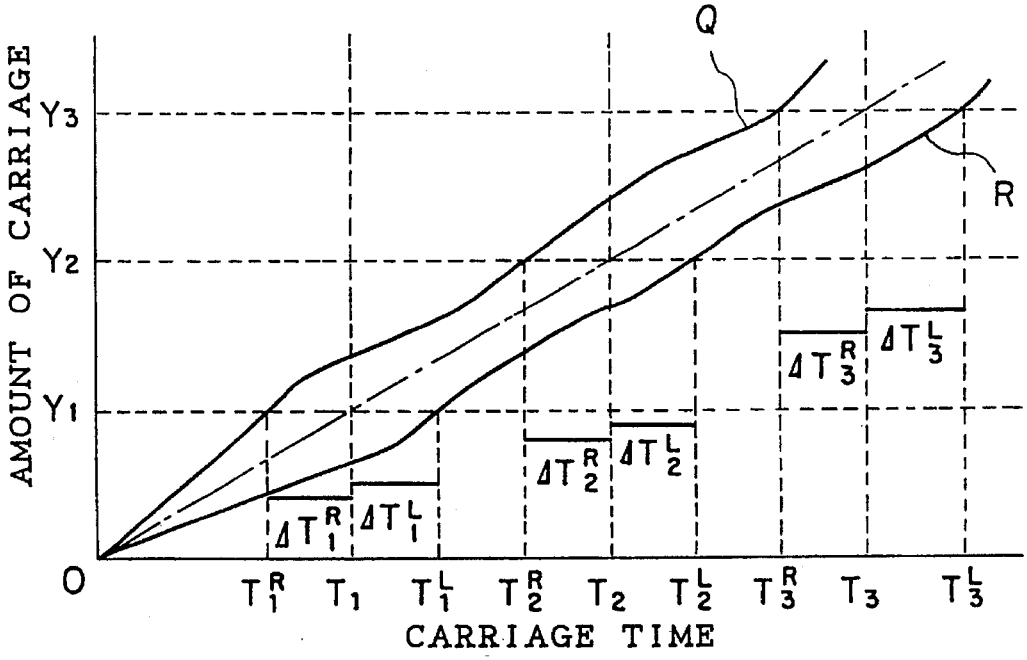
FIG. 33 is a graph showing a relationship between a carriage time and an amount of carriage in the seventeenth embodiment.

A description will now be given of a method of calculating the skew angle and the carriage error. FIG. 33 is a graph showing a relationship between a carriage time and the amount of carriage of the sheet 30. The broken line shows an amount of carriage when the sheet is carried at the predetermined reference carrying speed $V_1$. Therefore, an inclination of the broken line is equivalent to the reference carrying speed $V_1$. The thick line Q and the narrow line R show illustrative amounts of carriage of the sheet which is carried with skew. The thick line Q and the narrow line R correspond to amounts of carriage at positions in contact with the carriage detecting rollers 100*a* and 100*b*, and are respectively the amount of right carriage and the amount of left carriage with respect to the carrying direction. In the drawing, Y1, Y2, and Y3 on the ordinate axis show an amount of carriage corresponding to each regular rotation angle of the carriage detecting roller 100, and are disposed at constant intervals. Further, T1, T2, and T3 show a reference carriage time, that is, the carriage time when the sheet is carried at the predetermined reference carrying speed $V_1$. Since the carriage detecting roller 100 rotates while following the sheet, an outer periphery of the carriage detecting roller 100 has substantially the same amount of rotation as the amount of carriage of the sheet. This is because of the fact as will be discussed. That is, since no resistance is provided against the rotation of the carriage detecting roller 100, no shearing force is applied to a contact surface between the sheet 30 and the carriage detecting roller 100. Therefore, no slip is caused between the sheet 30 and the carriage detecting roller 100. Hence, $T^R_1$, $T^R_2$, and $T^R_3$, and $T^L_1$, $T^L_2$, and $T^L_3$ respectively show time points when the amount of rotation of the carriage detecting rollers 100*a* and 100*b* reach Y1, Y2, and Y3, and are time points when the detection signals are outputted from the photosensors 102*a* and 102*b*.

Referring now to FIG. 33, when the amount of carriage reaches Y1, Y2, or Y3, actual carriage times of the sheet 30 are deviated from the reference carriage times by $\Delta T^L_1$, $\Delta T^L_2$, $\Delta T^L_3$, $\Delta T^R_1$, $\Delta T^R_2$, and $\Delta T^R_3$. The carriage error can be found by multiplying the deviation of the carriage time by the reference carrying speed $V_1$. Further, the skew angle $\theta_c$ of the sheet can be found according to the expression (5) on the basis of a value detected by the carriage detecting roller 100*b* on the left side with respect to the sheet carrying direction. In this case, in the carriage time, a clock pulse of the reference clock 104 is used as unit.

$$\theta_{CN}=\mathrm{Tan}^{-1}(\{(\Delta T^L_N-\Delta T^R_N)\cdot V1\}/Wd) \quad (5)$$

where N=1, 2, or 3, and Wd is a distance between the carriage detecting rollers 100*a* and 100*b* in the horizontal scanning direction. In the expression (5), the skew angle is calculated depending upon the inclination of the carriage error with respect to the horizontal scanning direction. However, the skew angle is obviously equivalent to the inclination of the amount of carriage. Further, in the expression (5), the skew angle becomes positive when the sheet is rotated to the left with respect to a reference carrying direction.

Figure 34:
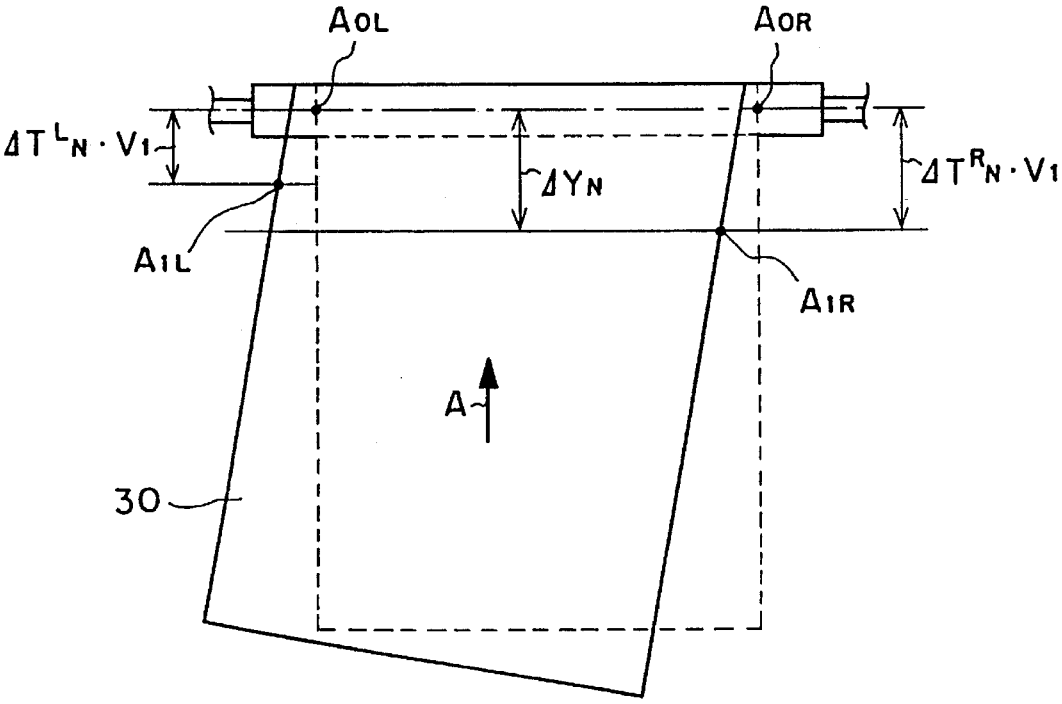
FIG. 34 is an explanatory view of a principle of detection of a deviation of an amount of carriage in the seventeenth embodiment.

FIG. 34 is an explanatory view of a principle of detection of a deviation of the amount of carriage in the embodiment. In the drawing, reference marks $A_{OR}$ and $A_{OL}$ show sheet edge positions when no skew and no carriage error are caused in the sheet. On the other hand, reference marks $A_{1R}$ and $A_{1L}$ show sheet edge positions when the skew and the carriage error $\Delta Y_N$ are caused. As is apparent from the drawing, the skew angle $\theta_{CN}$ can be expressed by the expression (5).

The carriage error $\Delta Y$ from the amount of reference carriage can be found according to the expression (6):

$$\Delta Y_N=-1\cdot\{(\Delta T^L_N+T^R_N)+|\Delta T^L_N-\Delta T^R_N|\}/2\cdot V1 \quad (6)$$

where N=1, 2, or 3

Here, the correction is made depending upon the skew angle $\theta_c$ and the carriage error $\Delta Y$ found in the expressions (5) and (6). In the expressions (5) and (6), though only first to third detections are expressed, in actuality, the detection is executed a plurality of times until print is finished.

A description will now be given of a method of correction. The skew angle $\theta_c$ can be corrected by controlling carriage load applied from the load roller 31. and the carriage error $\Delta Y$ can be corrected by control of the rotational speed of the drive motor 11 to drive the sheet carrying roller 1. The correcting operations are concurrently performed while the carriage detecting rollers 100*a* and 100*b* are rotated by the predetermined regular rotation angle. The respective correcting operations will be described specifically.

The skew angle $\theta_c$ is corrected by applying the carriage load from the load roller 31*a* or 31*b* to the side on which the amount of carriage in a sheet width direction is increased due to the skew so as to rotate the sheet 30 in a direction opposed to the skew angle $\theta_c$. The carriage load is transmitted from a torque limiter 33*a* or 33*b* by setting, in a coupling state, an electromagnetic clutch 32*a* or 32*b* on the side to which the load is applied. The electromagnetic clutch 32 to be coupled is determined depending upon the sign of the skew angle $\theta_c$ calculated according to the expression (5). For example, when the skew angle $\theta_c$ is positive, the electromagnetic clutch 32 on the right side with respect to the sheet carrying direction is coupled. The coupling of the electromagnetic clutch 32 is kept for the coupling time tn read from the correction table 103 according to the magnitude of the skew angle $\theta_c$, and is thereafter released. The coupling time tn is determined by the magnitude of the carriage load determined by the torque limiter 33.

The carriage error $\Delta Y$ can be corrected by changing the rotational speed $V_m$ of the drive motor 11 to drive the sheet carrying roller 1 according to the expression (7). In this case, the rotational speed $V_m$ can be changed by modulating the number of drive pulse $\omega_p$ of the drive motor 11.

$$V_m = V_{m1} \cdot (1 - \Delta Y / Td) \tag{7}$$

where $V_{m1}$ is the predetermined reference rotational speed, and Td is a time required for rotation of the carriage detecting roller 100 by a regular rotation angle at the reference carrying speed $V_1$. According to the expression (7), for example, when the carriage error $\Delta Y$ is positive, that is, when the amount of carriage exceeds a predetermined amount, the rotational speed $V_m$ of the drive motor 11 is decelerated.

Figure 35:
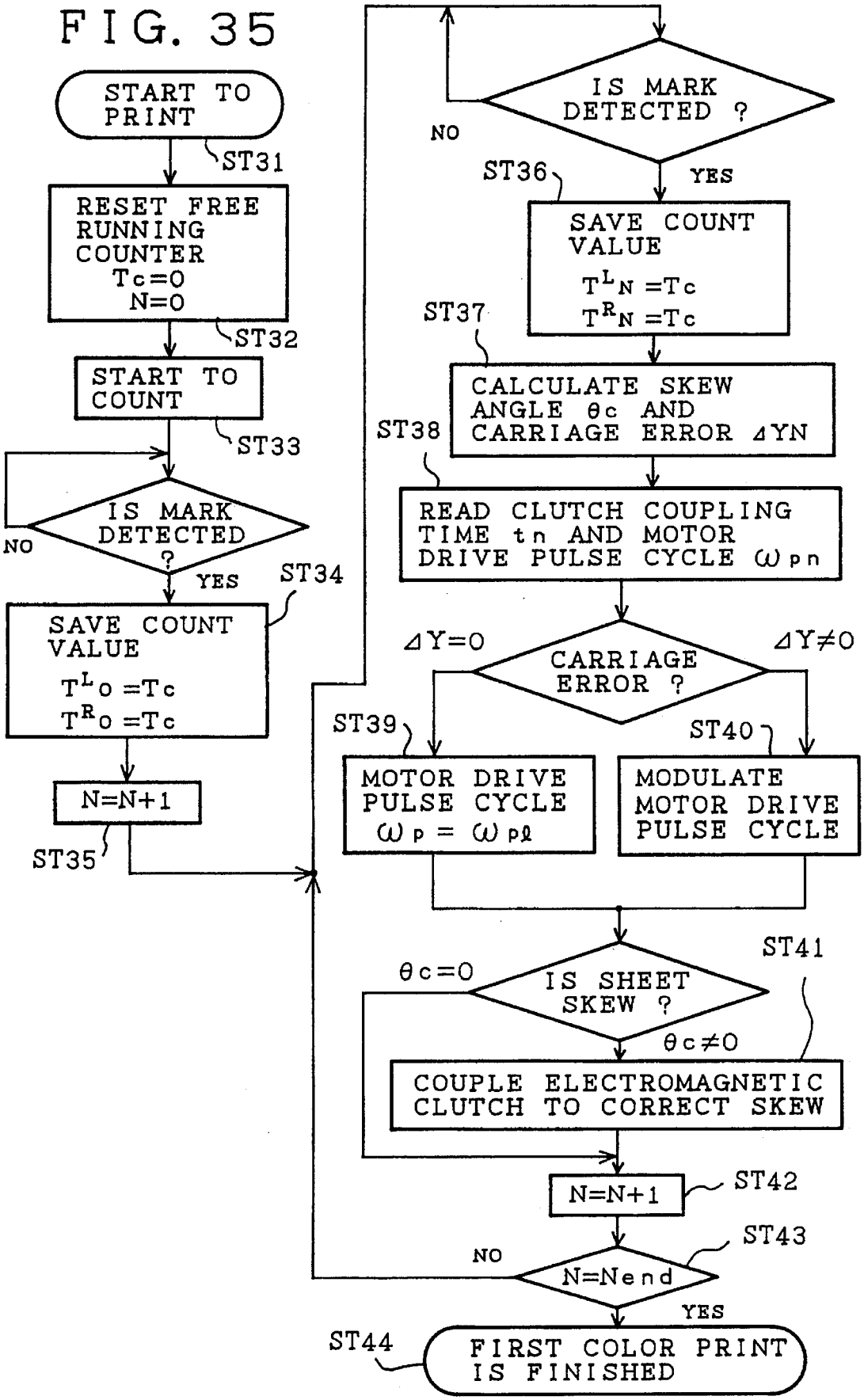
FIG. 35 is a flowchart showing the steps of processing in the seventeenth embodiment.

FIG. 35 is a flowchart showing the steps of processing in the correcting operation, in which N in $\theta C_N$ and $\Delta Y_N$ shows the number of times of detection.

Print is started in Step ST31. In Step ST32, the CPU 38 sets the count value Tc of the free running counter 105 and the mark detection count value N of the disk 101 to zero. When the mark of the first disk with respect to the carrying direction is detected, the CPU 38 causes the free running counter 105 to start to count the reference clock (Step ST33). The CPU 38 stores the respective count values Tc at times of detection of the marks of the disks 101*a* and 101*b* in the memory 107 as $T^L_0$ and $T^R_0$ (Step ST34). Further, the CPU 38 updates the mark detection count N (Step ST35). Thereafter, when the marks of the first and second disks 101*a* and 101*b* are respectively detected, the CPU 38 stores the respective count values Tc in the memory as $T^L_N$ and $T^R_N$ (Step ST36).

Further, when both the marks of the first and second disks 101*a* and 101*b* are detected, the CPU 38 calculates the skew angle $\theta_{CN}$ and the carriage error $\Delta Y_N$ (Step ST37). Subsequently, the CPU 38 reads a clutch coupling time tn and a frequency of motor drive pulse $\omega_{pn}$ from the correction table according to the skew angle $\theta_{CN}$ and the carriage error $\Delta Y_N$ (Step ST38). When the carriage error $\Delta Y_N$ is zero, the CPU 38 controls such that the drive motor 11 can be driven at the predetermined frequency of reference motor drive pulse $\omega_{p1}$ (Step ST39). When the carriage error $\Delta Y_N$ is not zero, the CPU 38 controls such that the drive motor 11 can be driven at the frequency of motor drive pulse $\omega_{pn}$ read from the correction table (Step ST40). The frequency of motor drive pulse as set herein is continuously used until both the marks of the first and second disks 101*a* and 101*b* are detected.

When the skew angle $\theta_{CN}$ is zero, the CPU 38 does not couple the electromagnetic clutch. Otherwise, when the skew angle $\theta_{CN}$ is not zero, the CPU 38 selects the electromagnetic clutch 32 according to a direction of the skew so as to set the electromagnetic clutch 32 in the coupling state for the clutch coupling time tn read from the correction table (Step ST41). After the elapse of the time tn, the CPU 38 releases the electromagnetic clutch.

The CPU 38 updates the number of times of mark detection N (Step ST42). When the number of times of mark detection N becomes a predetermined mark count $N_{end}$, the CPU 38 terminates processing for the detection and the correction (Step ST43). Then, the print is ended (Step ST44).

In Step ST37, the skew angle $\theta_c$ and the carriage error $\Delta Y$ can be calculated according to the expression (8) derived depending upon the expressions (5) and (6):

$$\begin{aligned} \theta_{CN} &= \{[(T_N^L - T_O^L - T_N) - (T_N^R - T_O^R - T_N)] \cdot V_O\}/Wd \\ &= \{[(T_N^L - T_O^L) - (T_N^R - T_O^R)] \cdot V_O\}/Wd \end{aligned} \tag{8}$$

$$\Delta Y_N = (-1) \cdot [\{(T_N^L - T_O^L) + (T_N^R - T_O^R) + \{(T_N^L - T_O^L) - (T_N^R - T_O^R)\}\}/2 - T_N] \cdot V_O$$

where N=1, 2, 3, . . . $n_{end}-1$, and $T_N$ is the reference carriage time.

In the embodiment, the skew is not corrected when the skew angle $\theta_c$ and the carriage error $\Delta Y$ are respectively zero. However, it must be noted that the correction may be prohibited when the skew angle $\theta_c$ and the carriage error $\Delta Y$ are respectively equal to or less than a predetermined permissible skew angle $\theta_0$, and a permissible carriage error $\Delta Y_0$. In the above algorithm, when the Nth mark is detected, the calculated skew angle is corrected before the (N+1)th mark is detected. Hence, it is impossible to correct a skew angle generated for a period from a time of detection of the Nth mark to a time of detection of the (N+1)th mark. Therefore, it is necessary to set mark intervals and a torque value of the torque limiter 33 such that the magnitude of the skew angle calculated at the time of detection of the Nth mark becomes equal to or less than a desired target value.

In the above structure, it is possible to concurrently correct the skew of the sheet 30 and correct the carriage error during carriage. Further, an expensive fine resolution encoder is not required to detect the amount of carriage, resulting in an inexpensive structure of the apparatus. Though, in the embodiment, the skew is corrected according to the same method as that in the fifth embodiment, it is to be noted that the present invention should not be limited to this. The same effect can be obtained by the structures described in the sixth to fourteenth embodiments.

Though, in the embodiment, the carriage detecting roller 100 is interposed between the sheet carrying roller 1 and the load roller 31, it is to be noted that the present invention should not be limited to this. The carriage detecting roller 100 may be disposed in the upstream of the load roller 31, resulting in the same effect. Further, the carriage detecting roller 100 may be opposed to the load roller 31 through the sheet 30, resulting in the same effect and a more simplified structure.

Embodiment 18

Figure 36:
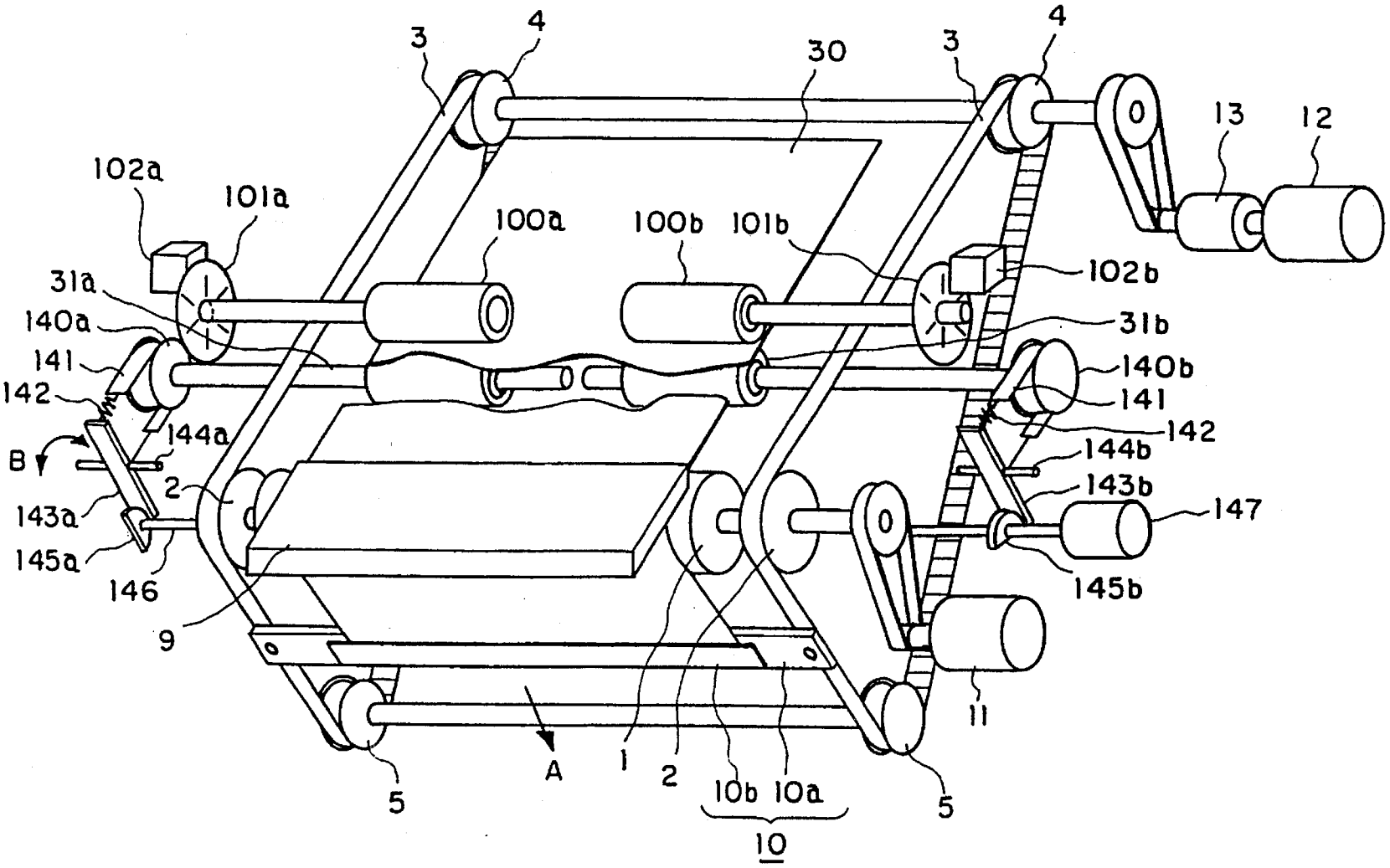
FIG. 36 is a perspective view showing an essential structure in the eighteenth embodiment of the sheet carrying apparatus of the present invention.

FIG. 36 is a perspective view showing an essential structure in the eighteenth embodiment of the sheet carrying apparatus of the present invention. In FIG. 36, the same reference numerals are used for component parts identical with or equivalent to those shown in FIGS. 49 and 50. In FIG. 36, an ink sheet 6 and an ink sheet carrying portion are omitted. In the embodiment, carriage detecting means are equivalent to those in the seventeenth embodiment, and carriage load applying means are equivalent to those in the seventh embodiment. However, the embodiment is different from the above embodiments in positional relationships of the component parts, and descriptions thereof will be given. The same reference numerals are used for component parts identical with or equivalent to those shown in FIGS. 12 and 31, and detailed descriptions thereof are omitted.

As shown in FIG. 36, the carriage detecting rollers 100*a* and 100*b* forming the carriage detecting means are disposed, in the upstream of the sheet carrying roller 1, on the right and left sides with respect to a sheet center line in a sheet carrying direction so as to extend in a horizontal scanning direction. Load rollers 31*a* and 31*b* serving as load applying members forming the carriage load applying means are disposed at positions opposed to the carriage detecting rollers 100*a* and 100*b* through the sheet 30. The respective rollers are independently rotatably supported by an unillustrated mechanism. The carriage detecting rollers 100*a* and 100*b*, and the load rollers 31*a* and 31*b* are disposed such that right and left roller rotating shafts are disposed in alignment with each other, and directions of the respective rotating shafts are perpendicular to the carrying direction. In such a structure, during sheet carriage, the carriage detecting rollers 100*a* and 100*b* are brought into pressure contact with load rollers 140*a* and 140*b* with a predetermined pressure contacting force through the sheet 30. The carriage detecting rollers 100*a* and 100*b* have substantially the same diameter, and include, for example, rubber rollers, or metallic rollers. The load rollers 140*a* and 140*b* have substantially the same diameter, and include, for example, rubber rollers, or metallic rollers having fine irregularity of their surfaces.

In the above structure, an amount of sheet carriage is detected according to the method described in the seventeenth embodiment. Depending upon the result of detection, a skew angle $\theta_c$ of the sheet is corrected according to the method described in the seventh embodiment, and the carriage error $\Delta Y$ is corrected according to the method described in the seventeenth embodiment.

Figure 37:
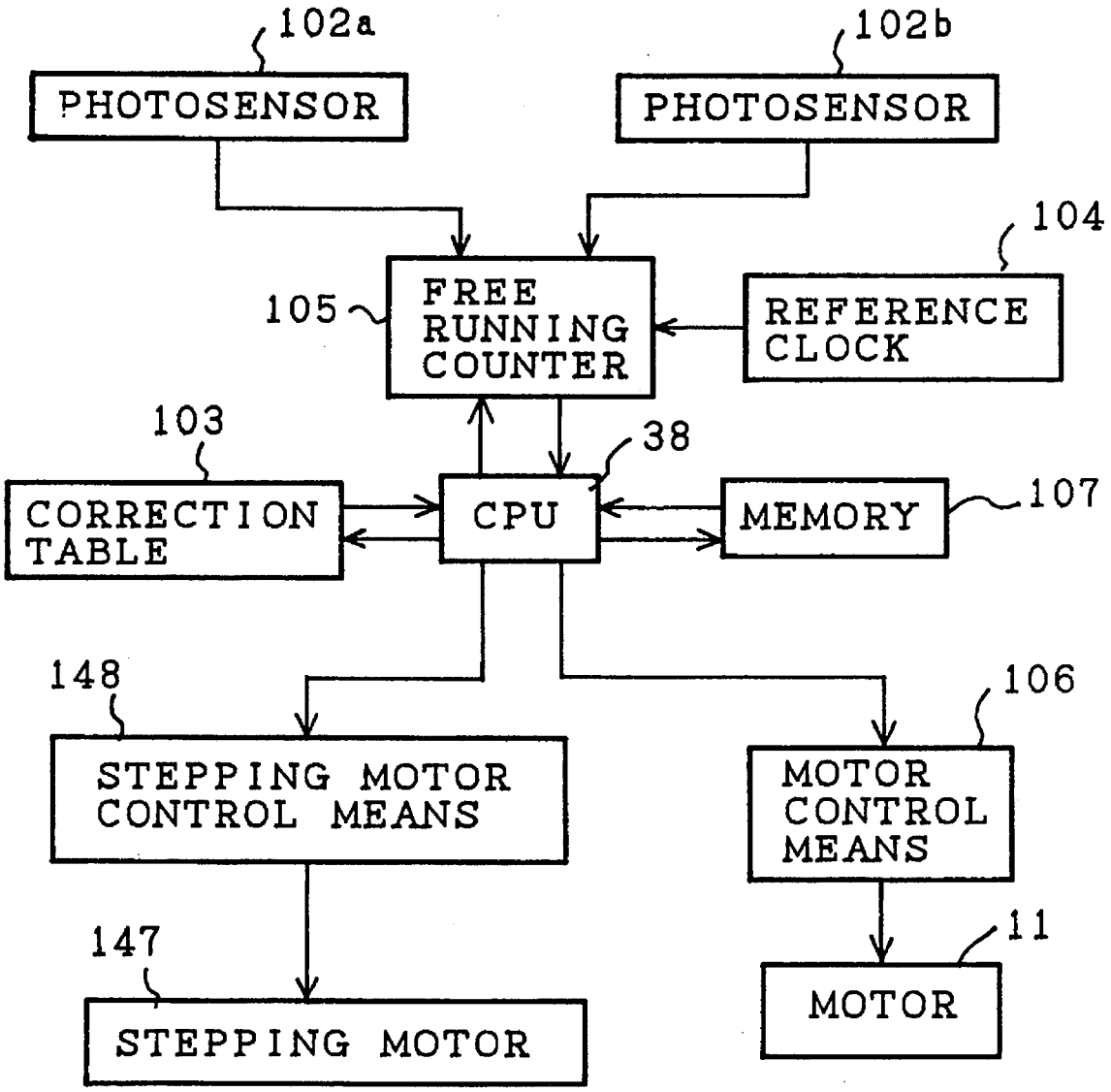
FIG. 37 is a block diagram showing a control system in the eighteenth embodiment.

Fig..37 is a block diagram showing a control system in the embodiment. In FIG. 37, the same reference numerals are used for blocks identical with or equivalent to those shown in FIGS. 14 and 32.

When the correction is made, the CPU 38 reads data required for the correction from a correction table depending upon. the calculated skew angle $\theta_c$ and the carriage error $\Delta Y$. The correction table 103 contains rotation angle data of a stepping motor 147, and data associated with a time tn for which a braking force is applied to the load roller and with the number of drive pulse $\omega_{pn}$ for a drive motor 11. The CPU 38 outputs a drive signal to stepping motor control means 148 and motor control means 106 depending upon the read data. The stepping motor control means 148 controls the stepping motor 147 depending upon the drive signal inputted from the CPU 38 so as to apply carriage load to the sheet. The motor control means 106 controls a rotational speed of the drive motor 11 depending upon the number of drive pulse $\omega_{pn}$ inputted from the CPU 38.

According to the embodiment, it is possible to reduce the number of parts such as rollers forming the carriage detecting means and the carriage load applying means, and simplify the apparatus.

Though the load roller in the seventh embodiment is used as the load applying member in the embodiment, it must be noted that the present invention should not be limited to this, and may include another member as long as the member can apply the carriage load to the sheet. For example, it is also possible to use the load roller described in the fifth embodiment or the sixth embodiment, or the electrode plate described in the tenth embodiment, and perform the correction according to the structure and the method described in the respective embodiments, resulting in the same effect. As the load applying member, there may be employed the friction plate in the ninth embodiment, which can be brought into pressure contact/disengaged. In this case, a metallic roller is used as the detecting roller for the purpose of avoiding a variation in a rotation diameter of the detecting roller due to a variation in a pressure contacting force of the load applying member. As the load applying member, there may be employed the inductor in the eleventh embodiment. In this case, a frictional material such as felt is applied to the inductor at a portion in contact with the sheet. The metallic roller having magnetism is used as the detecting roller for the purpose of generating the pressure contacting force between the inductor and the detecting roller by a magnetic field generated by the inductor, and avoiding the variation in the rotation diameter of the detecting roller due to a variation in the pressure contacting force.

In the embodiment, the carriage detecting rollers are in contact with the sheet on the print side, and the load rollers are in contact with a back surface of the sheet. However, it is to be noted that the aspect of contact of the respective rollers should not be limited to this. The load rollers may be in contact with the sheet on the print side, and the carriage detecting rollers may be in contact with the back surface of the sheet. In this case, as configured as shown in FIG. 36, there is no adhesion of the load roller to a rubber print surface, which is easily caused when the braking force is applied to the load roller. As a result, it is possible to obtain a good output image.

Embodiment 19

Figure 38:
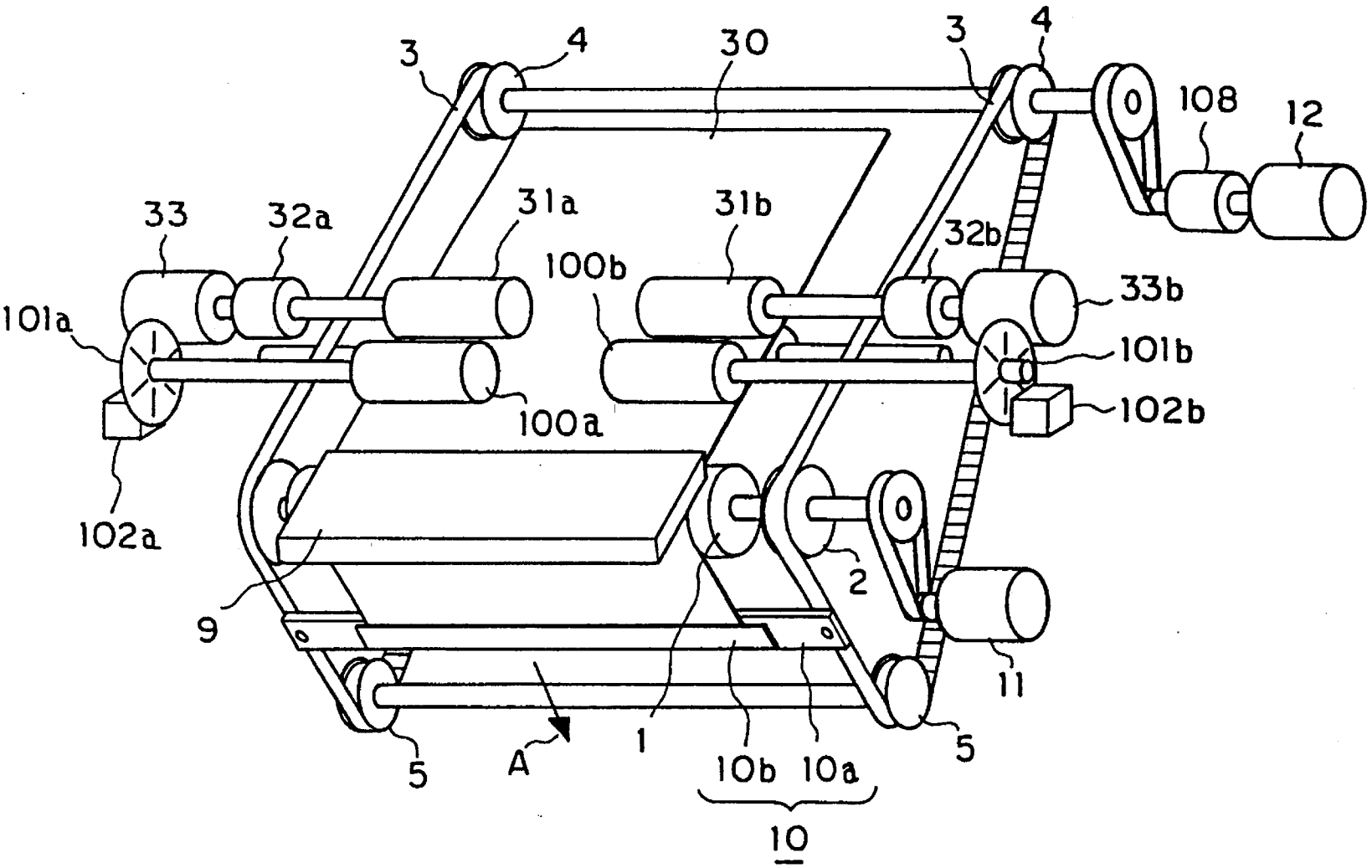
FIG. 38 is a perspective view showing an essential structure in the nineteenth embodiment of the sheet carrying apparatus of the present invention.

FIG. 38 is a perspective view showing an essential structure in the nineteenth embodiment of the sheet carrying apparatus of the present invention. In the seventeenth embodiment, the carriage error is corrected by control of the rotational speed of the drive motor 11 coupled with the sheet carrying roller 1. In the embodiment, the carriage error is corrected by controlling a carrying force applied. to a sheet 30. Further, in the sheet control apparatus, the carrying force applied to the sheet 30 is controlled by control of tensile strength applied from a clamper 10 to the sheet 30 and by control of carriage load applied from load rollers 31 as described in the sixteenth embodiment. In FIG. 38, the same reference numerals are used for component parts identical with those shown in FIG. 31.

As shown in FIG. 38, timing belts 3 between which the clamper 10 is interposed are circularly driven by a drive motor 12. Further, transmitting torque of an electromagnetic clutch 108 coupled with the drive motor 12 is variable. The electromagnetic clutch 108 is set such that torque T1 can be transmitted when no correction is made, and the transmitting torque is changed into T2 depending upon an inputted signal when the correction is made. In this case, values of the torque meet a relationship of $T1<T2$.

First, a description will now be given of a principle of correction of the carriage error. When the carriage load is applied uniformly in a horizontal scanning direction, the amount of carriage of the sheet 30 is uniformly decreased in the horizontal scanning direction with respect to an amount of reference carriage. When the carrying force is similarly applied in a carrying direction, the amount of carriage is uniformly increased in the horizontal scanning direction with respect to the amount of reference carriage. This is because a slight amount of slip at a contact portion between the sheet carrying roller 1 and the sheet 30 is varied according to the applied carrying force. In the embodiment, the carrying force is controlled by using such a characteristic so as to correct skew of the sheet and the carriage error.

Next, a description will now be given of a correcting operation. Initially, depending upon a skew angle $\theta_{CN}$ calculated in a CPU 38, the skew is corrected by the load rollers 31 according to the same method as that in the sixteenth embodiment. Subsequently, the carriage error is corrected depending upon $\Delta Y_N$. Specifically, when $\Delta Y_N$ is positive, that is, when the actual amount of sheet carriage exceeds the amount of reference carriage, right and left electromagnetic clutches 32*a* and 32*b* are set in a coupling state, and both the load rollers 31 uniformly apply the carriage load to the sheet. As a result, the amount of slip at the contact portion between the sheet 30 and the sheet carrying roller 1 is increased so as to decrease the amount of carriage. Consequently, the carriage error is corrected. Otherwise, when $\Delta Y_N$ is negative, that is, when an actual amount of sheet carriage is less than the amount of reference carriage, the transmitting torque of the electromagnetic clutch 108 is increased from T1 to T2. Thus, the carrying force applied to the sheet 30 in the carrying direction is increased. As a result, the amount of slip at the contact portion between the sheet 30 and the sheet carrying roller 1 is varied so as to increase the amount of carriage, and the carriage error can be corrected.

A coupling time of both the right and left electromagnetic clutches 32*a* and 32*b*, and a transmitting torque increasing time in the electromagnetic clutch 108 are determined depending upon $\Delta Y_N$.

The torque value of the torque limiter 33 coupled with the load roller 31 and the transmitting torque value T2 of the electromagnetic clutch 108 are set such that the corrections for $\theta_{CN}$ and $\Delta Y_N$ are completed before the next values are calculated.

Embodiment 20

In the nineteenth embodiment, the carriage error detected according to the method as described in the seventeenth embodiment. However, it must be noted that the carriage error may be detected for each rotation of carriage detecting rollers 100. In the nineteenth embodiment, in order to detect and correct a slight amount of carriage error, ununiformity in mark intervals on a disk 101, or a deviation of diameter of the carriage detecting roller 100 may cause a detection error. Since the detection error is generated for each rotation of the carriage detecting roller 100, it is possible to reduce the carriage error by detecting the carriage error for each rotation.

Specifically, when, for example, ten marks are written on the disk 101, in Step ST36 of the flowchart in FIG. 35, the detection may be made for each time the number of times of mark detection N becomes integral multiples of ten.

It is to be noted that the detection interval of the carriage error should not be limited to each rotation of the carriage detecting roller 100, and may be for each n rotation (n is a natural number).

Embodiment 21

Figure 39:
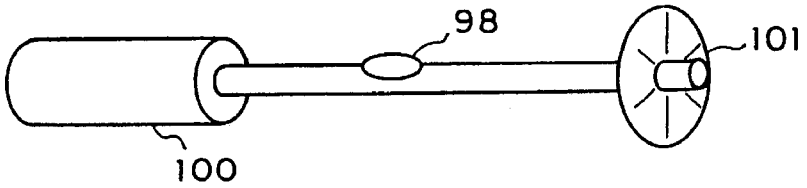
FIG. 39 is a perspective view showing a registration mechanism in the nineteenth embodiment.

FIG. 39 is a perspective view showing a carriage detecting roller 100 in the twenty-first embodiment of the present invention. A sheet carrying apparatus in the embodiment is provided with the structure in the nineteenth embodiment or the twentieth embodiment, in which origin registration is made for a rotation position of each carriage detecting roller 100 each time one sheet 30 is carried. As shown in FIG. 39, the carriage detecting roller 100 is coupled with a disk 101 through a shaft, and a weight 98 is mounted to a partial periphery of the shaft. The weight 98 implements a registration mechanism to perform the origin registration of a rotation angle of the carriage detecting roller 100.

A description will now be given of the operation. Before carriage of the sheet 30, the carriage detecting rollers 100 are in a state to be apart from a predetermined position during carriage. At the time, the weight 98 can apply moment to rotate each carriage detecting roller 100. Since each carriage detecting roller 100 is rotatably supported, each carriage detecting roller 100 can be rotated to reach a position at which the weight 98 is downward directed. When print is started in this state, each carriage detecting roller 100 is brought into contact with the sheet with the weight 98 directed downward. Therefore, a photosensor can start detection continuously from the same mark. In such a way, without detecting for each rotation of the roller, it is possible to reduce the detection error of the amount of carriage caused due to the deviation of the carriage detecting roller 100 or the ununiformity in the mark intervals.

In this case, it is to be noted that an adjusting mechanism for the origin registration should not be limited to the mechanism using the weight 98. For example, for the origin registration, a magnetic member may be mounted to a partial periphery of each disk 101, and, when each carriage detecting roller 100 is in a separated state before carriage, the magnetic member may be attracted by a magnet secured to a side plate and so forth.

Embodiment 22

In the seventeenth to twenty-first embodiments, in case the sheet 30 is carried a plurality of times on the same carrying path, in particular, like a color printer, on the basis of first carriage, the correction may be made during second or later carriage. A description will now be given of the operation. No correction is made at a time of the first carriage of the sheet 30, and count values are stored in a memory when marks on the disks 101 of the carriage detecting rollers 100 are detected ($T^L_N$ and $T^R_N$ in FIG. 32). Thereafter, during second or later carriage, skew and a carriage error are calculated on the basis of the stored data to perform the correction.

As in the sixteenth embodiment, in the embodiment, it is possible to reduce a relative error in a carrying direction for each carriage, and reduce misregistration of color, in particular, in the color printer.

Embodiment 23

The embodiment relates to correction of translation (shift) of a sheet in a horizontal scanning direction, which is generated when skew is corrected according to the method described in the above embodiments. Here, a description will be given on the basis of the structure and the operation in the fifteenth embodiment.

Figure 40:
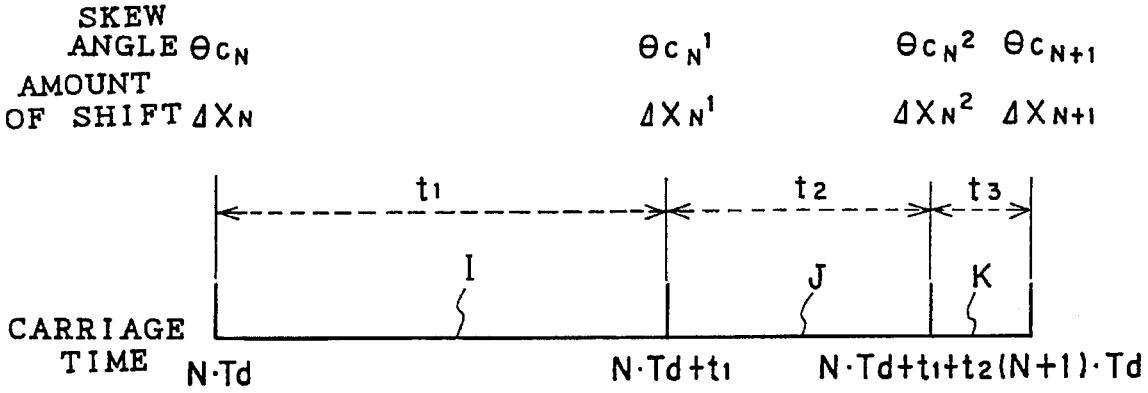
FIG. 40 is an explanatory view showing operations in the twenty-third embodiment of the sheet carrying apparatus of the present invention.

FIG. 40 is an explanatory view showing the operation in the embodiment. The transverse axis denotes a carriage time, specifically, denotes operation timing for an interval from one carriage time N·Td to another carriage time (N+1)·Td. In the embodiment, an interval Td is divided into, for example, three intervals I, J, and K. The respective intervals have periods $t_1$, $t_2$, and $t_3$. In the drawing, a skew angle and an amount of shift are shown as values at each end time of each interval, excluding skew and an amount of shift additionally caused in each interval.

In the interval I, among electromagnetic clutches 32*a* and 32*b*, the electromagnetic clutch 32 on the side to apply carriage load in a direction to correct a detected $\theta_{CN}$ is set in a coupling state. In the interval J, the coupling state is provided for the electromagnetic clutch 32 other than the electromagnetic clutch 32 set in the coupling state in the interval I. In the interval K, both the electromagnetic clutches 32*a* and 32*b* are released. It is possible to correct both the skew and shift by determining the respective periods $t_1$ and $t_2$ such that a skew angle $\theta_{CN+1}$ and an amount of shift $\Delta X_{N+1}$ can be minimized at the time (N+1)·Td. A description will now be given of an actual operation executed for each interval including the interval Td.

Figure 41:
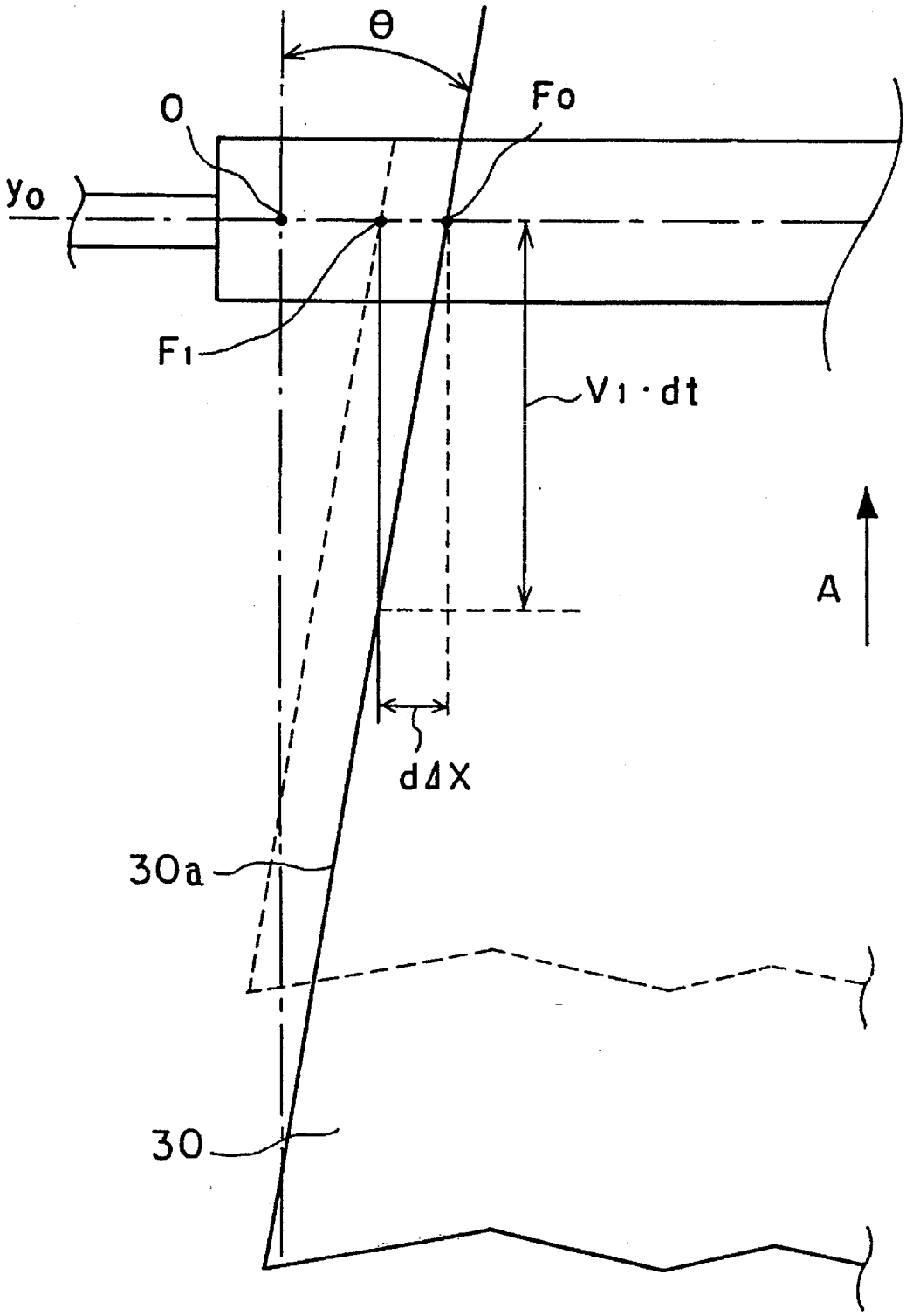
FIG. 41 is an explanatory view showing a relationship between a skew angle and an amount of shift in the twenty-third embodiment.

A method of calculating the periods $t_1$ and $t_2$ will be described. First, a description will be given of a relationship between the skew angle of the sheet and the amount of shift with reference to FIG. 41. FIG. 41 is a plan view showing the vicinity of an edge of a sheet 30 carried by a sheet carrying roller 1 in a skew state. In the drawing, the sheet 30 is carried in a direction of the arrow A. Further, the line $y_0$ means a print line on the sheet carrying roller 1. When the sheet 30 is initially carried in a state to be inclined by θ with respect to a carrying direction as shown by the solid line, the edge 30*a* reaches a position as shown by the broken line after the elapse of a time dt. At the time, an intersection of the line $y_0$ and the edge 30*a* of the sheet 30 is shifted from $F_0$ to $F_1$. Here, if a reference carrying speed of the sheet is defined as $V_1$, one relationship is established between the skew angle θ of the sheet after the elapse of the time dt and the amount of shift dΔX as shown by the expression (9):

$$d\Delta X/(V_1 \cdot dt) = \mathrm{Tan}^{-1}(\theta) \tag{9}$$

If θ is a sufficiently small value, the expression (10) can be obtained by modifying the expression (9):

$$\begin{aligned} d\Delta X &= \mathrm{Tan}^{-1}(\theta) \cdot V_1 \cdot dt \\ &\approx \theta \cdot V_1 \cdot dt \end{aligned} \tag{10}$$

When time integral is made for both the sides of the expression (10), it is possible to obtain the expression (11) showing the relationship between the skew angle of the sheet and the amount of shift.

$$\Delta X = \int(\theta \cdot V_1)dt \tag{11}$$

A description will now be given of the method of calculating the periods $t_1$ and $t_2$ with reference to the drawing. For the sake of simplicity, a sheet state at the carriage time N·Td is set as follows:

$$\theta_{CN} > 0, \text{ and } \Delta X_N > 0 \tag{12}$$

The expression (12) corresponds to a state in which the sheet 30 is skewed to the left with respect to a reference carrying direction. The amount of shift $\Delta X_N$ shows a distance from a reference position on the sheet carrying roller 1. According to the expression (12), the electromagnetic clutch 32*a* on the right side with respect to the carrying direction is set in the coupling state in the interval I so as to apply the carriage load to the sheet 30 on the right side. When, in this state, the sheet 30 is carried at substantially the same carrying speed as a reference carrying speed $V_1$ for the period $t_1$, values at the time N·Td+$t_1$ can be found as the expression (13):

$$\theta_{CN}^1 = \theta_{CN} - k\theta \cdot t_1$$

$$\Delta X^{N1} = \Delta X_N + \theta_{CN} \cdot t_1 \cdot V_1 - k\theta \cdot t_1^2 \cdot V/2 \tag{13}$$

where kθ is a known constant coefficient showing a rate of change in the skew angle to an applying time of the carriage load, that is, corresponding to the inclination of the line shown in FIG. 8. Subsequently, values at a time N·Td+$t_1$+$t_2$ at which the operation in the interval J is finished can be found by the expression (14):

$$\begin{aligned} \theta_{CN}^2 &= \theta_{CN}^1 - k\theta \cdot t_2 \\ &= \theta_{CN} + k\theta \cdot (-t_1 + t_2) \end{aligned} \tag{14}$$

$$\Delta X_N^2 = \Delta X_N + \theta_{CN} \cdot (t_1 + t_2) \cdot V_1 + k\theta \cdot (-t_1^2 + t_2^2) \cdot V_1/2 - k\theta \cdot t_1 t_2 \cdot V_1$$

Further, values at a time (N+1)·Td at which the operation in the interval K is finished can be found by the expression (15):

$$\begin{aligned} \theta_{CN+1} &= \theta_{CN}^2 \\ &= \theta_{CN} + k\theta \cdot (-t_1 + t_2) \end{aligned} \tag{15}$$

$$\Delta X_{N+1} = \Delta X_N + \{\theta_{CN} - (t_1 - t_2) \cdot k\theta\} \cdot Td \cdot V_1 + k\theta \cdot (t_1^2 - t_2^2) \cdot V_1/2 - k\theta \cdot t_1 \cdot t_2 \cdot V_1$$

where Td=$t_1$+$t_2$+$t_3$

According to the expression (15), $t_1$ and $t_2$ are calculated so as to minimize the magnitudes of $\theta_{CN+1}$ and $\Delta X_{N+1}$. If there is no solution to minimize both the magnitudes of $\theta_{CN+1}$ and $\Delta X_{N+1}$, $t_1$ and $t_2$ meeting a predetermined condition may be calculated. Though $\theta_{CN+1}$ is defined as a positive value, $\theta_{CN+1}$ may be a negative value. In this case, it is possible to calculate $t_1$ and $t_2$ according to the same method as set forth above by using kθ having the opposite sign in the expressions (13) and (14).

According to the method as described above, $t_1$ and $t_2$ are calculated depending upon the skew angle $\theta_{CN}$ and the amount of shift $\Delta X_N$ which are detected for each interval Td, and carriage load applying means or carrying force applying means is controlled depending upon the values as shown in FIG. 40. It is thereby possible to concurrently correct the skew and the shift during carriage. In this case, the amount of shift $\Delta X_N$ of the sheet can be calculated depending upon a value from a position detecting sensor 34.

Here, $t_1$ and $t_2$ are calculated so as to minimize the magnitudes of $\theta_{CN+1}$ and $\Delta X_{N+1}$. However, $t_1$ and $t_2$ may be calculated so as to minimize the magnitudes of $\theta_{CN}^2$ and $\Delta X^{N2}$, resulting in the same effect.

In the embodiment, the skew is successively detected and corrected in the interval Td by way of the fifteenth embodiment as one example. However, it is to be noted that the skew may be detected and corrected for each rotation of a carriage detecting roller by a predetermined regular rotation angle according to the method described in the seventeenth embodiment, resulting in the same effect. Even when the skew angle is detected and corrected in real time, the same calculation and operation as those described above may be performed at a time when the calculated skew angle exceeds a desired permissible skew angle, resulting in the same effect. In this case, it is necessary to set a correction time Tc corresponding to the above interval Td. The correction time Tc is previously set such that the magnitude of a skew angle generated for the correction time Tc becomes equal to a desired target value or less.

Embodiment 24

Figure 42:
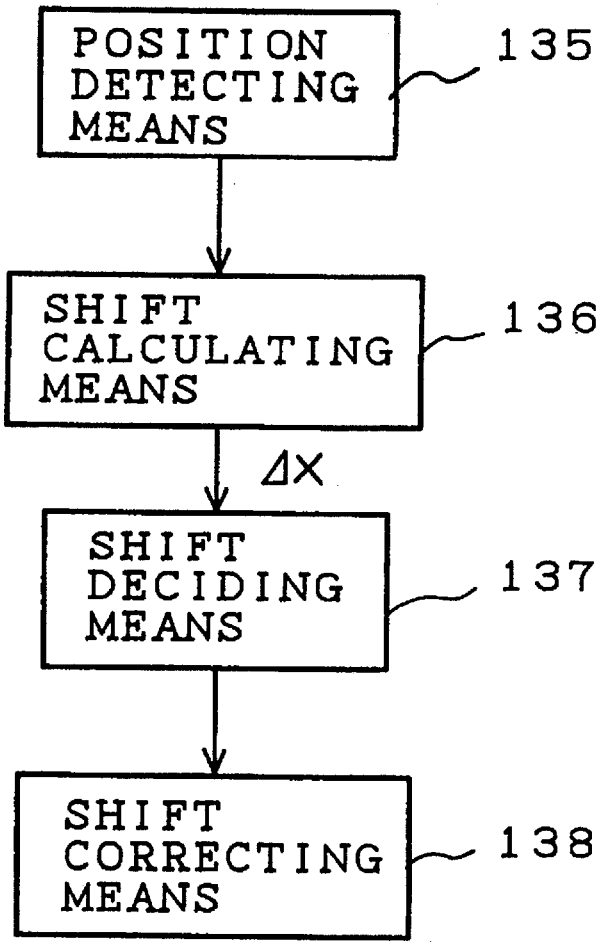
FIG. 42 is a block diagram showing a control system in the twenty-fourth embodiment of the sheet carrying apparatus of the present invention.

FIG. 42 is a block diagram showing a control system in the twenty-fourth embodiment of the sheet carrying apparatus of the present invention. Shift correcting means 138 shown in FIG. 42 controls a position of a print area of unillustrated printing means in a horizontal scanning direction.

A description will now be given of a correcting operation. Position detecting means 135 detects, on demand during carriage, a position in the horizontal scanning direction of a sheet carried by sheet carrying means. Further, shift calculating means 136 calculates an amount of shift ΔX of the sheet depending upon a deviation of position data of a sheet edge outputted from the position detecting means 135 from a predetermined reference position. Subsequently, shift deciding means 137 compares the calculated amount of shift ΔX with a predetermined amount of permissible shift $\Delta X_0$. If correction is required, the shift deciding means 137 outputs a drive signal depending upon ΔX such that the print area can be moved in the same direction as that in which the sheet is shifted. Further, the shift correcting means 138 is driven depending upon the drive signal inputted from the shift deciding means 137 so as to correct the shift of the sheet.

The above operation is repeated until carriage of the sheet is completed so as to correct the shift of the sheet generated during carriage without stopping the carriage.

Embodiment 25

Figure 43:
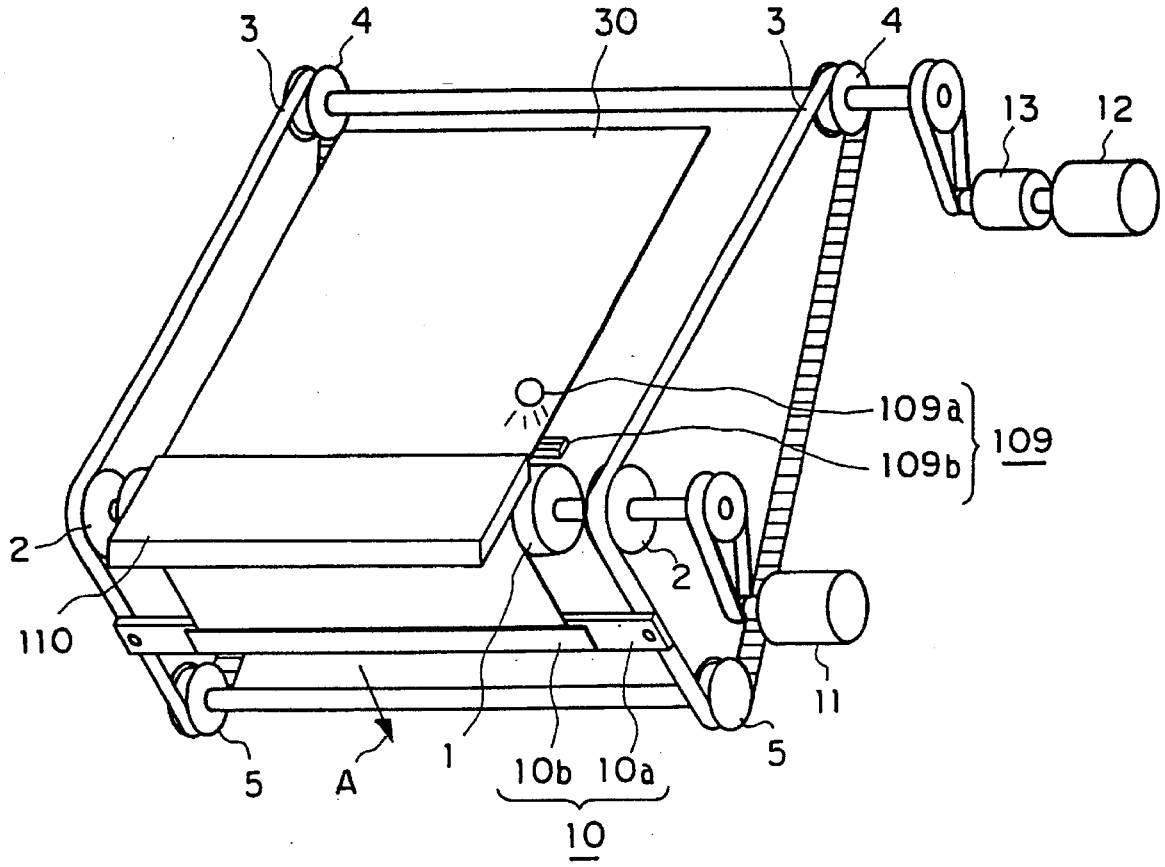
FIG. 43 is a perspective view showing an essential structure in the twenty-fifth embodiment of the sheet carrying apparatus of the present invention.

FIG. 43 is a perspective view showing an essential structure in the twenty-fifth embodiment of the sheet carrying apparatus of the present invention. In FIG. 43, the same reference numerals are used for component parts identical with those shown in FIGS. 49, and 50. In FIG. 43, an ink sheet 6 is omitted. As shown in FIG. 43, a distal end of a sheet 30 is clamped by a clamper 10, and the sheet 30 is circularly carried in a direction shown by the arrow A in the drawing by forward rotation of a sheet carrying roller 1. At the time, the clamper 10 circulates while applying predetermined tensile strength to the sheet 30. In the downstream of the vicinity of the sheet carrying roller 1, a position detecting sensor 109 is disposed at a position at which the edge of the sheet 30 can be detected. The position detecting sensor 109 includes a light source **109*a* and one line-type CCD sensor 109*b* so as to detect the position of the sheet edge in a horizontal scanning direction. Further, a thermal head 110 serves as means for correcting a print position according to an amount of shift of the sheet 30 in the horizontal scanning direction, and is brought into pressure contact with the sheet carrying roller 1 with a predetermined pressure contacting force by an unillustrated spring through the sheet 30 and the unillustrated ink sheet 6**.

Figure 44:
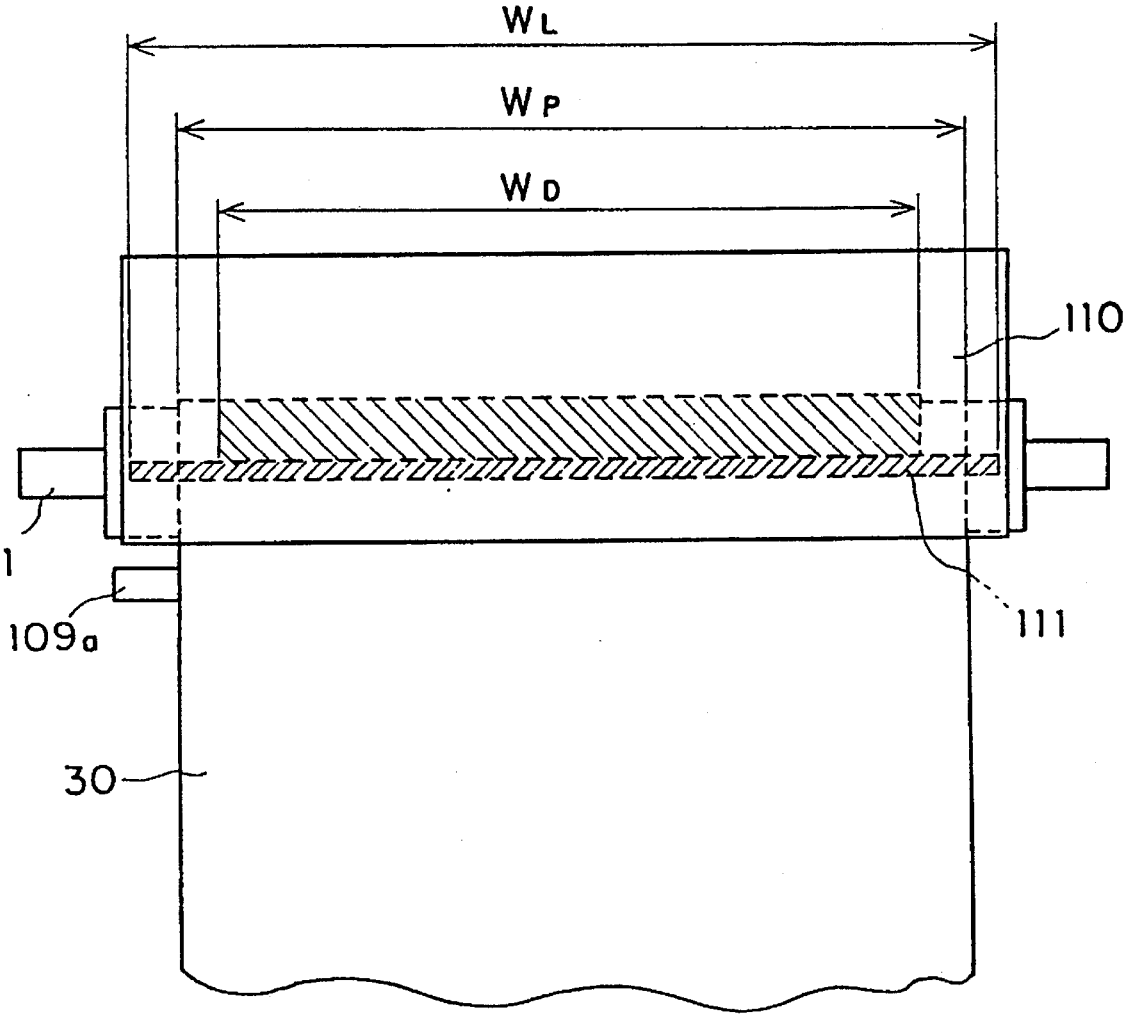
FIG. 44 is a plan view showing the vicinity of a print area portion in the twenty-fifth embodiment.

A detailed description will now be given of the thermal head 110 serving as shift correcting means with reference to FIG. 44. FIG. 44 is an explanatory plan view showing the vicinity of the thermal head of the sheet carrying apparatus. In the drawing, reference marks $W_L$, $W_P$, and $W_D$ mean a heating line width, a sheet width, and a print width of the thermal head 110. A heating line 111 of the thermal head 110 includes a plurality of heating resistive elements arrayed at constant intervals Dh in the horizontal scanning direction. The interval Dh between the heating resistive elements (hereinafter referred to as dot width) is determined according to desired resolution. Typically, the heating line width $W_L$ is set to be substantially equal to the predetermined print width $W_D$. However, in the embodiment, the heating line width $W_L$ of the thermal head 110 is set to be larger than the print width $W_D$. That is, there are formed heating resistive elements whose number is more than the number of heating resistive elements determined by the print width $W_D$ and the dot width Dh. Further, the heating line 111 is controlled so as to optionally select an area which is heated during print. Therefore, even when a shift in the horizontal scanning direction is caused at a position of the sheet 30 on the sheet carrying roller 1, the heating area of the heating line 111 may be varied according to the amount of shift of the sheet 30. It is thereby possible to avoid a deviation of the print position due to the shift.

Figure 45:
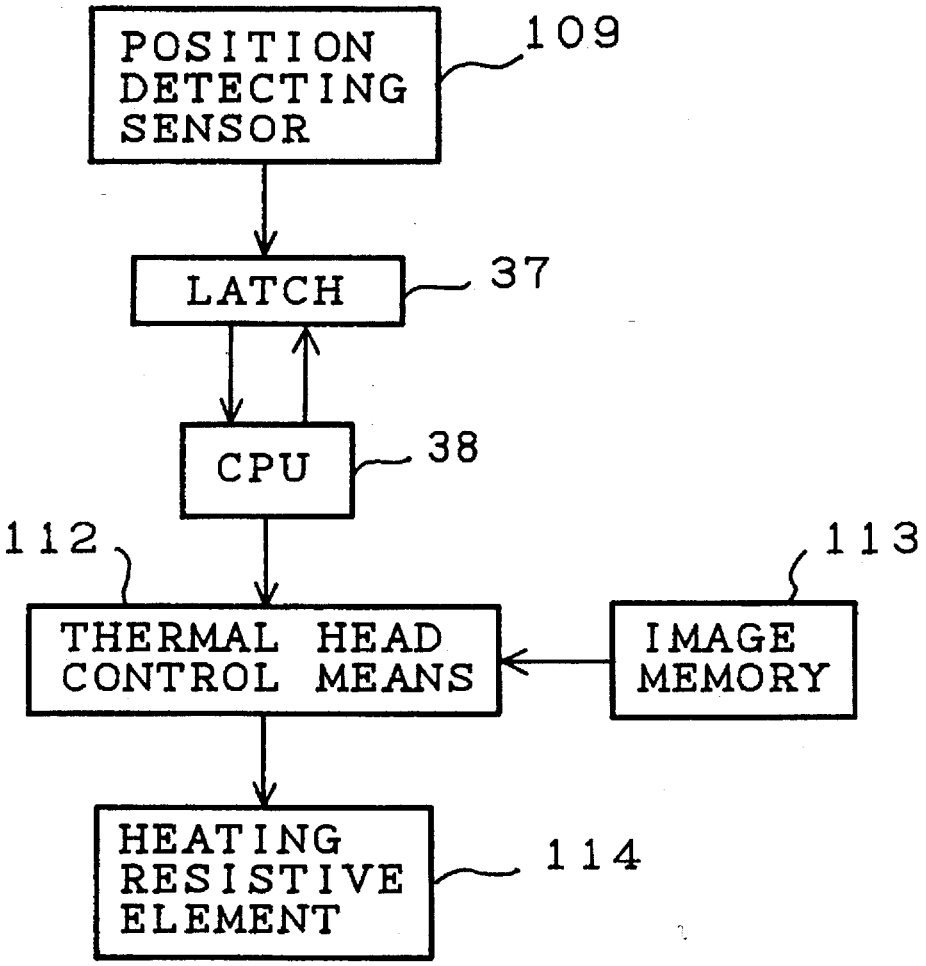
FIG. 45 is a block diagram showing a control system in the twenty-fifth embodiment.

A description will now be given of a control system in the embodiment with reference to a block diagram of FIG. 45. Output from the position detecting sensor 109 is outputted to a latch 37 on demand. In synchronization with a signal inputted from a CPU 38, the latch 37 outputs the output signal from the position detecting sensor 109 to the CPU 38. The CPU 38 compares the output signal from the position detecting sensor 109 with reference position data of a predetermined sheet edge so as to calculate an amount of shift ΔX of the sheet 30 in the horizontal scanning direction. When the calculated amount of shift ΔX becomes equal to or more than a length half one dot width Dh, the CPU 38 outputs shift data to thermal head control means 112. The thermal head control means 112 calculates a direction for shift and the number of dot for shift depending upon the inputted shift data. Further, the heating area on the thermal head is shifted by the calculated number of dot in a direction for correction. In subsequent process, depending upon image data from an image memory 113, the heating resistive elements 114 in the heating area after the shift are driven for a transferring operation.

Figure 46:
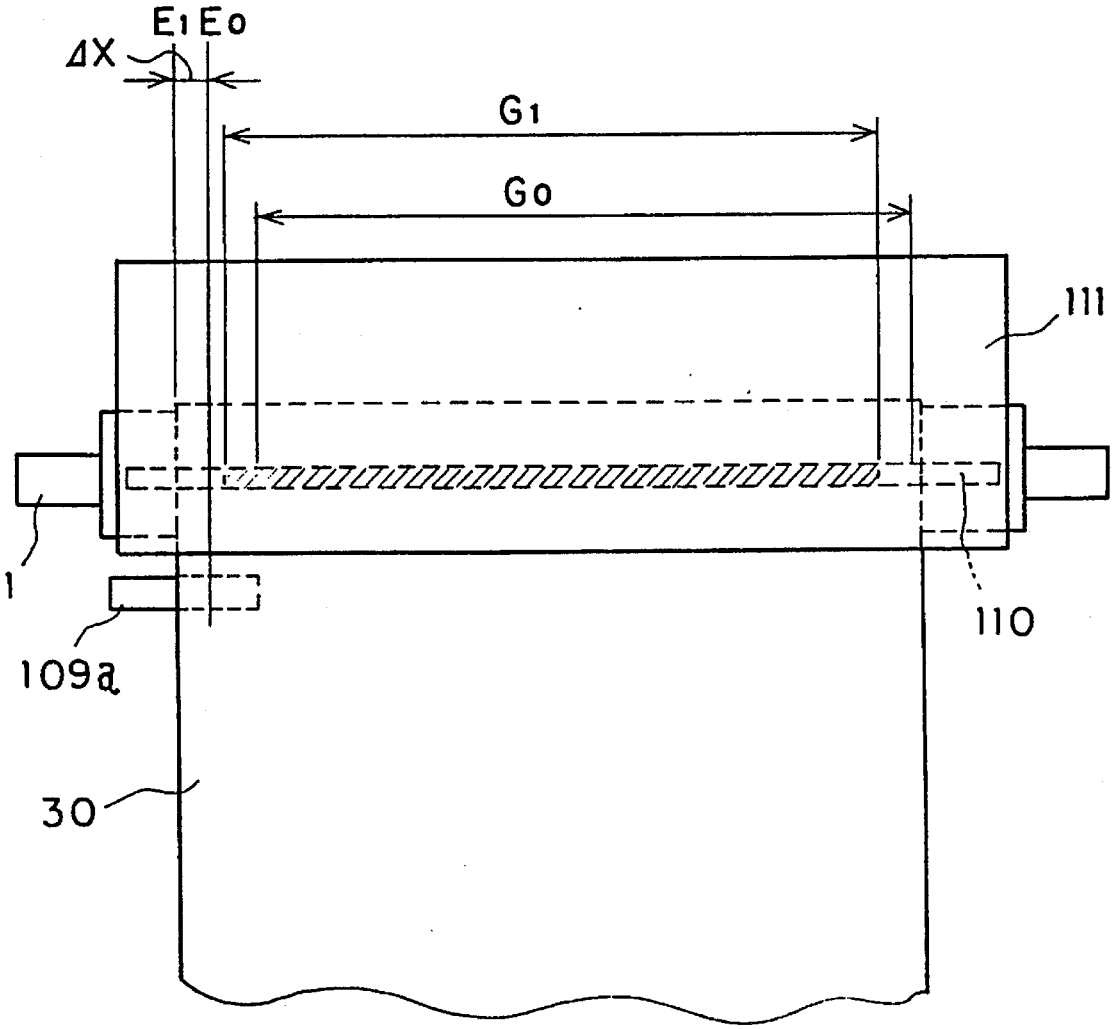
FIG. 46 is a plan view showing the vicinity of a print area portion in the twenty-fifth embodiment.

A description will now be given of a correcting operation in the embodiment using the structure with reference to FIG. 46. FIG. 46 is similar to FIG. 44, and shows a state in which the heating area is shifted according to the detected amount of shift. In the drawing, reference numeral $G_0$ means a reference heating area, and $G_1$ is a shaded heating area after the shift.

Initially, an edge position $E_1$ of the sheet 30 is detected immediately before print of each color. The amount of shift ΔX is calculated depending upon the detected edge position $E_1$ and a predetermined reference position $E_0$. When the amount of shift ΔX becomes equal to or more than the length half one dot width Dh, the heating area is shifted. Thus, the number of dot $N_c$ used for the shift can be calculated according to the expression (16):

$$N_c = f(|\Delta X|/Dh) \tag{16}$$

where a function f(x) serves to count fractions of 0.5 and over as a unit and cut away the rest. Further, the heating area is shifted from the reference position by the number of dot $N_c$. The heating area is shifted in the same direction as that in which the sheet 30 is shifted. In FIG. 46, the heating area is shifted from $G_0$ to $G_1$. After the completion of shift of the heating area, sheet carriage and print are started. During the print, while the sheet is carried, the position of the sheet is detected by the position detecting means on demand. When the amount of shift $X_c$ becomes a length of Dh/2 or more, the heating area is shifted according to the same method as described above.

In this case, as is apparent from the expression (16), the heating area is shifted by one dot. The above correcting operation is performed for each color until the print is completed. It is thereby possible to reduce the deviation of the print position in the horizontal scanning direction to Dh/2 or less on the right and left sides of the reference position. Therefore, when the print is made to superimpose two or more colors, it is possible to reduce misregistration of color in the horizontal scanning direction to the one dot width Dh or less.

As set forth above, in the embodiment, the shift can be corrected by only electrical control. Consequently, no additional mechanism is required for the correction, and a structure is simple. It is also possible to correct without damage to a print surface. In the embodiment, the correction is made when the sheet is shifted by Dh/2 or more. However, it must be noted that a desired shift permissible value $\Delta X_0$ may be set, and the correction may be made when the amount of shift becomes $\Delta X_0$ or more. Further, though the thermal head is used as the printing means in the embodiment, it is to be noted that the present invention should not be limited to this. For example, the printing means may include other printing means in an ink jet mode, an electrostatic recording mode, an ion jet flow mode having a structure in which recording elements are arrayed on a line with a width corresponding to a desired recording width, and the printing means may be configured as set forth above, resulting in the same effect.

Embodiment 26

Figure 47:
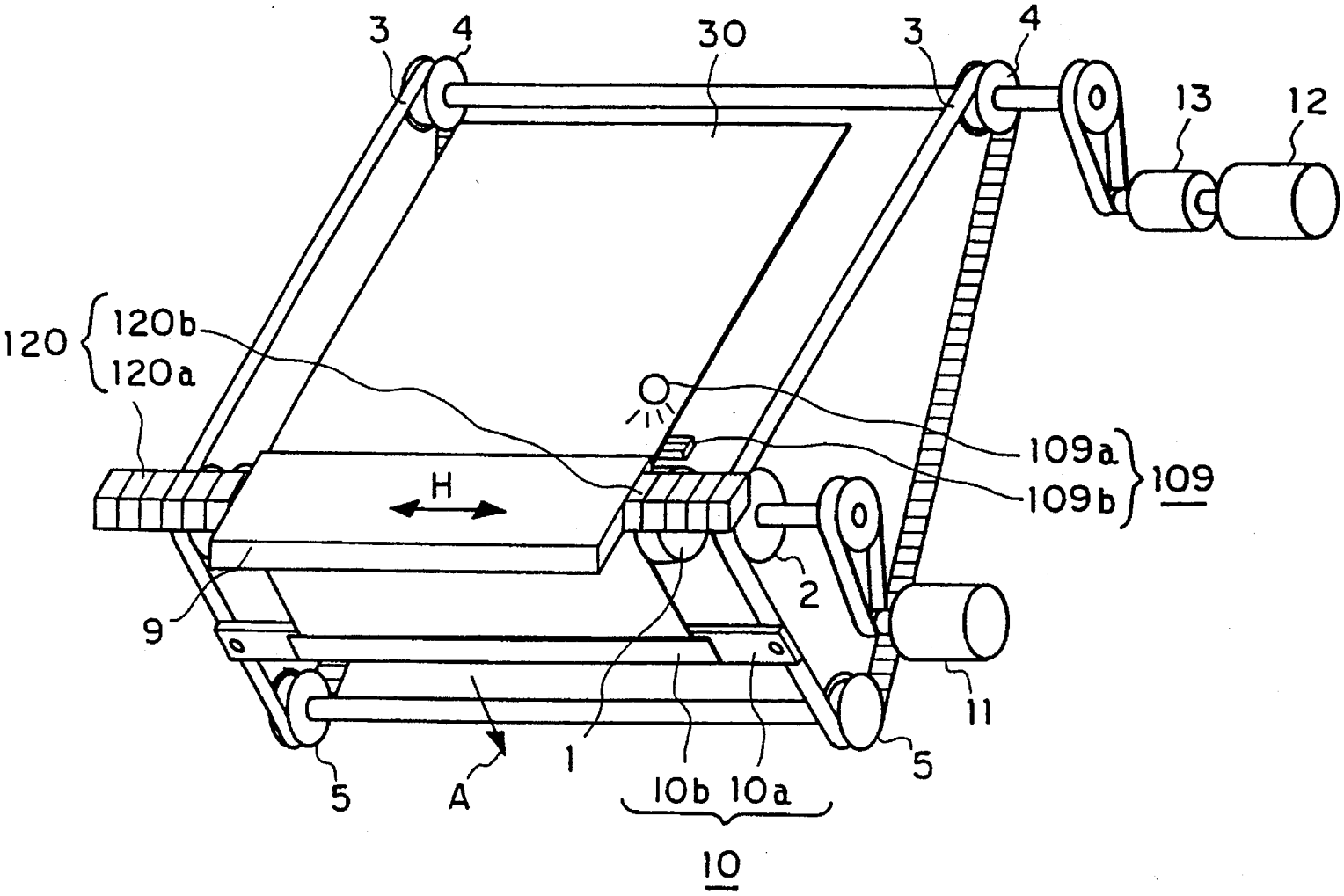
FIG. 47 is a perspective view showing an essential structure in the twenty-sixth embodiment of the sheet carrying apparatus of the present invention.

FIG. 47 is a perspective view showing an essential structure in the twenty-sixth embodiment of the sheet carrying apparatus of the present invention. In FIG. 47, the same reference numerals are used for component parts identical with those shown in FIGS. 49 and 50. In FIG. 47, an ink sheet 6 is omitted.

As shown in FIG. 47, a distal end of a sheet 30 is clamped by a clamper 10, and the sheet 30 is circularly carried in a direction shown by the arrow A in the drawing by forward rotation of a sheet carrying roller 1. At the time, the clamper 10 circulates while applying predetermined tensile strength to the sheet 30. In the downstream of the vicinity of the sheet carrying roller 1, a position detecting sensor (position detecting means) 109 is disposed at a position at which the edge of the sheet 30 can be detected. The position detecting sensor 109 includes a light source 109*a* and one line-type CCD sensor 109*b* so as to detect the position of the sheet edge in a horizontal scanning direction. Further, a thermal head 9 is brought into pressure contact with the sheet carrying roller 1 with a predetermined pressure contacting force by an unillustrated spring through the sheet 30 and the unillustrated ink sheet 6. Further, linear actuators 120*a* and 120*b* forming head position control means are secured to both ends of the thermal head 9 so as to be extensible in the horizontal scanning direction. For example, piezoelectric elements are used as the linear actuators 120*a* and 120*b*. In addition, one ends of the linear actuators 120*a* and 120*b* are secured to unillustrated side plates so that the linear actuators 120*a* and 120*b* can be moved up/down together with the thermal head 9.

In the above structure, the two linear actuators 120*a* and 120*b* are expanded and contracted in opposite phase, and the thermal head 9 can thereby be moved in directions shown by the arrow H. A moving distance can be controlled by voltage applied to the linear actuators 120*a* and 120*b*.

Figure 48:
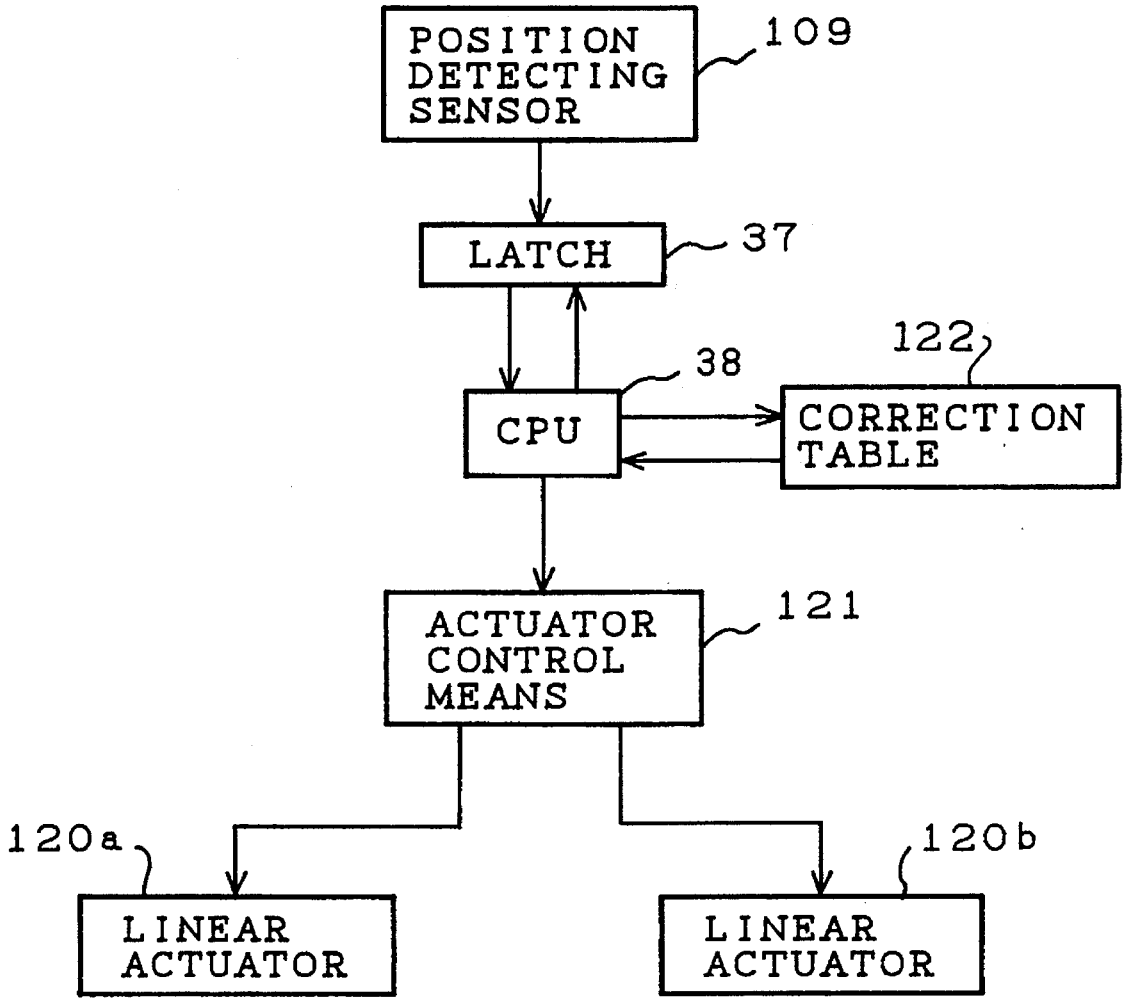
FIG. 48 is a block diagram showing a control system in the twenty-sixth embodiment.

A description will now be given of a control system in the embodiment with reference to a block diagram of FIG. 48. Output from the position detecting sensor 109 is outputted to a latch 37 on demand. In synchronization with a signal inputted from a CPU 38, the latch 37 outputs the output signal from the position detecting sensor 109 to the CPU 38. The CPU 38 compares the output signal from the position detecting sensor 109 with reference position data of a predetermined sheet edge so as to calculate an amount of shift of the sheet 30 in the horizontal scanning direction. Then, the calculated amount of shift is compared with a predetermined amount of permissible shift. When the amount of shift exceeds the amount of permissible shift, applied voltage data is read from a correction table 122. The correction table 122 previously contains a relationship between the amount of movement of the thermal head in the horizontal scanning direction and the applied voltage. The CPU 38 outputs the applied voltage data to actuator control means 121. The actuator control means 121 drives the linear actuators 120*a* and 120*b* depending upon the inputted applied voltage data.

A description will now be given of a correcting operation in the embodiment using the structure. Initially, the CPU 38 detects an edge position of the sheet 30 immediately before print of each color through the position detecting sensor 109. The CPU 38 calculates an amount of shift ΔX of the sheet in the horizontal scanning direction by subtracting the predetermined reference position from the detected edge position. When the amount of shift ΔX exceeds the amount of permissible shift, the thermal head 9 is moved by the linear actuators 120*a* and 120*b* according to the amount of shift ΔX. At the time, the two linear actuators 120*a* and 120*b* are expanded and contracted such that the thermal head 9 can be moved by a distance ΔX in the same direction as that in which the sheet 30 is shifted. Therefore, relative misregistration between the sheet 30 and the heating area on the thermal head 9 in the horizontal scanning directions H can be canceled, and print can be started from a desired reference position. After the completion of movement of the thermal head 9, the sheet carriage and the print are started. During the print, while the sheet is carried, the position of the sheet is detected on demand. When the detected amount of shift ΔX exceeds the amount of permissible shift, according to the same method as described above, the two linear actuators 120*a* and 120*b* move the thermal head by the distance ΔX from the reference position in the direction in which the sheet 30 is shifted.

The above correcting operation is performed for each color until the print is completed. It is thereby possible to reduce a deviation of the print position in the horizontal scanning direction to the amount of permissible shift or less on the right and left sides of the reference position.

Though the thermal head is used as the printing means in the embodiment, it is to be noted that the present invention should not be limited to this. For example, the printing means may include other printing means in an ink jet mode, an electrostatic recording mode, an ion jet flow mode having a structure in which recording elements are arrayed on a line with a width corresponding to a desired recording width, and the printing means may be configured as set forth above, resulting in the same effect.

In the embodiment, the linear actuators including the piezoelectric elements are directly connected to the thermal head. However, the linear actuator may be connected to the thermal head through a moving amount amplifier mechanism. Further, though the piezoelectric elements are used as the linear actuators forming the head position control means, it is to be noted that the present invention should not be limited to this. It is also possible to use, for example, a linear actuator which can move the head in the horizontal scanning direction, or a motor coupled with a cam, resulting in the same effect. Further, in the embodiment, the head position control means are provided for both ends of the thermal head. However, it is to be noted that the head position control means may be provided for only one end, urging means such as spring may be provided for the other end, and the thermal head may continuously be urged to the head position control means by urging pressure.

In the present embodiment, a correction table, in which relations for control for the amount of movement of the thermal head are stored, is previously employed. However, it may be possible that an optical sensor or the like detects the amount of movement of the thermal head and the amount of movement of the thermal head is controlled by feedback of detected amount of movement of the thermal head. Further it may be possible that the head position control means comprises a rough moving means for moving the thermal head in an interval corresponding to one dot (one printing element on the thermal head) or more and a fine moving means for moving the thermal head in an interval corresponding to less than one dot. A linear actuator, a motor connected with cam or the like is used for example as the rough moving means. A piezoelectric element or the like is used for example as the fine moving means. In the above constructed apparatus, fine position correction is achieved in case a shift corresponding to a few dot or more is occurred.

In the twenty-fifth embodiment and the twenty-sixth embodiment, only one position detecting sensor is disposed to detect the edge position of the sheet. However, it is to be noted that the present invention should not be limited to this. Two position detecting sensors may be disposed to extend in a sheet carrying direction such that a sensor detecting direction is perpendicular to the sheet carrying direction. In addition, by grasping a positional relationship between the two position detecting sensors and the sheet carrying roller, it is possible to calculate the sheet edge position on the sheet carrying roller depending upon the sheet edge positions at positions of the two detecting sensors. Consequently, even when the sheet is rotated due to skew, it is possible to more accurately detect the sheet edge position on the sheet carrying roller than would detect by one sensor.

Embodiment 27

The embodiment relates to a sheet carrying apparatus to carry a sheet 30 a plurality of times on the same carrying path, in particular, like a color printer. In the fifth to eleventh embodiments, on the basis of first carriage, correction is made during second or later carriage. A description will now be given of the operation. No correction is made at a time of the first carriage of the sheet 30, and a sheet edge position during carriage, detected by a position detecting sensor 109, is stored in a memory. Further, in second or later carriage, skew is calculated depending upon sheet position data stored at the time of the first carriage so as to correct the skew.

In such a way, it is possible to reduce a relative error of the sheet position in a carrying direction for each carriage, and reduce misregistration of color, in particular, in the color printer. Further, it is possible to reduce a variation in a detection accuracy generated due to a difference in edge shape (particularly, in the straightness) of the sheets 30 detected by the position detecting sensor 109.

In the embodiment, a position detecting sensor 34 and the position detecting sensor 109 include a line-type CCD sensor and a light source. However, it must be noted that the present invention should not be limited to this. For example, a two-dimensional CCD sensor and a light source may be employed. Alternatively, there may be employed a contact-type sensor contacting a side edge of the sheet.

In the above embodiments, the skew, the carriage error, and the shift of the sheet during carriage are discretely corrected. However, any one of the first, and third to fourteenth embodiments may be combined with any one of the twenty-fourth to twenty-sixth embodiments. As a result, it is possible to concurrently correct the skew and the shift of the sheet during carriage. Alternatively, any one of the second, and seventeenth and nineteenth embodiments may be combined with any one of the twenty-fourth to twenty-sixth embodiments. As a result, it is possible to concurrently correct the skew, the carriage error, and the shift of the sheet during carriage.

In the fifth to twelfth embodiments, and twentieth and twenty-sixth embodiments, the reference position of the sheet is previously stored. However, an initial sheet position immediately before/after the carriage is started may be stored for each carriage, and may be defined as a reference position in subsequent carriage.

Alternatively, in the fifth to eleventh embodiments, the carriage load applying-means may be provided such that the carriage load is transmitted to a back surface of the sheet. As a result, it is thereby possible to avoid, for example, damage to the print surface due to the carriage load.

As set forth above, the sheet carrying apparatus includes the position detecting means for detecting the position of the sheet during carriage in the direction perpendicular to the sheet carrying direction, the calculating means for calculating the skew angle of the sheet depending upon the deviation of the position of the sheet detected by the position detecting means from the predetermined reference position, the carrying force control means for controlling the carrying force for the sheet during carriage, disposed on the right and left sides with respect to the sheet center line in the sheet carrying direction so as to extend in the direction perpendicular to the sheet carrying direction, and the driving means for independently driving the right and left carrying force control means depending upon the skew angle calculated by the calculating means. As a result, it is possible to correct the skew of the sheet without stopping the carriage of the sheet.

Alternatively, the sheet carrying apparatus includes the carriage detecting means for detecting the amount of carriage of the sheet during carriage at the plurality of positions in the direction perpendicular to the sheet carrying direction, the calculating means for calculating the skew angle of the sheet and the deviation of the amount of carriage depending upon the deviations of the amounts of carriage detected by the carriage detecting means from the predetermined amount of reference carriage, the carrying force control means for controlling the carrying force for the sheet during carriage, disposed on the right and left sides with respect to the sheet center line in the sheet carrying direction so as to extend in the direction perpendicular to the sheet carrying direction, and the driving means for independently driving the right and left carrying force control means depending upon the skew angle calculated by the calculating means, and the carriage control means for controlling the amount of sheet carriage depending upon the deviation of the amount of carriage calculated by the calculating means. As a result, it is possible to correct the skew of the sheet and the deviation of the carriage without stopping the carriage of the sheet.

Alternatively, the carrying force control means include the carriage load applying means for applying the carriage load to the sheet at a portion in the upstream of the sheet carrying means. In this case, when the sheet is skewed, the carriage load is applied to the sheet on the side carried more ahead, or the carriage load is removed from the sheet on the side whose carriage is delayed, thereby correcting the skew of the sheet during carriage.

Alternatively, the carrying force control means include the carrying force applying means for applying the carrying force to the sheet at a portion in the downstream of the sheet carrying means. In this case, when the sheet is skewed, the carrying force in the carrying direction is applied to the sheet on the side whose carriage is delayed, or the carrying force is removed from the sheet on the side carried more ahead, thereby correcting the skew of the sheet during carriage.

Alternatively, the carriage load applying means are disposed in the upstream of the sheet carrying means, and include the load rollers rotating by pressure contact with the sheet with the predetermined pressure contacting force, the braking means able to apply the constant or predetermined range of braking force to the load rollers, and the following rollers disposed at positions opposed to the load rollers through the sheet. In this case, it is possible to correct the skew of the sheet during carriage without stopping the carriage of the sheet, and simplify the structure of the sheet carrying apparatus.

Alternatively, the carriage load applying means are disposed in the upstream of the sheet carrying means, and include the load members to contact the sheet so as to apply the carriage load to the sheet, the pressure contact members disposed at positions opposed to the load members through the sheet, and a pressure contact mechanism to bring the pressure contact members into pressure contact with or disengage the pressure contact members from the sheet. In this case, it is possible to correct the skew of the sheet during carriage without stopping the carriage of the sheet, and apply the carriage load to the sheet in a simple structure.

Alternatively, the carriage load applying means are disposed in the upstream of the sheet carrying means, and include the electrodes disposed at positions in contact with the sheet, and the power source to apply voltage to the electrodes. In this case, it is possible to correct the skew of the sheet during carriage without stopping the carriage of the sheet, and provide smaller carriage load applying means.

Alternatively, the carriage load applying means are disposed in the upstream of the sheet carrying means, and include the magnetic members having magnetism, the inductors disposed at positions opposed to the magnetic members through the sheet and able to attract the magnetic members, the power source to apply current to the inductors, and the supporting mechanism to clamp the sheet between or release the sheet from between the magnetic members and the inductors. In this case, it is possible to correct the skew of the sheet during carriage without stopping the carriage of the sheet, and provide smaller carriage load applying means.

Alternatively, the carriage load applying means are disposed in the downstream of the sheet carrying means, and include the clamp mechanism to clamp the distal end of the carried sheet, and the clamp drive mechanism to independently carry, by a predetermined driving force, the clamp mechanism on the right and left sides with respect to the sheet center line in the sheet carrying direction. In this case, without a complicated mechanism, it is possible to correct the skew of the sheet during carriage without stopping the carriage of the sheet.

Alternatively, the sheet carrying apparatus carries the sheet and the ink sheet, and include vertically movable mechanisms to move the ink sheet roller in a direction in contact with the ink sheet and in its reverse direction. In this case, it is possible to correct the skew of the sheet during carriage without stopping the carriage of the sheet, and apply the carrying force without providing the carrying force control means in the course of the sheet carrying path.

Alternatively, in the sheet carrying apparatus, one sheet is carried a plurality of times on the same carrying path, the sheet position detected during the first carriage is stored, and the skew angle is calculated by using the stored sheet position as the reference position during the second or later carriage. In this case, without previously setting the reference position, it is possible to correct the skew of the sheet during carriage without stopping the carriage of the sheet.

Alternatively, the carriage detecting means are disposed on the right and left sides with respect to the sheet center line in the sheet carrying direction so as to extend in the direction perpendicular to the sheet carrying direction, and include the carriage detecting rollers respectively contacting the sheet so as to independently follow and rotate, and the sensors to detect the respective rotations of the carriage detecting rollers. Further, the calculating means includes the first calculating means for calculating carriage times depending upon output signals from the sensors so as to calculate the amounts of deviation of the predetermined reference time from the carriage times, and the second calculating means for calculating the skew angle of the sheet and the deviation of the amount of carriage depending upon the amounts of deviation calculated by the first calculating means. In this case, it is possible to find the skew angle of the sheet during carriage and the deviation of the amount of carriage in a simple mechanism, and correct the skew of the sheet and the deviation of the amount of carriage during carriage without stopping the carriage of the sheet.

Alternatively, the carriage detecting rollers and the load applying members are disposed at positions mutually opposed through the sheet, and are brought into pressure contact with a predetermined pressure contacting force. In this case, a structure of the apparatus can be simplified.

Alternatively, the second calculating means calculates the deviation of the amount of carriage for each n rotation (n is a natural number) of the carriage detecting roller. In this case, it is possible to correct the skew of the sheet and the deviation of the amount of carriage during carriage without stopping the carriage of the sheet. Further, it is possible to reduce a variation in detected values of the amount of carriage due to eccentricity of the detecting roller.

Alternatively, the sheet carrying apparatus in which one sheet is carried a plurality of times on the same carrying path, includes the registration mechanism to perform origin registration of the rotation angle of the carriage detecting roller for each carriage of the sheet. In this case, it is possible to reduce a variation in detected values of the amount of carriage due to eccentricity of the detecting roller.

Alternatively, in the sheet carrying apparatus, one sheet is carried a plurality of times on the same carrying path, the amount of carriage or the carriage time of the sheet detected during the first carriage is stored, and the deviation of the amount of carriage is calculated by using the stored amount of carriage or the stored carriage time of the sheet as the amount of reference carriage or the reference carriage time during the second or later carriage. In this case, it is possible to correct the skew of the sheet and the deviation of the amount of carriage during carriage without stopping the carriage of the sheet. Further, it is possible to reduce a variation in diameter of the carriage detecting roller due to wear, and reduce an effect due to the variation in diameter of the detecting roller.

Alternatively, in the sheet carrying apparatus, the carrying force control means control the carrying force for the sheet at least once on the right and left sides depending upon the calculated skew angle so as to concurrently correct the skew angle and the shift of the sheet during carriage. In this case, it is possible to correct the skew and the deviation during carriage without stopping the carriage of the sheet.

Alternatively, the sheet carrying apparatus includes the printing means for printing onto the sheet through the print area, the position detecting means for detecting the position of the sheet during carriage in the direction perpendicular to the sheet carrying direction, the shift calculating means for calculating the amount of shift of the sheet depending upon the deviation of the position of the sheet detected by the position detecting means from the predetermined reference position, and the shift correcting means for moving the print area of the printing means in the direction perpendicular to the sheet carrying direction depending upon the amount of shift calculated by the shift calculating means. In this case, it is possible to correct the deviation of the print position generated due to the shift of the sheet without moving the sheet.

Alternatively, the printing means can print onto a width longer than a width of the print area in the direction perpendicular to the sheet carrying direction, and the shift correcting means shifts the print area in the direction perpendicular to the sheet carrying direction depending upon the amount of shift calculated by the shift calculating means. In this case, it is possible to correct the deviation of the print position generated due to the shift by electrically controlling the print area.

Alternatively, the shift correcting means includes the head moving means for moving the printing means in the direction perpendicular to the sheet carrying direction, and the head moving means are controlled depending upon the amount of shift calculated by the shift calculating means. In this case, it is possible to correct the deviation of the print position generated due to the shift in a simple structure.

Alternatively, in the sheet carrying apparatus, one sheet is carried a plurality of times on the same carrying path, the sheet position detected during the first carriage is stored, and the amount of shift is calculated by using the stored sheet position as the reference position during the second or later carriage. In this case, it is possible to correct the deviation of the print position due to the shift, and reduce a variation in the detected amount of shift of the sheet generated due to a slight variation in sheet shape.

What is claimed is:

1. A sheet carrying apparatus, comprising:

sheet carrying means for carrying a sheet;

position detecting means for detecting a position of the sheet during carriage in a direction perpendicular to a sheet carrying direction;

calculating means for calculating a skew angle of the sheet depending upon a deviation of the position of the sheet detected by the position detecting means from a predetermined reference position;

carrying force control means, independent of said sheet carrying means, disposed on the right and left sides with respect to a sheet center line in the sheet carrying direction so as to extend in the direction perpendicular to the sheet carrying direction, for controlling, during carriage, a carrying force for the sheet carried by the sheet carrying means; and driving means for independently driving the right and left carrying force control means depending upon the skew angle calculated by the calculating means;

wherein the carrying force control means include carriage load applying means for applying carriage load to the sheet at a portion in the upstream of the sheet carrying means; and wherein the carriage load applying means are disposed in the upstream of the sheet carrying means, and include load rollers rotating by pressure contact with the sheet with a predetermined pressure contacting force, braking means able to apply a constant or predetermined range of braking force to the load rollers, and following rollers disposed at positions opposed to the load rollers through the sheet.

2. A sheet carrying apparatus according to claim 1, wherein said carriage load applying means comprise independent electromagnetic clutches, and said braking means comprise independent torque limiters; and wherein said electromagnetic clutches connect or release said load rollers with said torque limiters so as to apply or release pressure to the sheet.

* * * * *